US007416823B2

(12) United States Patent
Yanagawa et al.

(10) Patent No.: US 7,416,823 B2
(45) **Date of Patent: *Aug. 26, 2008**

(54) ELECTROPHOTOGRAPHIC PHOTOCONDUCTOR, AND IMAGE FORMATION METHOD, IMAGE FORMATION APPARATUS, AND PROCESS CARTRIDGE FOR IMAGE FORMATION APPARATUS USING THE SAME

(75) Inventors: Yoshiki Yanagawa, Shizuoka (JP); Hiroshi Ikuno, Kanagawa (JP); Hongguo Li, Shizuoka (JP); Kazukiyo Nagai, Shizuoka (JP); Hiroshi Tamura, Shizuoka (JP); Tetsuro Suzuki, Shizuoka (JP); Naohiro Toda, Kanagawa (JP); Yoshiaki Kawasaki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 375 days.

This patent is subject to a terminal disclaimer.

(21) Appl. No.: 11/033,802

(22) Filed: Jan. 13, 2005

(65) Prior Publication Data

US 2005/0158641 A1 Jul. 21, 2005

(30) Foreign Application Priority Data

Jan. 15, 2004 (JP) ..... 2004-007871
May 19, 2004 (JP) ..... 2004-148853
Dec. 24, 2004 (JP) ..... 2004-372872

(51) Int. Cl.
*G03G 5/147* (2006.01)
*G03G 5/047* (2006.01)

(52) U.S. Cl. ..... 430/58.7; 430/66; 430/123.42; 430/123.43; 399/159

(58) Field of Classification Search ..... 430/66, 430/58.7, 123.42, 123.43
See application file for complete search history.

(56) References Cited

U.S. PATENT DOCUMENTS

| | | | |
|---|---|---|---|
| 3,286,704 | A | 11/1966 | Dannis |
| 4,772,525 | A | 9/1988 | Badesha et al. |
| 5,322,753 | A | 6/1994 | Tamura et al. |
| 5,488,137 | A | 1/1996 | Tamura et al. |
| 5,492,784 | A | 2/1996 | Yoshikawa et al. |
| 5,608,010 | A | 3/1997 | Tamura et al. |
| 5,871,876 | A | 2/1999 | Ikuno et al. |
| 5,976,746 | A | 11/1999 | Tanaka et al. |
| 6,027,846 | A | 2/2000 | Shimada et al. |
| 6,030,733 | A | 2/2000 | Kami et al. |
| 6,066,428 | A | 5/2000 | Katayama et al. |
| 6,151,468 | A | 11/2000 | Kami et al. |
| 6,172,176 | B1 | 1/2001 | Tanaka et al. |
| 6,187,492 | B1 | 2/2001 | Ri et al. |
| 6,194,535 | B1 | 2/2001 | Katayama et al. |
| 6,210,848 | B1 | 4/2001 | Nagai et al. |
| 6,316,577 | B1 | 11/2001 | Shimada et al. |
| 6,432,596 | B2 | 8/2002 | Ikuno et al. |
| 6,444,387 | B2 | 9/2002 | Ri et al. |
| 6,486,293 | B1 | 11/2002 | Ri et al. |
| 6,548,216 | B2 | 4/2003 | Kawamura et al. |
| 6,576,386 | B1 | 6/2003 | Ri et al. |
| 6,686,114 | B2 | 2/2004 | Sakon et al. |
| 6,790,571 | B2 | 9/2004 | Kawamura et al. |
| 2003/0077531 | A1 | 4/2003 | Suzuki et al. |
| 2003/0190540 | A1 | 10/2003 | Shoshi et al. |
| 2003/0198881 | A1 | 10/2003 | Kawamura et al. |
| 2003/0224268 | A1 | 12/2003 | Ikuno et al. |
| 2004/0002574 | A1 | 1/2004 | Ri et al. |
| 2004/0048177 | A1 | 3/2004 | Tamoto et al. |
| 2004/0053152 | A1 | 3/2004 | Nagai et al. |
| 2004/0131960 | A1 | 7/2004 | Kawamura et al. |
| 2004/0248024 | A1 | 12/2004 | Suzuki et al. |
| 2004/0253527 | A1 | 12/2004 | Suzuki et al. |
| 2005/0158641 | A1 | 7/2005 | Yanagawa et al. |

FOREIGN PATENT DOCUMENTS

| | | |
|---|---|---|
| JP | 56-48637 | 5/1981 |
| JP | 63-285552 | 11/1988 |
| JP | 64-1728 | 1/1989 |
| JP | 64-9964 | 1/1989 |
| JP | 64-13061 | 1/1989 |
| JP | 64-19049 | 1/1989 |
| JP | 1-241559 | 9/1989 |
| JP | 4-11627 | 1/1992 |
| JP | 4-175337 | 6/1992 |

(Continued)

OTHER PUBLICATIONS

STN Registry database information on molecular formulae C9H20O7 and C10H22O7 (2007).*

(Continued)

*Primary Examiner*—Christopher RoDee
(74) *Attorney, Agent, or Firm*—Oblon, Spivak, McClelland, Maier & Neustadt, P.C.

(57) ABSTRACT

An electrophotographic photoconductor having at least a photoconductive layer on an electrically conductive support, in which a surface layer of the photoconductive layer can be obtained by curing at least a free-radical-polymerizable monomer having no charge transporting structure, represented by general formula (A)

and a one-functional free-radical-polymerizable compound having a charge transporting structure, wherein $R_{71}$, $R_{72}$, $R_{73}$, $R_{74}$, $R_{75}$, and $R_{76}$ are described in the specification.

10 Claims, 3 Drawing Sheets

FOREIGN PATENT DOCUMENTS

| | | | |
|---|---|---|---|
| JP | 4-183719 | | 6/1992 |
| JP | 4-225014 | | 8/1992 |
| JP | 4-230767 | | 8/1992 |
| JP | 4-281461 | | 10/1992 |
| JP | 4-230420 | | 11/1992 |
| JP | 5-19497 | | 1/1993 |
| JP | 5-70595 | | 3/1993 |
| JP | 5-232727 | | 9/1993 |
| JP | 5-310904 | | 11/1993 |
| JP | 6-234836 | | 8/1994 |
| JP | 6-234837 | | 8/1994 |
| JP | 6-234838 | | 8/1994 |
| JP | 6-234839 | | 8/1994 |
| JP | 6-234840 | | 8/1994 |
| JP | 6-234841 | | 8/1994 |
| JP | 6-236050 | | 8/1994 |
| JP | 6-236051 | | 8/1994 |
| JP | 6-295077 | | 10/1994 |
| JP | 7-56374 | | 3/1995 |
| JP | 8-176293 | | 7/1996 |
| JP | 8-208820 | | 8/1996 |
| JP | 8-211640 | | 8/1996 |
| JP | 8-253568 | | 10/1996 |
| JP | 8-269183 | | 10/1996 |
| JP | 08262779 | A * | 10/1996 |
| JP | 9-43883 | | 2/1997 |
| JP | 9-62019 | | 3/1997 |
| JP | 9-71642 | | 3/1997 |
| JP | 9-87376 | | 3/1997 |
| JP | 9-104746 | | 4/1997 |
| JP | 9-110974 | | 4/1997 |
| JP | 9-110976 | | 4/1997 |
| JP | 9-157378 | | 6/1997 |
| JP | 9-221544 | | 8/1997 |
| JP | 9-227669 | | 9/1997 |
| JP | 9-235367 | | 9/1997 |
| JP | 9-241369 | | 9/1997 |
| JP | 9-268226 | | 10/1997 |
| JP | 9-272735 | | 10/1997 |
| JP | 9-302084 | | 11/1997 |
| JP | 9-302085 | | 11/1997 |
| JP | 9-328539 | | 12/1997 |
| JP | 10-73944 | | 3/1998 |
| JP | 2000-66425 | | 3/2000 |
| JP | 3164426 | | 3/2001 |
| JP | 3194392 | | 6/2001 |
| JP | 2001175016 | A * | 6/2001 |
| JP | 3262488 | | 12/2001 |

OTHER PUBLICATIONS

U.S. Appl. No. 10/880,622, filed Jul. 1, 2004, Shinichi Kawamura, et al.
U.S. Appl. No. 10/937,687, filed Sep. 10, 2004, Shoshi, et al.
U.S. Appl. No. 10/974,814, filed Oct. 28, 2004, Tamoto, et al.
U.S. Appl. No. 10/944,003, filed Sep. 20, 2004, Yanagawa, et al.
U.S. Appl. No. 11/750,570, filed May 18, 2007, Ikuno, et al.
U.S. Appl. No. 11/736,258, filed Apr. 17, 2007, Kawasaki, et al.
U.S. Appl. No. 11/685,441, filed Mar. 13, 2007, Yanagawa, et al.
U.S. Appl. No. 11/692,682, filed Mar. 28, 2007, Mori, et al.
U.S. Appl. No. 11/684,520, filed Mar. 9, 2007, Toshine, et al.
U.S. Appl. No. 11/621,805, filed Jan. 10, 2007, Suzuki, et al.
U.S. Appl. No. 11/562,203, filed Nov. 21, 2006, Nagai, et al.
U.S. Appl. No. 11/561,983, filed Nov. 21, 2006, Sugino, et al.
U.S. Appl. No. 11/563,710, filed Nov. 28, 2006, Inaba, et al.
U.S. Appl. No. 11/616,523, filed Dec. 27, 2006, Fujiwara, et al.
U.S. Appl. No. 11/500,352, filed Aug. 8, 2006, Toshine, et al.
U.S. Appl. No. 11/480,517, filed Jul. 5, 2006, Yanagawa, et al.
U.S. Appl. No. 11/367,786, filed Mar. 6, 2006, Ohta, et al.
U.S. Appl. No. 11/403,012, filed Apr. 13, 2006, Toda.
U.S. Appl. No. 11/332,545, filed Jan. 17, 2006, Tamoto, et al.
U.S. Appl. No. 11/317,048, filed Dec. 27, 2005, Nagai, et al.
U.S. Appl. No. 11/261,751, filed Oct. 31, 2005, Ohshima et al.
U.S. Appl. No. 11/110,937, filed Apr. 21, 2005, Ohshima, et al.
U.S. Appl. No. 11/136,488, filed May 25, 2005, Yanagawa, et al.
U.S. Appl. No. 11/157,060, filed Jun. 21, 2005, Ikuno, et al.
U.S. Appl. No. 11/165,279, filed Jun. 24, 2005, Ohshima, et al.
U.S. Appl. No. 11/157,998, filed Jun. 22, 2005, Tamura, et al.
U.S. Appl. No. 11/272,826, filed Nov. 15, 2005, Kawasaki, et al.
U.S. Appl. No. 11/270,693, filed Nov. 10, 2005, Li, et al.
U.S. Appl. No. 11/834,240, filed Aug. 6, 2007, Hirose, et al.
U.S. Appl. No. 11/926,748, filed Oct. 29, 2007, Yanagawa, et al.
U.S. Appl. No. 11/939,239, filed Nov. 13, 2007, Hirose, et al.
U.S. Appl. No. 11/941,355, filed Nov. 16, 2007, Ikuno, et al.
U.S. Appl. No. 11/943,713, filed Nov. 21, 2007, Ishikawa, et al.
U.S. Appl. No. 12/000,239, filed Dec. 11, 2007, Fujiwara, et al.

* cited by examiner

ELECTROPHOTOGRAPHIC PHOTOCONDUCTOR, AND IMAGE FORMATION METHOD, IMAGE FORMATION APPARATUS, AND PROCESS CARTRIDGE FOR IMAGE FORMATION APPARATUS USING THE SAME

BACKGROUND OF THE INVENTION

1. Field of the Invention

First, the present invention relates to an electrophotographic photoconductor that can realize excellent service durability, stable electrical characteristics, and high quality image formation for a long period, using a photoconductive layer with high abrasive resistance, good film surface properties, and good electrical characteristics.

Second, the present invention relates to an electrophotographic photoconductor that can realize excellent service durability, stable electrical characteristics, and high quality image formation for a long period, using a surface layer with high abrasive resistance, a smooth film surface, and little variation in electrical characteristics dependent on the environment.

Further, the present invention relates to an image formation method, an image formation apparatus and a process cartridge for image formation apparatus using the aforementioned high quality photoconductor with a long operating life.

2. Description of the Related Art

Recently, an organic photoconductor (OPC) is frequently used in a copying machine, a facsimile machine, a laser printer, and a complex machine thereof, due to good performance and various advantages of it, instead of an inorganic photoconductor. As the reasons, for example, (1) excellent optical properties such as a wider wavelength range for light absorption and higher rate of absorption, (2) excellent electrical characteristics such as high sensitive and stable charging property, (3) a wide scope of material selection, (4) easier manufacturing, (5) lower cost, and (6) no toxicity can be listed.

On the other hand, recently, the achievement of high durability of a photoconductor has been desired for the miniaturization of a photoconductor promoted in accordance with the miniaturization of an image formation apparatus, the speeding up of a machine, and the tendency of maintenance-free.

From this viewpoint, since a surface layer of the organic photoconductor is based on a low-molecular-weight charge transportation material and an inactive polymer, the organic photoconductor is generally soft, and, therefore, has a disadvantage of easily causing abrasion by mechanical load from a development system or a cleaning system, when the organic photoconductor is used repeatedly in an electrophotographic process.

In addition, with the miniaturization of the particle diameters of toner particles for the requirement of achieving a high quality image, the increase of the rubber hardness and the contact pressure of a cleaning blade has to be made for improving a cleaning property, which increase is a factor of accelerating the abrasion of the photoconductor. Such abrasion of the photoconductor lowers the sensitivity and degrades electric characteristics such as the charging property, so as to cause the lowering in image density and improper imaging such as background contamination. Also, the damage caused by local abrasion results in insufficient cleaning, and therefore, an image with linear contamination. In the present circumstances, the operating life of the photoconductor, that is, the replacement of the photoconductor, is regulated by the abrasion and the damage.

Accordingly, it is necessary to reduce the aforementioned abrasion for achieving the high durability of an organic photoconductor, and further, an organic photoconductor having good surface properties are required for giving an excellent cleaning property and a transcription property to the organic photoconductor. These problems are required to be solved in the art.

As techniques for improving abrasive resistance of a photoconductive layer, (1) the use of a curable binder in a surface layer (ex. see Japanese Laid-Open Patent Application No. 56-48637), (2) the use of a polymeric charge transportation material (ex. see Japanese Laid-Open Patent Application No. 64-1728), (3) dispersing an inorganic filler in a surface layer (ex. see Japanese Laid-Open Patent Application No. 4-281461) can be provided.

Among these techniques, (1) the use of a curable binder tends to elevate a residual potential and cause lowering in image density due to a low compatibility with a charge transportation material and impurities such as a polymerization initiator and an unreacted residue. Also, (2) the use of a polymeric charge transportation material and (3) dispersing an inorganic filler can improve abrasive resistance to some extent, but have not satisfied sufficiently the resistance required for an organic photoconductor. Additionally, (3) dispersing an inorganic filler tends to elevate a residual potential and cause lowering in image density due to a trap existing on the surface of the inorganic filler. Moreover, these techniques denoted by (1), (2), and (3) have not satisfied sufficiently the overall durability that includes electric durability and mechanical durability required for an organic photoconductor.

Furthermore, a photoconductor that contains a material obtained by curing multi-functional acrylate monomers for improving the abrasive resistance and the damage resistance is known (see Japanese Patent No. 3262488). With respect to the photoconductor, the patent discloses that the material obtained by curing multi-functional acrylate monomers is contained in a protective layer provided on a photoconductive layer. Also, the patent discloses that the protective layer may contain a charge transportation material but no specific explanation. Further, when a low-molecular-weight charge transportation material is simply contained in a surface layer, there is a problem of the compatibility with the cured material, whereby the precipitation of the low-molecular-weight charge transportation material and the production of a crack can be caused to lower the mechanical strength.

Although the patent also discloses that a polycarbonate resin is contained for improving the compatibility, the content of the acryl monomers to be cured is reduced and, consequently, sufficient abrasive resistance cannot be achieved. Additionally, with respect to a photoconductor that contains no charge transportation material in the surface layer, the patent discloses that the surface layer is made be a thin film against the lowering in the electric potential of a light-exposed portion. However, since the film thickness is small, the operating life of the photoconductor is short. Further, the environmental stability of charging electric potential and the electric potential of a light-exposed portion is low and the values of them varies widely dependent on the environment factors such as temperature and humidity and cannot be kept at a sufficient values at present.

Instead, as a technique for improving an abrasive resistance of a photoconductive layer, it is known that a charge transportation layer formed from a coating liquid that contains a monomer having a carbon-carbon double bond, a charge transportation material having a carbon-carbon double bond and a binder resin is provided (ex. see Japanese Patent No.

3194392). The binder resin includes that of having a carbon-carbon double bond and reactivity to the charge transportation material and that of having no carbon-carbon double bond and no reactivity to the charge transportation material.

The photoconductor attracts attention since the photoconductor has both abrasive resistance and good electrical characteristics, but when a binder resin having no reactivity is used, the compatibility of the binder resin with a cured material produced by the reaction of the aforementioned monomers and the charge transportation material is low and layer separation or the production of surface irregularity are made at the time of cross-linking. As the result, it is observed that the photoconductor tends to cause improper cleaning.

As described above, the binder resin disturbs the curing of the monomers. Further, the patent discloses a two-functional monomer as the monomer used in the photoconductor but sufficient cross-link density cannot be obtained by the two-functional monomers since the number of functional groups of the monomer is small and the photoconductor does not satisfy the sufficient abrasive resistance.

Also, when the binder resin having reactivity, due to the small number of functional groups contained in the monomer and the binder resin, it is difficult to balance the extent of monomer coupling in the charge transportation material and the cross-link density of the charge transportation material, and the electrical characteristics and the abrasive resistance are insufficient.

Moreover, a photoconductive layer that contains a compound obtained by curing hole transportation compounds having more than one chain-polymerizable functional group in the molecule thereof is known (ex. see Japanese Laid-Open Patent Application No. 2000-66425).

However, since the bulky hole transportation compound in the photoconductive layer has more than one chain-polymerizable functional group, distortion is caused and the internal stress increases in the cured compound. As the result, the surface layer may easily become rough or produce a crack with time, so that the surface layer does not have sufficient durability.

Thus, the photoconductor having a cross-linked photoconductive layer obtained by chemically bonding the charge transporting structures in these conventional techniques does not have the sufficient overall characteristics at present.

SUMMARY OF THE INVENTION

One of the objects of the present invention to provide an electrophotographic photoconductor that can realize excellent service durability and stable electrical characteristics for a long period, using a photoconductive layer with high abrasive resistance, good film surface properties, and good electrical characteristics.

The object described above is achieved by an electrophotographic photoconductor having at least a photoconductive layer on an electrically conductive support, in which a surface layer of the photoconductive layer can be obtained by curing at least a free-radical-polymerizable monomer having no charge transporting structure, represented by general formula (A)

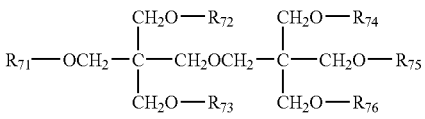

and a one-functional free-radical-polymerizable compound having an a charge transporting structure, wherein each of $R_{71}$, $R_{72}$, $R_{73}$, $R_{74}$, $R_{75}$, and $R_{76}$ is a hydrogen atom or

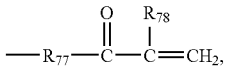

$R_{77}$ is a single bond, an alkylene group, an alkylene ether group, or an alkyleneoxycarbonyl group, $R_{78}$ is a hydrogen atom or a methyl group, and one or none of $R_{71}$ through $R_{76}$ is a hydrogen atom.

Another object of the present invention is to provide an electrophotographic photoconductor that can realize excellent service durability, highly stable electrical characteristics, and high quality image formation for a long period, using a surface layer with high abrasive resistance, a smooth film surface, and littlie variation in electrical characteristics dependent on the environment.

The object described above is achieved by an electrophotographic photoconductor having at least a photoconductive layer on an electrically conductive support, in which a surface layer of the photoconductive layer can be obtained by curing at least a free-radical-polymerizable monomer having no charge transporting structure, represented by general formula (A)

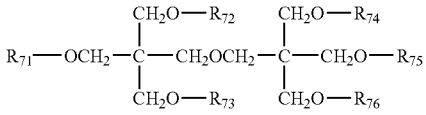

and a one-functional free-radical-polymerizable compound having a charge transporting structure, wherein three through five of $R_{71}$, $R_{72}$, $R_{73}$, $R_{74}$, $R_{75}$, and $R_{76}$ are represented by a general formula (B)

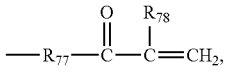

$R_{77}$ is a single bond, an alkylene group, an alkylene ether group, or an alkyleneoxycarbonyl group, $R_{78}$ is a hydrogen atom or a methyl group, functional groups represented by general formula (B) may be identical to or different from each other, a functional group except the functional groups represented by general formula (B) among $R_{71}$, $R_{72}$, $R_{73}$, $R_{74}$, $R_{75}$, and $R_{76}$ is independently a functional group such as an alkyl group which may have a substituent in which the number of carbons is equal to or less than 6.

Further objects of the present invention are to provide an image formation method, an image formation apparatus and a process cartridge for image formation apparatus using the aforementioned high quality photoconductor with a long operating life.

One of the objects described above is achieved by an image formation method in which at least charging process, image-wise light exposure process, developing process, and transcription process are repeated using the electrophotographic photoconductor described above.

Furthermore, one of the objects described above is achieved by an image formation apparatus having the electrophotographic photoconductor described above.

Moreover, one of the objects described above is achieved by a process cartridge for image formation apparatus detachable from a main body of an image formation apparatus, having the electrophotographic photoconductor described above and at least one device selected from the group consisting of a charging device, a developing device, a transcription device, a cleaning device, and a charge elimination device.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Figure 1A:
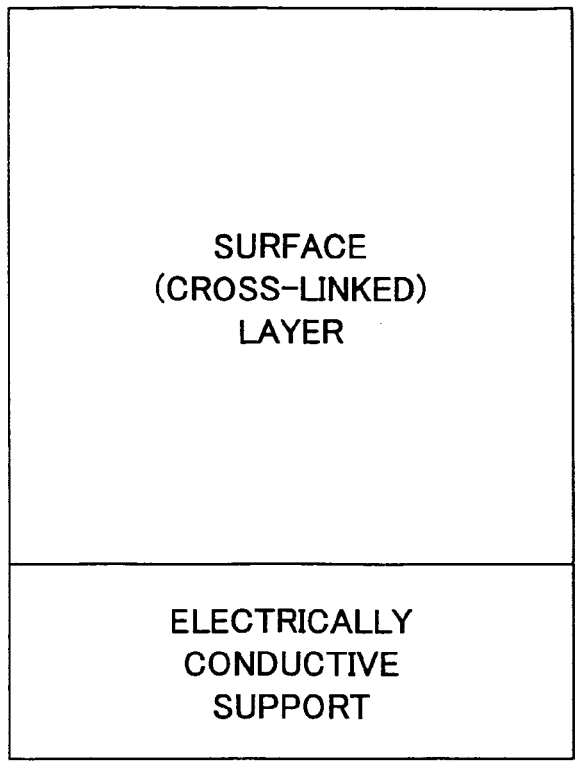
FIGS. 1A and 1B are cross-sectional views of examples of an electrophotographic photoconductor according to the present invention.

The present invention is described in detail below.

The first embodiment of the present invention is an electrophotographic photoconductor having at least a photoconductive layer on an electrically conductive support, in which a surface layer of the photoconductive layer can be obtained by curing at least a free-radical-polymerizable monomer having no charge transporting structure, represented by general formula (A)

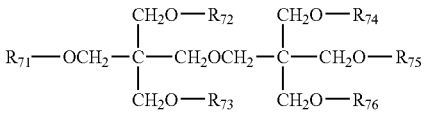

and a one-functional free-radical-polymerizable compound having a charge transporting structure, wherein each of $R_{71}$, $R_{72}$, $R_{73}$, $R_{74}$, $R_{75}$, and $R_{76}$ is a hydrogen atom or

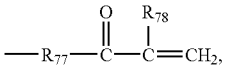

$R_{77}$ is a single bond, an alkylene group, an alkylene ether group, or an alkyleneoxycarbonyl group, $R_{78}$ is a hydrogen atom or a methyl group, and one or none of $R_{71}$ through $R_{76}$ is a hydrogen atom.

According to the first embodiment of the present invention, a three-dimensional network structure can be improved by the free-radical-polymerizable monomer having no charge transporting structure so that a highly hard cross-linked surface layer with a significantly high cross-link density can be obtained. Thus, high abrasive resistance can be achieved.

The second embodiment of the present invention is an electrophotographic photoconductor having at least a photoconductive layer on an electrically conductive support, in which a surface layer of the photoconductive layer can be obtained by curing at least a free-radical-polymerizable monomer having no charge transporting structure, represented by general formula (A)

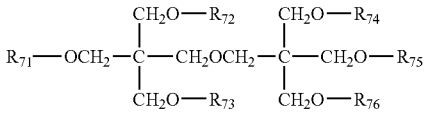

and a one-functional free-radical-polymerizable compound having an charge transporting structure, wherein three through five of $R_{71}$, $R_{72}$, $R_{73}$, $R_{74}$, $R_{75}$, and $R_{76}$ are represented by a general formula (B)

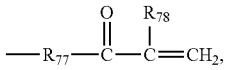

$R_{77}$ is a single bond, an alkylene group, an alkylene ether group, or an alkyleneoxycarbonyl group, $R_{78}$ is a hydrogen atom or a methyl group, functional groups represented by general formula (B) may be identical to or different from each other, a functional group except the functional groups represented by general formula (B) among $R_{71}$, $R_{72}$, $R_{73}$, $R_{74}$, $R_{75}$, and $R_{76}$ is independently a functional group such as an alkyl group which may have a substituent in which the number of carbons is equal to or less than 6. If there are plural functional groups except the functional groups represented by general formula (B) among $R_{71}$, $R_{72}$, $R_{73}$, $R_{74}$, $R_{75}$, and $R_{76}$, the plural functional groups are identical to or different from each other.

In general formula (A), the number of carbons of the alkyl group which may have a substituent in which the number of carbons is equal to or less than 6 in any of $R_{71}$ through $R_{76}$, is equal to or less than 6, preferably, equal to or less than 4, more preferably equal to or less than 2, from the viewpoint of the number of radical-polymerizable functional groups per one molecule. Then, highly dense cross-linking can be realized by increasing the number of radical-polymerizable functional groups per one molecule, so as to be able to obtain high abrasive resistance.

Also, the number of carbons contained in an alkyl moiety of an alkylene group, an alkylene ether group, and an alkyleneoxycarbonyl group as $R_{77}$ is equal to or less than 15, preferably, equal to or less than 10, more preferably equal to or less than 5, from the viewpoint of ensuring the number of radical-polymerizable functional groups per one molecule, as similar to the above description.

According to the second embodiment of the present invention, a three-dimensional network structure can be also improved by the free-radical-polymerizable monomer having no charge transporting structure so that a highly hard cross-linked surface layer with significantly high cross-link density can be obtained. Thus, high abrasive resistance can be achieved.

On the other hand, when a monomer having fewer radical-polymerizable functional group is employed, fewer cross-linkage in cross-linked surface layer is made and, therefore, no significant improvement of the abrasive resistance is achieved.

Furthermore, when a polymer material is contained in the cross-linked surface layer, the improvement of the three-dimensional network structure is disturbed so that the cross-link density lowers, and significant abrasive resistance cannot be obtained in contrast to the present invention.

Also, since the compatibility of the polymer material with a cured material produced by a reaction of the contained polymer material and a radical-polymerizable composition (the free-radical-polymerizable monomer having no charge transporting structure represented by general formula (A) and the free-radical-polymerizable compound having a charge transporting structure) is low, local abrasion due to layer separation occurs, resulting in the damage of the photoconductor surface.

In the present invention, for forming the cross-linked surface layer, the one-functional free-radical-polymerizable compound having a charge transporting structure as well as the free-radical-polymerizable monomer having no charge transporting structure represented by general formula (A) is employed. Accordingly, the compound and the monomer are simultaneously cured at short times, so that highly hard cross-linked surface layer is formed and a photoconductor having a high durability can be obtained. In addition, the problem of the compatibility that occurs in the case of containing the charge transportation material in the cross-linked surface layer is solved. Further, due to the improvement of curing rate, the formation of a smooth surface layer can be realized and a good cleaning property can be maintained for a long period.

Also, a uniform cross-linked film with little distortion can be provided as the cross-linked layer by curing the free-radical-polymerizable monomer having no charge transporting structure represented by general formula (A) and having relatively many reactive functional groups and a high curing rate, and the one-functional free-radical-polymerizable compound having a charge transporting structure. As the result, unreacted charge transportation material in the cross-linked surface layer is reduced so as to significantly improve the homogeneity inside the cross-linked film. Accordingly, both the improvement of the abrasive resistance and the stable electrostatic characteristics can be simultaneously realized.

That is, various kinds of properties of photoconductor such as the abrasive resistance, the cleaning property, and the electrical characteristics do not degrade due to the influence of the environmental conditions such as temperature and humidity in a location for storage or setting of the photoconductor, according to the present invention. Therefore, both the stable abrasive resistance and the high quality image formation can be also realized in the case of printing for a long period.

Also, since the one-functional free-radical-polymerizable compound having a charge transporting structure is incorporated in the cross-linked layer, stable electrical characteristics are exhibited for a long period.

On the other hand, when a low-molecular-weight charge transportation material having no functional group is contained in the cross-linked surface layer, the precipitation of the low-molecular-weight charge transportation material or white turbidity occurs due to the low compatibility and the mechanical strength of the cross-linked surface layer lowers.

Furthermore, when a two- or more-functional charge transporting compound is employed, the compound is secured in the cross-linking structure via plural bondings. However, since the charge transporting structure is very bulky, distortion occurs in a cured resin and the internal stress of the cross-linked surface layer becomes high, so that the cracks or the damages frequently generates due to carrier adhesion, etc. Also, since the compound is secured in the cross-linking structure via plural bondings, an intermediate structure (a cationic radical) at the time of charge transportation cannot stably maintained and, therefore, the lowering in the sensitivity and the elevation of the residual potential of the photoconductor are caused by charge trapping. Such degradation of the electrical characteristics results in lowering image density, thinning character images, etc.

Therefore, According to the present invention, an electrophotographic photoconductor can be realized, which can solve such problems of the conventional techniques and maintain both the improvement of abrasive resistance and the achievement of high quality image simultaneously for a long period.

In other words, the present invention is characterized in that a resin component constituting the cross-linked surface layer is obtained by simultaneously polymerizing compounds having a reactive functional group, more specifically, the free-radical-polymerizable monomer having no charge transporting structure represented by general formula (A) and the one-functional free-radical-polymerizable compound having a charge transporting structure. Accordingly, the improvement of abrasive resistance, the stability of electrical characteristics for a long term, and the improvement of the maintenance of high quality image formation can be realized.

Moreover, the free-radical-polymerizable monomer represented by general formula (A) has an alkyl group as a non-polar group in the molecular structure thereof, so as to reduce affinity to a polar solvent (such as an alcohol and water) and exhibit high durability against an acid or an alkali. Therefore, the hygroscopocity of a cured material in the cross-linked surface layer can be controlled and deformation and the lowering in electrical characteristics caused by moisture absorption can be suppressed. That is, the tolerance for environmental variation, for example, to high temperature and high humidity or low temperature and low humidity, which tolerance is considered to depend on a polar group, is greatly improved using the free-radical-polymerizable monomer represented by general formula (A).

Therefore, according to the present invention, since a resin component constituting the cross-linked surface layer is obtained by simultaneously polymerizing compounds having a reactive functional group, more specifically, the free-radical-polymerizable monomer having no charge transporting structure represented by general formula (A) and the one-functional free-radical-polymerizable compound having a charge transporting structure, an electrophotographic photoconductor can be realized, which can simultaneously achieve both the improvement of abrasive resistance and the maintenance of high quality image for a long term and greatly improve the tolerance against the environmental variation.

Next, component materials of coating liquid for cross-linked surface layer used in the present invention are explained.

The free-radical-polymerizable monomer having no charge transporting structure used for the present invention is represented by general formula (A), for which a monomer having 5 or more radical-polymerizable functional groups such as an acryloyloxy group or an methacryloyloxy group can be provided.

The compound having 5 or more acryloyloxy groups can be obtained, for example, by esterification reaction or trans-esterification reaction using a compound having 5 or more hydroxyl groups in the molecule thereof and an acrylic acid, an acrylate salt, an acryloyl halide, or an acrylate ester. Also, the compound having 5 or more methacryloyloxy groups can be obtained can be similarly obtained. Additionally, radical-polymerizable functional groups in a monomer having 5 or more radical-polymerizable functional group may be identical to or different from each other.

The free-radical-polymerizable monomer having no charge transporting structure used for the present invention is represented by general formula (A), for which a monomer having 3 through 5 radical-polymerizable functional groups such as an acryloyloxy group or a methacryloyloxy group can be provided.

The compound having 3 through 5 acryloyloxy groups can be obtained, for example, by esterification reaction or trans-esterification reaction using a compound having 3 through 5 hydroxyl groups in the molecule thereof and an acrylic acid, an acrylate salt, an acryloyl halide, or an acrylate ester. Also, the compound having 3 through 5 methacryloyloxy groups can be obtained can be similarly obtained. Additionally, radical-polymerizable functional groups in a monomer having 3 through 5 radical-polymerizable functional group may be identical to or different from each other.

As the free-radical-polymerizable monomer having no charge transporting structure represented by general formula (A), the following compound can be illustrated but the monomer is not limited to these compounds.

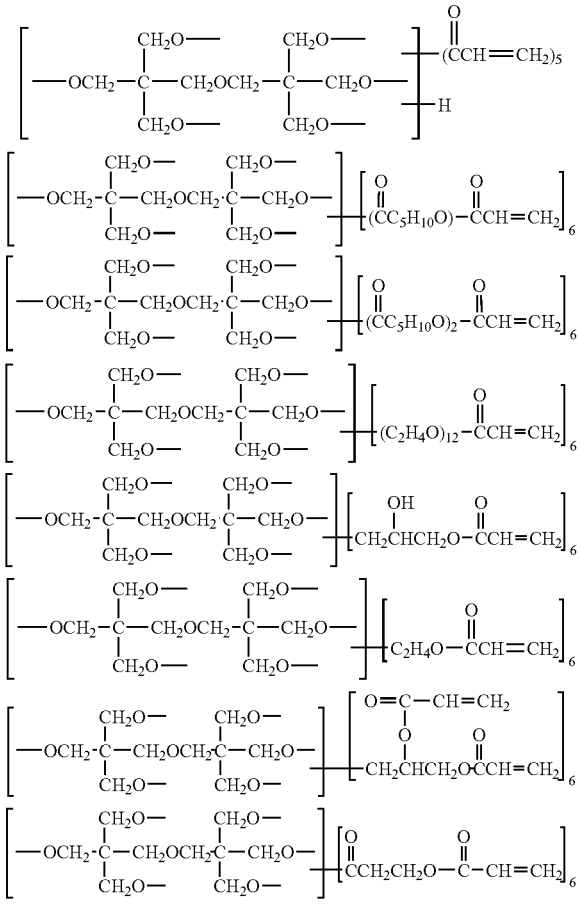

-continued

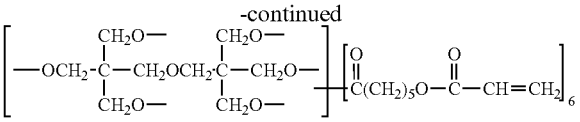

alkyl-modified di-penta-erythritol pentaacrylate (KAYARAD D-310 produced by NIPPON KAYAKU CO., LTD.)

alkyl-modified di-penta-erythritol tetraacrylate (KAYARAD D-320 produced by NIPPON KAYAKU CO., LTD.)

alkyl-modified di-penta-erythritol triacrylate (KAYARAD D-330 produced by NIPPON KAYAKU CO., LTD.)

These compounds may be used singularly or in combination.

Also, the content of the free-radical-polymerizable monomer having no charge transporting structure represented by general formula (A) used for the cross-linked surface layer is 5 through 80% by weight, preferably 10 through 70% by weight of the total weight of the cross-linked surface layer. If the monomer content is less than 5% by weight, the three-dimensional cross-link density of the cross-linked surface layer is low and, therefore, significant abrasive resistance is not achieved, compared to the use of conventional thermoplastic binder resin. On the other hand, if the monomer content is over 80% by weight, the content of the charge transportation compound is low and, therefore, the electrical characteristics degrade.

The one-functional free-radical-polymerizable compound having a charge transporting structure used for the present invention is a compound having a hole transporting structure such as triarylamine, hydrazone, pyrazoline, and carbazole or an electron transporting structure such as condensed polycyclic quinone, diphenoquinone, and an electron-withdrawing aromatic ring with a cyano group or a nitro group, and having a radical-polymerizable functional group.

The radical-polymerizable functional group is not particularly limited if the radical-polymerizable functional group has a carbon-carbon double bond and is a radical-polymerizable group.

As the radical-polymerizable functional group, for example, 1-substituted ethylene functional group and 1,1-substituted ethylene functional group described below are provided.

(1) As the 1-substituted ethylene functional group, for example, a functional group represented by the following formula (4):

$$CH_2{=}CH{-}X_1{-}$$

can be provided. In formula (4), $X_1$ is an arylene group such as phenylene group and naphthylene group which may have a substituent, an alkenylene group which may have a substituent, —CO— group, —COO— group, —CON($R_{10}$)— group, or —S— group, wherein $R_{10}$ is hydrogen, an alkyl group such as methyl group and ethyl group, an aralkyl group such as benzyl group, naphthylmethyl group, and phenethyl group, and an aryl group such as phenyl group and naphthyl group.

As these substituents are specifically explained with examples, vinyl group, styryl group, 2-methyl-1,3-butadienyl group, vinylcarbonyl group, acryloyloxy group, acryloylamide group, and vinylthioether group can be provided.

(2) As the 1,1-substituted ethylene functional group, for example, a functional group represented by the following formula (5):

$$CH_2{=}C(Y){-}X_2{-}$$

can be provided.

In formula (5), Y is an alkyl group which may have a substituent, an aralkyl group which may have a substituent, an aryl group such as phenyl group and naphthyl group which may have a substituent, a halogen atom, cyano group, nitro group, an alkoxy group such as methoxy group and ethoxy group, —$COOR_{11}$ group, or —$CONR_{12}R_{13}$, wherein $R_{11}$ is a hydrogen atom, an alkyl group such as methyl group and ethyl group which may have a substituent, an aralkyl group such as benzyl group and phenethyl group which may have a substituent or an aryl group such as phenyl group and naphthyl group which may have a substituent, each of $R_{12}$ and $R_{13}$ is an hydrogen atom, an alkyl group such as methyl group and ethyl group which may have a substituent, an aralkyl group such as benzyl group, naphthylmethyl group, and phenethyl group which may have a substituent, or an aryl group such as phenyl group and naphthyl group which may have a substituent, and $R_{12}$ and $R_{13}$ may be identical to or different from each other.

Also, $X_2$ is the same substituent as $X_1$ in formula (4), a single bond, or an alkylene group. Herein, at least one of Y and $X_2$ is oxycarbonyl group, cyano group, an alkenylene group or an aromatic ring.

As these substituents are specifically explained with examples, α-acryloyloxy chloride group, methacryloyloxy group, α-cyanoethylene group, α-cyanoacryloyloxy group, α-cyanophenylene group, and methacryloylamino group can be provided.

Herein, as a substituent for substituting these substituents $X_1$, $X_2$, and Y, for example, a halogen atom, nitro group, cyano group, an alkyl group such as methyl group and ethyl group, an alkoxy group such as methoxy group and ethoxy group, an aryloxy group such as phenoxy group, an aryl group such as phenyl group and naphthyl group, and an aralkyl group such as benzyl group and phenethyl group can be provided.

Among these radical-polymerizable functional groups, particularly, acryloyloxy group and methacryloyloxy group are useful. Also, as the charge transporting structure, a triarylamine structure is highly effective.

Furthermore, when a compound represented by the general formula (1)

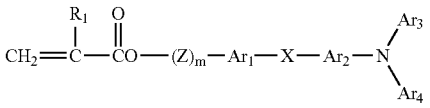

or the general formula (2)

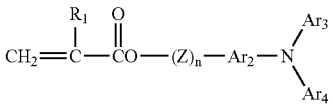

is employed, the electrical characteristics such as the sensitivity and the residual potential of the photoconductor are maintained well.

In the formulas (1) and (2), $R_1$ is a hydrogen atom, a halogen atom, an alkyl group which may have a substituent, an aralkyl group which may have a substituent, an aryl group which may have a substituent, cyano group, nitro group, an alkoxy group, —$COOR_7$, a carbonyl halide group, or —$CONR_8R_9$, wherein $R_7$ is a hydrogen atom, an alkyl group which may have a substituent, an aralkyl group which may have a substituent, or an aryl group which may have a substituent, each of $R_8$ and $R_9$ is a hydrogen atom, a halogen atom, an alkyl group which may have a substituent, an aralkyl group which may have a substituent, or an aryl group which may have a substituent, and $R_8$ and $R_9$ may be identical to or different from each other.

Each of $Ar_1$ and $Ar_2$ is a substituted or non-substituted arylene group, and $Ar_1$ and $Ar_2$ may be identical to or different from each other.

Each of $Ar_3$ and $Ar_4$ is a substituted or non-substituted aryl group, and $Ar_3$ and $Ar_4$ may be identical to or different from each other.

X is a single bond, a substituted or non-substituted alkylene group, a substituted or non-substituted cycloalkylene group, a substituted or non-substituted alkylene ether group, oxygen atom, sulfur atom, or vinylene group.

Z is a substituted or non-substituted alkylene group, a substituted or non-substituted alkylene ether group, or alkyleneoxycarbonyl group.

Each of m and n is an integer of 0 through 3.

Examples of the substituents in general formulas (1) and (2) are shown below.

With respect to a substituent for $R_1$ in general formulas (1) and (2), for example, as the alkyl group, methyl group, ethyl group, propyl group, butyl group, etc. can be provided. As the aryl group, phenyl group and naphthyl group, etc. can be provided. As the aralkyl group, benzyl group, phenethyl group, naphthylmethyl group, etc. can be provided. As the alkoxy group, methoxy group, ethoxy group, propoxy group, etc. can be provided.

The substituents for $R_1$ may be further substituted with a halogen atom, nitro group, cyano group, an alkyl group such as methyl group and ethyl group, an alkoxy group such as methoxy group and ethoxy group, an aryloxy group such as phenoxy group, an aryl group such as phenyl group and naphthyl group, or an aralkyl group such as benzyl group and phenethyl group.

Among substituents $R_1$, a hydrogen atom and a methyl group are particularly preferable.

$Ar_3$ and $Ar_4$ are substituted or non-substituted aryl groups and as the aryl group, a condensed polycyclic hydrocarbon group, a not-condensed cyclic hydrocarbon group, and a heterocyclic group can be provided.

As the condensed polycyclic hydrocarbon group, the number of carbons that form a ring thereof is preferably equal to or less than 18, and, for example, pentanyl group, indenyl group, naphthyl group, azulenyl group, heptalenyl group, biphenylenyl group, as-indacenyl group, s-indacenyl group, fluorenyl group, acenaphthylenyl group, pleiadenyl group, acenaphthenyl group, phenalenyl group, phenanthryl group, anthryl group, fluoranthenyl group, acephenanthrylenyl group, aceanthrylenyl group, triphenylenyl group, pyrenyl group, chrysenyl group, and naphthacenyl group can be provided.

As the not-condensed cyclic hydrocarbon group, monovalent groups of a monocyclic hydrocarbon compound such as benzene, diphenyl ether, poly(ethylene-diphenylether), diphenylthioether, and diphenylsulfone, monovalent groups of a not-condensed polycyclic hydrocarbon compound such as biphenyl, polyphenyl, a diphenylalkane, a diphenylalkene, a diphenylalkyne, triphenylmethane, distyrylbenzene, 1,1-diphenylcycloalkane, polyphenylalkane, and a polyphenylalkene, and monovalent groups of a ring assembly hydrocarbon compound such as 9,9-diphenylfluorene can be provided.

As the heterocyclic group, monovalent groups of carbazole, dibenzofuran, dibenzothiophene, oxadiazole, and thiadiazole can be provided.

The aryl group represented by $Ar_3$ and $Ar_4$ may have a substituent, for example, as shown below.

(1) A halogen atom, cyano group, nitro group, etc.

(2) An alkyl group

The alkyl group is preferably $C_1$-$C_{12}$, more preferably $C_1$-$C_8$, most preferably $C_1$-$C_4$ straight or branched alkyl group, and the alkyl group may have a fluorine atom, hydroxyl group, a cyano group, a $C_1$-$C_4$ alkoxy group, phenyl group, or a phenyl group substituted with a halogen atom, a $C_1$-$C_4$ alkyl group, or a $C_1$-$C_4$ alkoxy group. Specifically, methyl group, ethyl group, n-butyl group, i-propyl group, t-butyl group, s-butyl group, n-propyl group, trifluoromethyl group, 2-hydroxyethyl group, 2-ethoxyethyl group, 2-cyanoethyl group, 2-methoxyethyl group, benzyl group, 4-chlorobenzyl group, 4-methylbenzyl group, and 4-phenylbenzyl group can be provided.

(3) An alkoxy groups (—$OR_2$)

(wherein $R_2$ is an alkyl group defined in (2))

Specifically, methoxy group, ethoxy group, n-propoxy group, i-propoxy group, t-butoxy group, n-butoxy group, s-butoxy group, i-butoxy group, 2-hydroxyethoxy group, benzyloxy group, and trifluoromethoxy group can be provided.

(4) An aryloxy group

As the aryl group, phenyl group and naphthyl group can be provided. The aryloxy group may contain a $C_1$-$C_4$ alkoxy group, a $C_1$-$C_4$ alkyl group, or a halogen atom as a substituent. Specifically, phenoxy group, 1-naphthyloxy group, 2-naphthyloxy group, 4-methoxyphenoxy group, and 4-methylphenoxy group can be provided.

(5) An alkylmercapto group or an arylmercapto group

Specifically, methylthio group, ethylthio group, phenylthio group, and p-methylphenylthio group can be provided.

(6) A substituent represented by the following formula

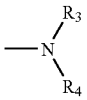

(wherein each of $R_3$ and $R_4$ is independently a hydrogen atom, an alkyl group defined in (2), or an aryl group. As the aryl group, for example, phenyl group, biphenyl group, and naphthyl group can be provided and the aryl group may contain a $C_1$-$C_4$ alkoxy group, a $C_1$-$C_4$ alkyl group, or a halogen atom as a substituent. $R_3$ and $R_4$ may collectively form a ring.)

Specifically, amino group, diethylamino group, N-methyl-N-phenylamino group, N,N-diphenylamino group, N,N-di(tolyl)amino group, dibenzylamino group, piperidino group, morpholino group, and pyrrolidino group can be provided.

(7) An alkylenedioxy group and an alkylenedithio group such as methylenedioxy group and methylenedithio group.

(8) A substituted or non-substitutedstyryl group, a substituted or non-substituted β-phenylstyryl group, diphenylaminophenyl group, ditolylaminophenyl group, etc.

As the arylene group represented by $Ar_1$ and $Ar_2$, divalent groups derived from the aryl groups represented by $Ar_3$ and $Ar_4$.

X is a single bond, a substituted or non-substituted alkylene group, a substituted or non-substituted cycloalkylene group, a substituted or non-substituted alkylene ether group, an oxygen atom, a sulfur atom, or vinylene group.

The substituted or non-substituted alkylene group is $C_1$-$C_{12}$, preferably $C_1$-$C_8$, more preferably $C_1$-$C_4$ straight or branched alkylene group and, further, the alkylene group may have a fluorine atom, hydroxyl group, cyano group, a $C_1$-$C_4$ alkoxy group, a phenyl group, or a phenyl group substituted with a halogen atom, a $C_1$-$C_4$ alkyl group, or a $C_1$-$C_4$ alkoxy group.

Specifically, methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenylethylene group, and 4-biphenylethylene group can be provided.

The substituted or non-substituted cycloalkylene group is a $C_5$-$C_7$ cyclic alkylene group and the cyclic alkylene group may have a fluorine atom, hydroxyl group, a $C_1$-$C_4$ alkyl group, or a $C_1$-$C_4$ alkoxy group. Specifically, cyclohexylidene group, cyclohexylene group, and 3,3-dimethylcyclohexylidene group can be provided.

As the substituted or non-substituted alkylene ether group, an alkyleneoxy group such as ethyleneoxy group and propyleneoxy group, an alkylenedioxy group derived from ethylene glycol or propyleneglycol, and a di- or poly-(oxyalkylene)oxy group derived from diethylene glycol, tetraethylene glycol, or tripropylene glycol can be provided and an alkylene group of the alkylene ether group may have a substituent such as hydroxyl group, methyl group, or ethyl group.

As the vinylene group, a substituent represented by the following general formula

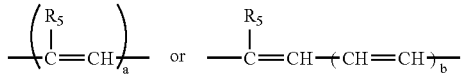

can be provided, wherein $R_5$ is hydrogen, an alkyl group (being the same alkyl group as that defined in (2)), an aryl group (being the same aryl group as that represented by $Ar_3$ or $Ar_4$), a is 1 or 2, and b is 1 through 3.

Z is a substituted or non-substituted alkylene group, a substituted or non-substituted alkylene ether group, or alkyleneoxycarbonyl group.

As the substituted or non-substituted alkylene group, the alkylene group as X can be provided.

As the substituted or non-substituted alkylene ether group, the alkylene ether group as X can be provided.

As the alkyleneoxycarbonyl group, a caprolactone-modified group can be provided.

Also, as the one-functional free-radical-polymerizable compound having a charge transporting structure in the present invention, more preferably, a compound represented by general formula (3)

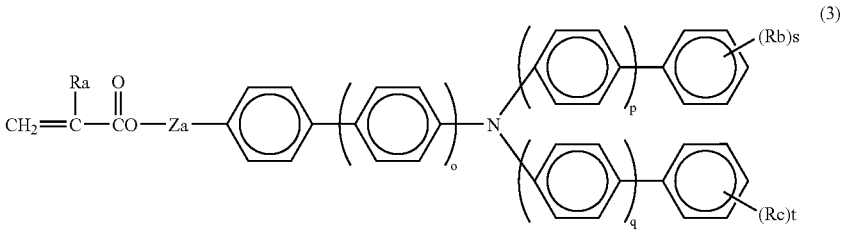

can be provide, wherein each of o, p, and q is an integer of 0 or 1, Ra is a hydrogen atom or a methyl group, each of Rb and Rc is a alkyl group in which the number of carbons is 1 through 6, where if the number of Rb or Rc is a plural number, the plural Rbs or Rcs may be different from each other, each of s and t is an integer of 0 through 3, and Za is a single bond, a methylene group, an ethylene group,

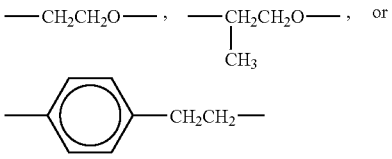

In the compound represented by general formula (3), a compound in which substituents Rb and Rc are independently methyl group or ethyl group is particularly preferable.

The one-functional free-radical-polymerizable compound having a charge transporting structure represented by general formula (1), (2), or (3) (especially (3)) used for the present invention does not become a terminal structure and is incorporated in a chaining polymer since the carbon-carbon double bond opens toward both sides thereof for polymerization. In the cross-linked polymer by the polymerization with the free-radical-polymerizable monomer having no charge transporting structure represented by general formula (A), the one-functional free-radical-polymerizable compound having a charge transporting structure is incorporated in a main chain of the polymer or a cross-linking chain between main chains. Herein, the cross-linking chain includes an intermolecular cross-linking chain between a main chain of one polymer molecule and a main chain of another polymer molecule and an intramolecular cross-linking chain between the first portion of a main chain of a folded polymer molecule and the second portion of it, which is away from the first portion. Whether the one-functional free-radical-polymerizable compound is incorporated in the main chain or the cross-linking chain, a triarylamine structure bonding to the chain has three aryl groups extending toward three radial directions from a nitrogen atom and is bulky but bonds to the chain indirectly via a carbonyl group, etc. Accordingly, the triarylamine structures are secured flexibly in regard to the configuration and located spatially adjacent to each other in moderation in the polymer, so that structural distortion of the molecule is small. Then, the polymer is used as a material for a surface layer of an electrophotographic photoconductor, it is considered that the molecular structure of the polymer can be comparatively free from breaking of a route for charge transportation.

Specific examples of the one-functional free-radical-polymerizable compound having a charge transporting structure for the present invention are shown below but the compound is not limited to these examples.

No. 1

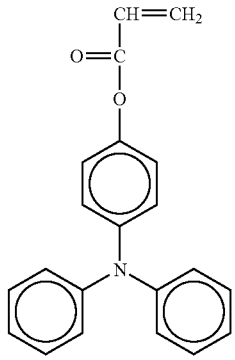

No. 2

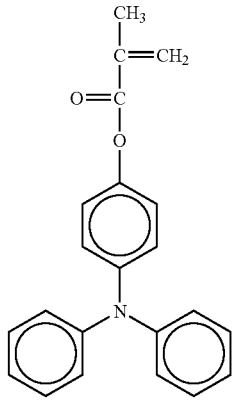

No. 3

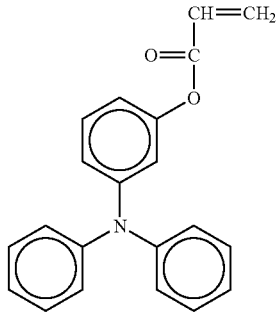

-continued
No. 4
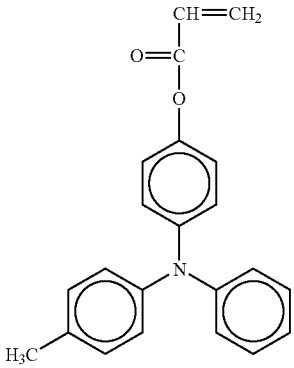
No. 5
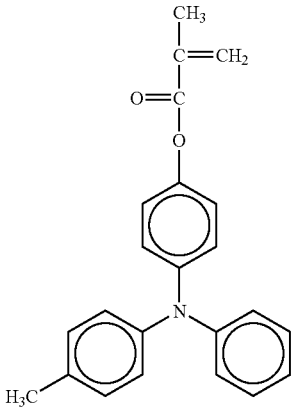
No. 6
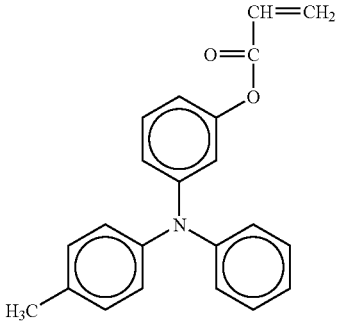
No. 7
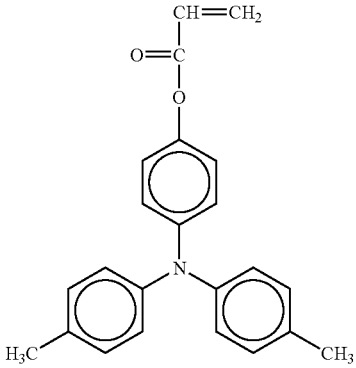
-continued
No. 8
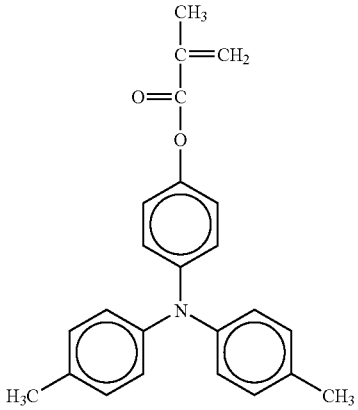
No. 9
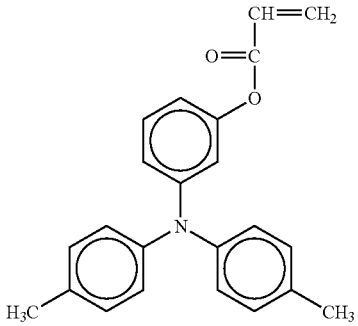
No. 10
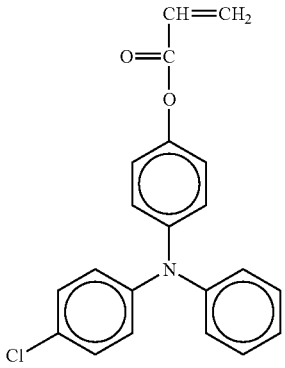
No. 11
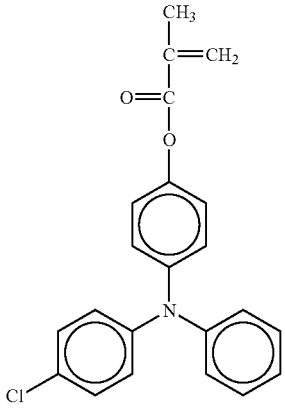

-continued
No. 12
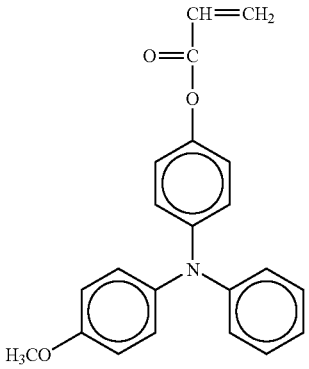
No. 13
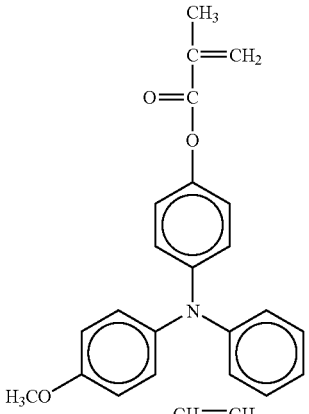
No. 14
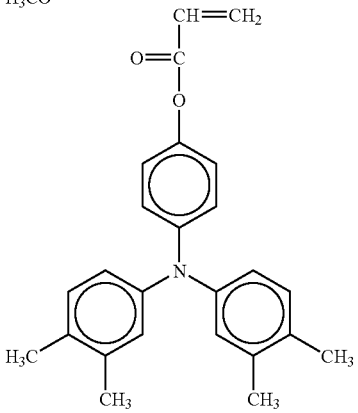
No. 15
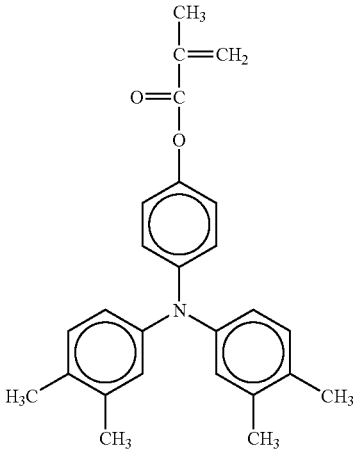
-continued
No. 16
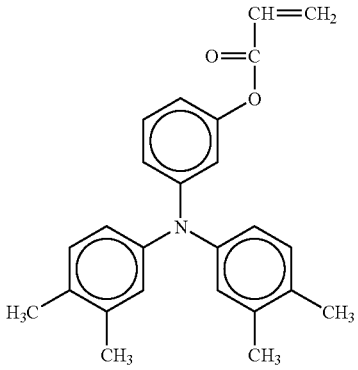
No. 17
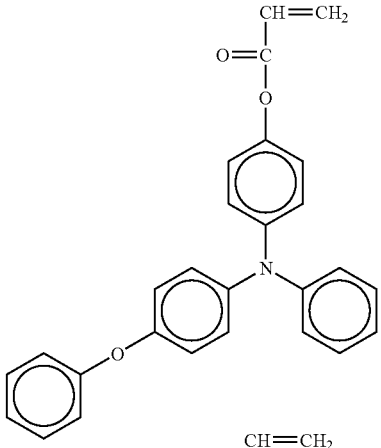
No. 18
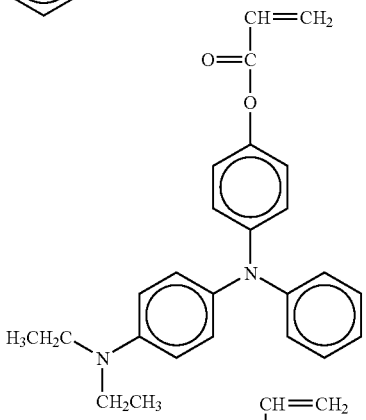
No. 19
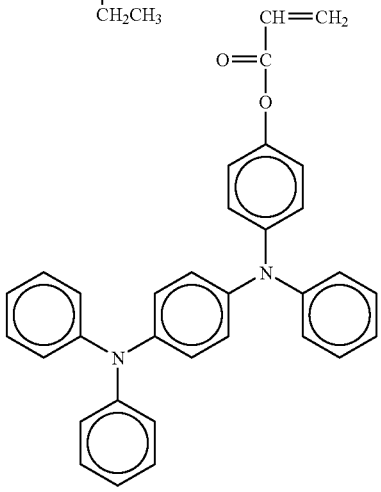

-continued
No. 20
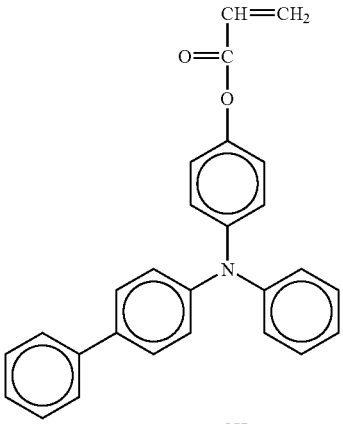
No. 21
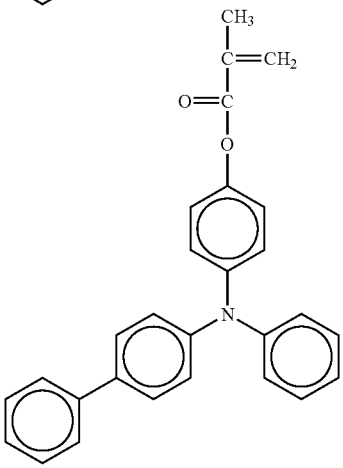
No. 22
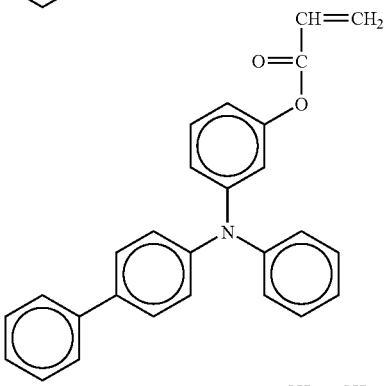
No. 23
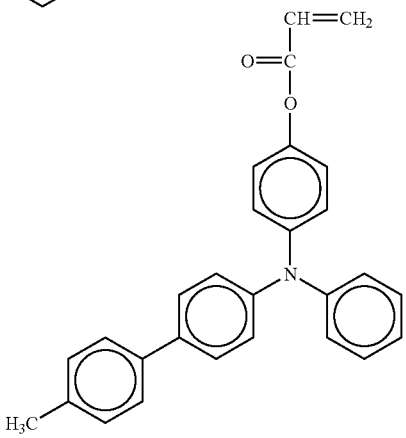
-continued
No. 24
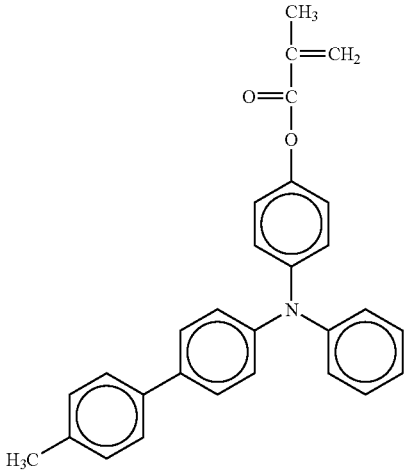
No. 25
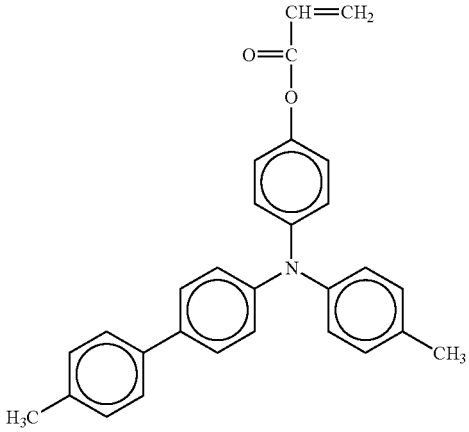
No. 26
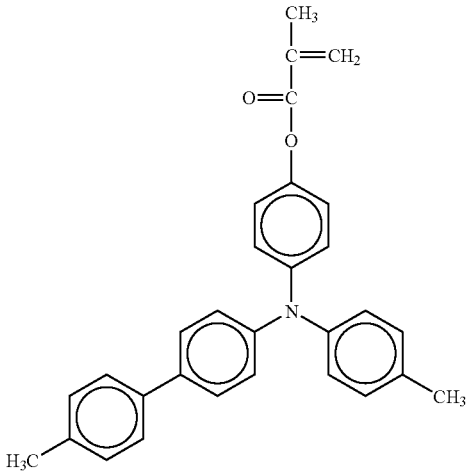

-continued
No. 27
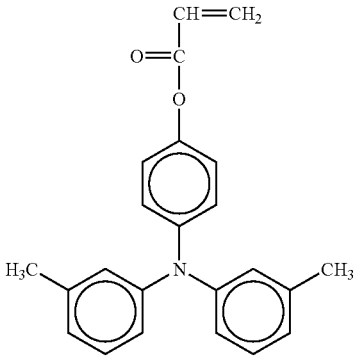
No. 28
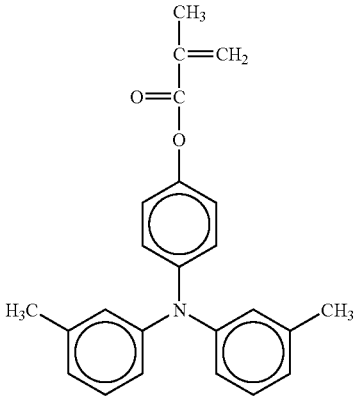
No. 29
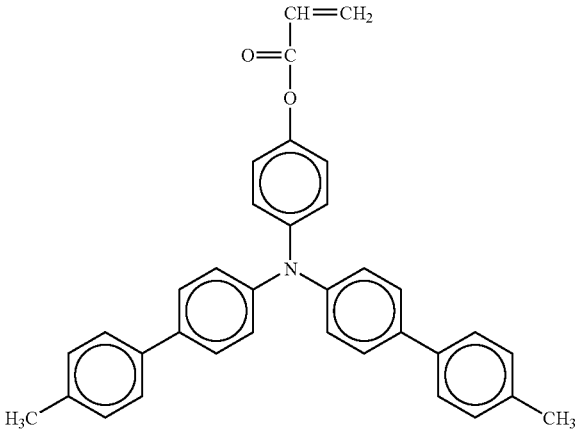
-continued
No. 30
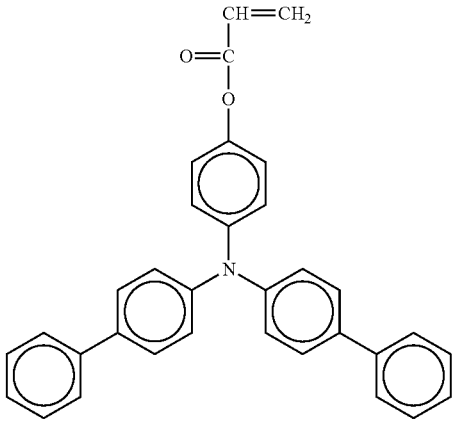
No. 31
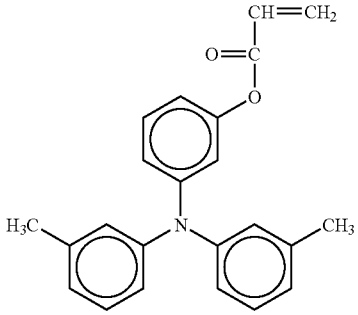
No. 32
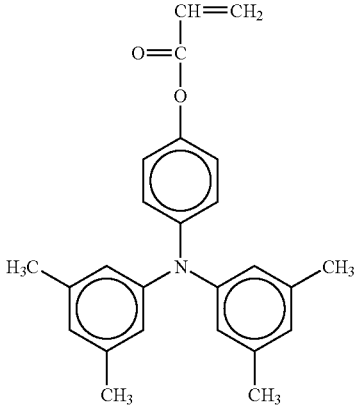
No. 33
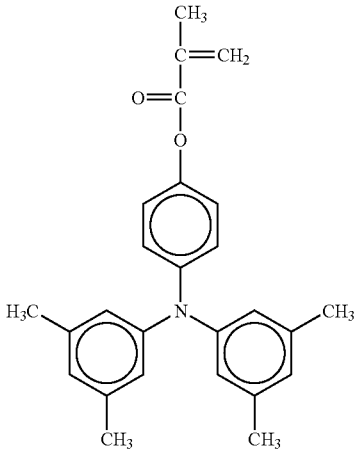

-continued
No. 34
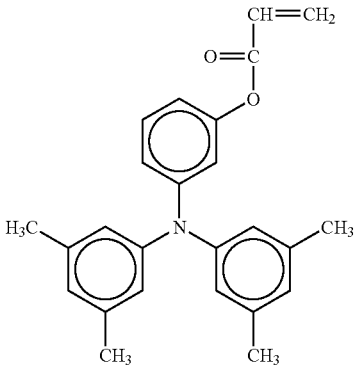
No. 35
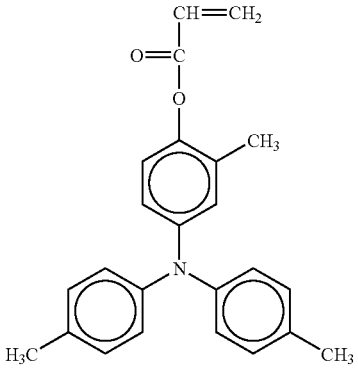
No. 36
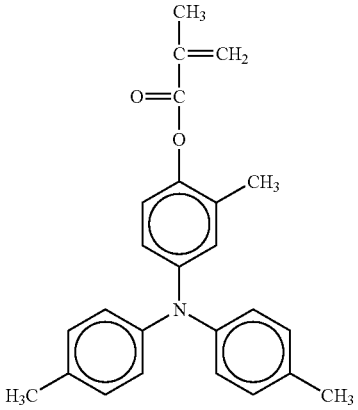
No. 37
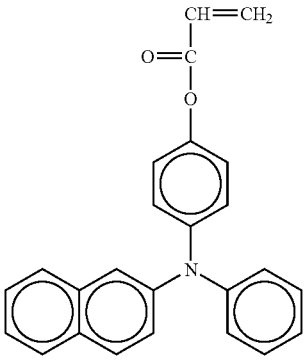
-continued
No. 38
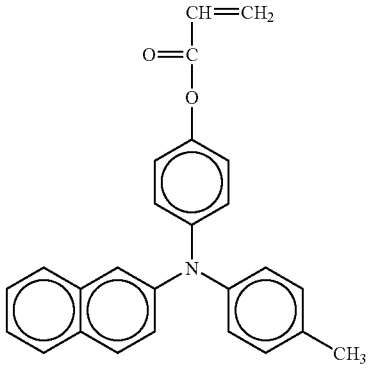
No. 39
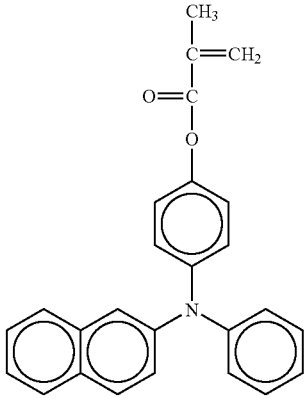
No. 40
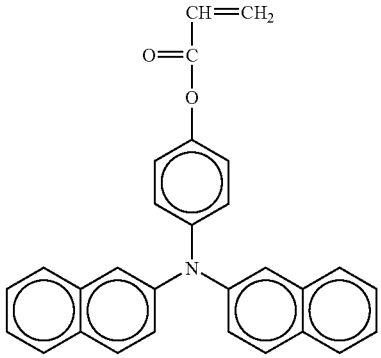
No. 41
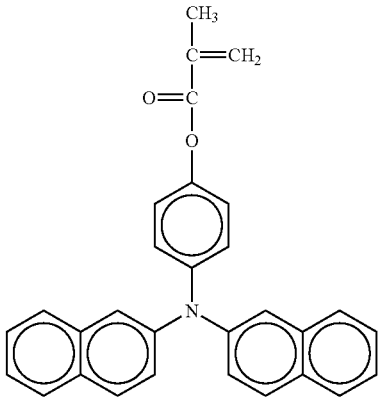

-continued
No. 42
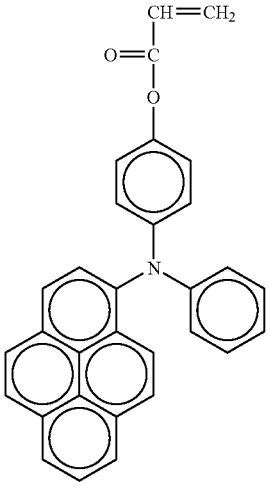
No. 43
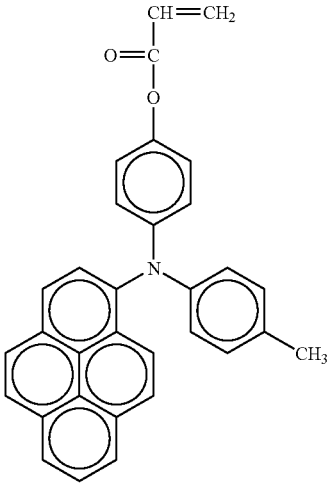
No. 44
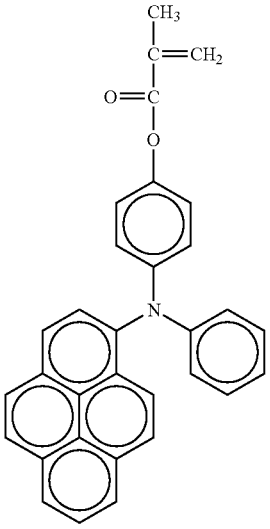
-continued
No. 45
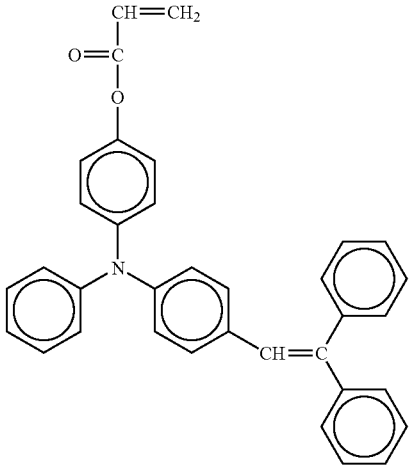
No. 46
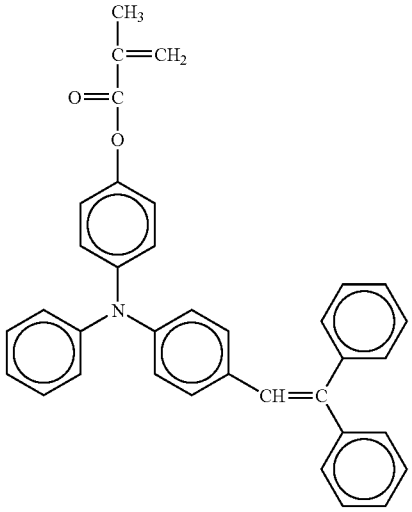
No. 47
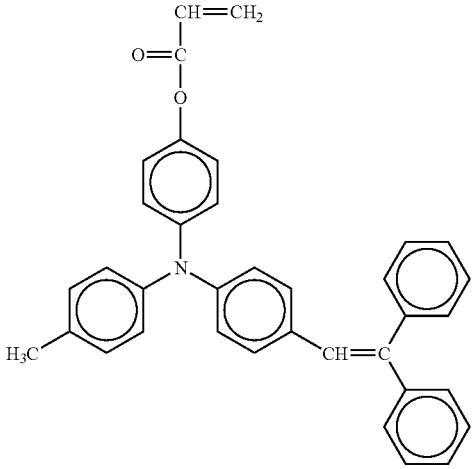

-continued
No. 48
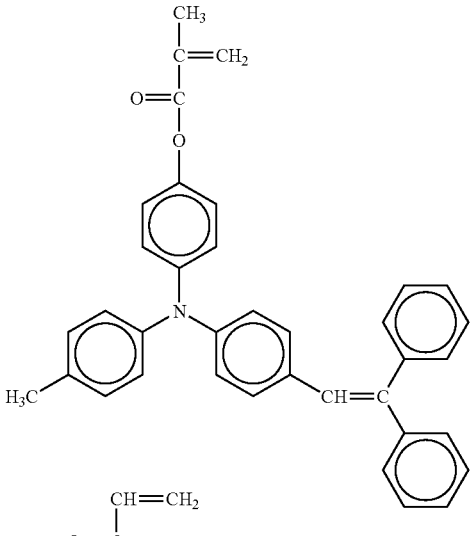
No. 49
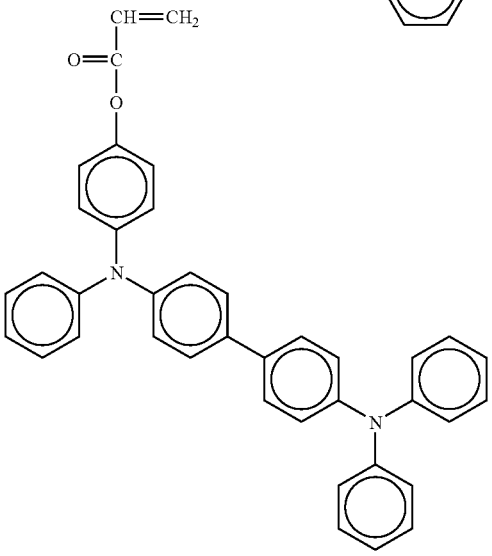
No. 50
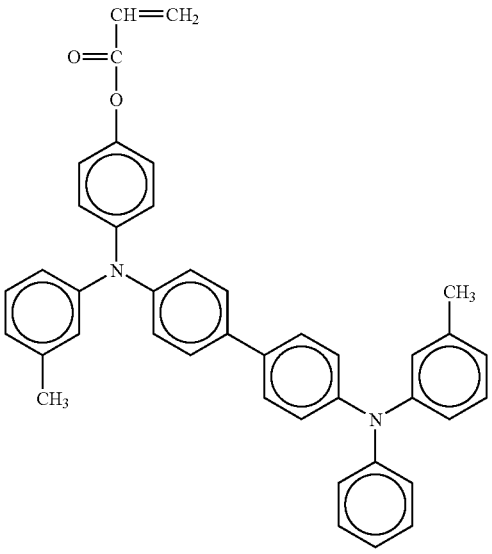
-continued
No. 51
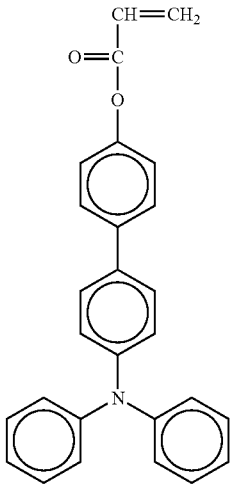
No. 52
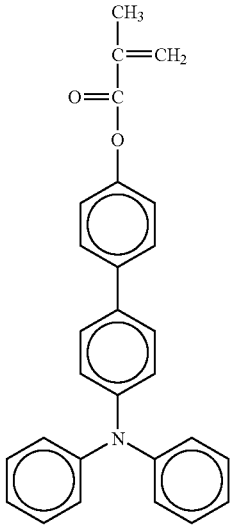
No. 53
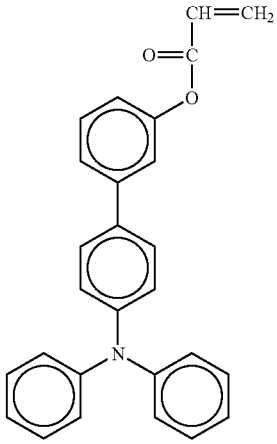

-continued
No. 54
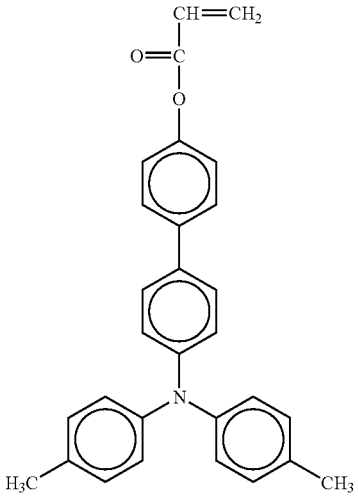
No. 55
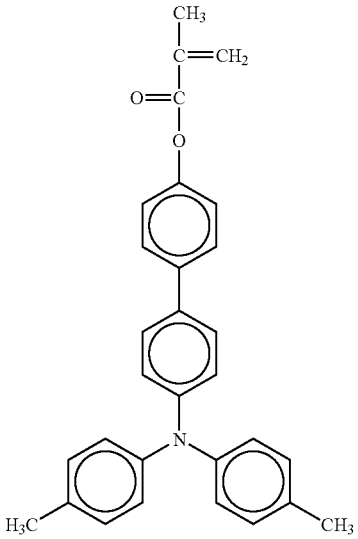
-continued
No. 56
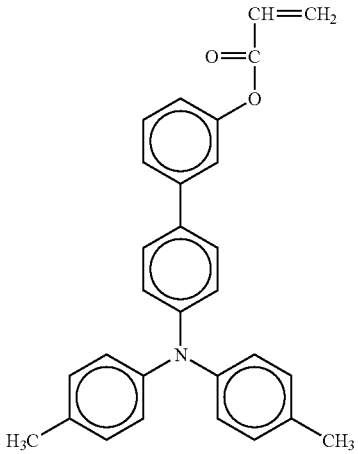
No. 57
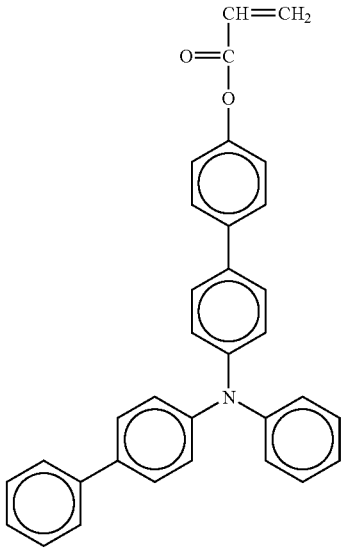

-continued
No. 58
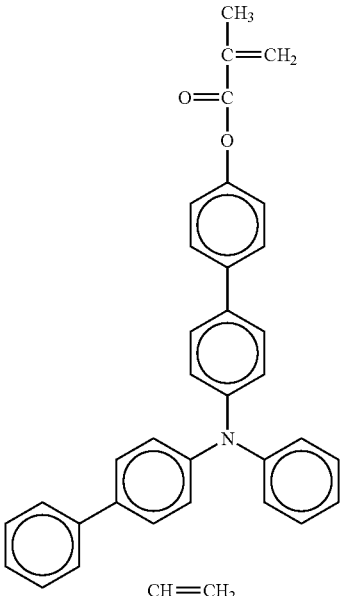
No. 59
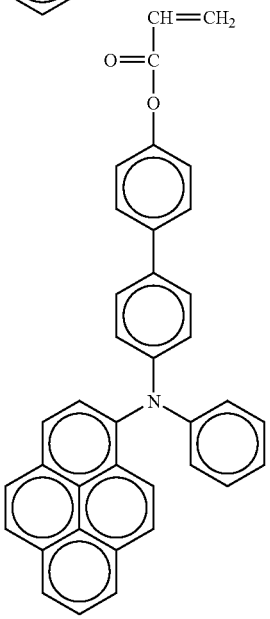
No. 60
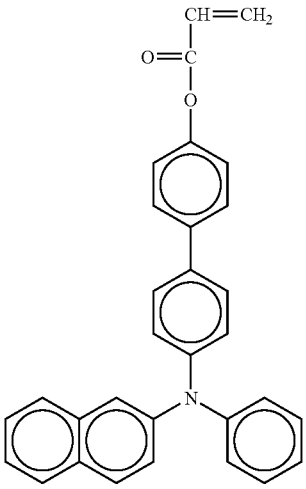
-continued
No. 61
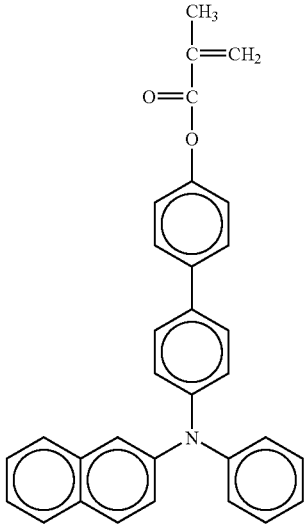
No. 62
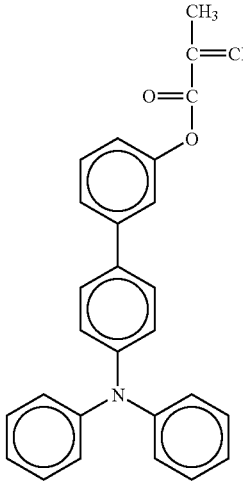
No. 63
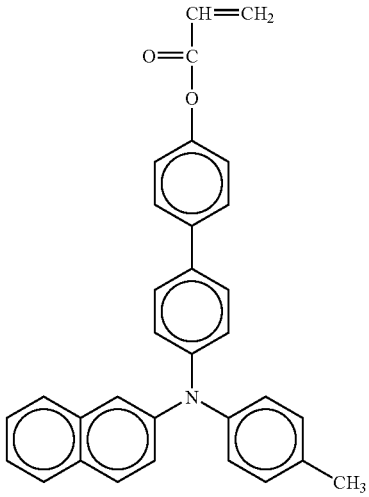

-continued
No. 64
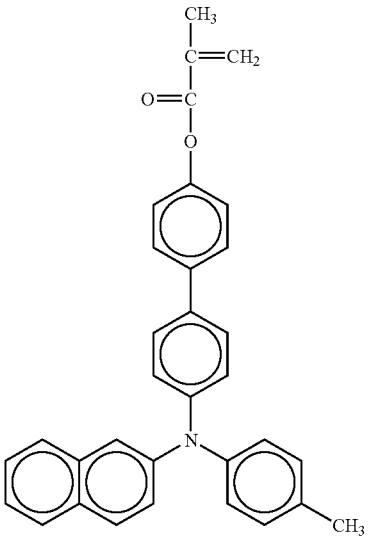
No. 65
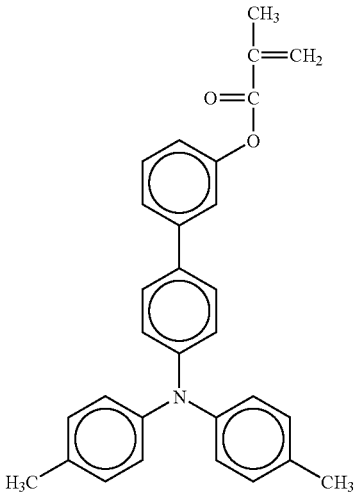
No. 66
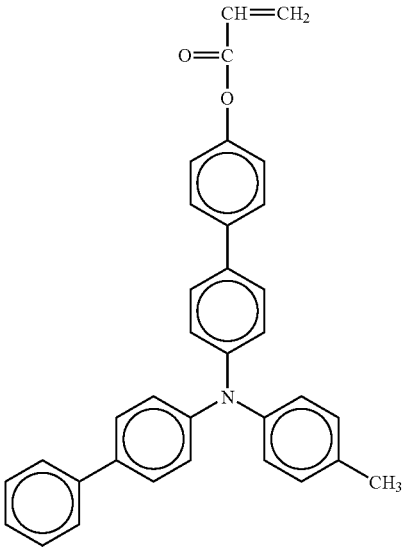
-continued
No. 67
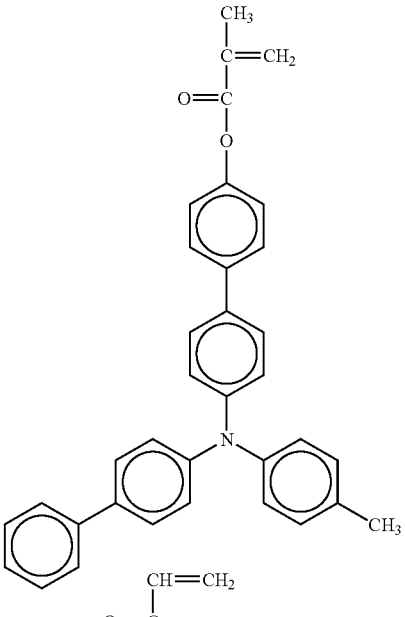
No. 68
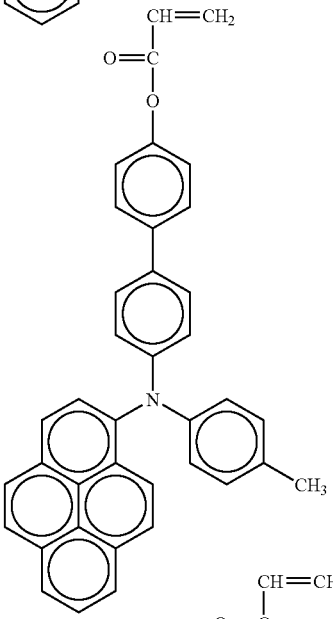
No. 69
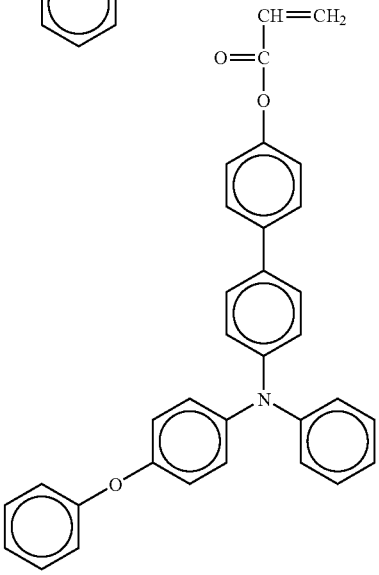

-continued
No. 70
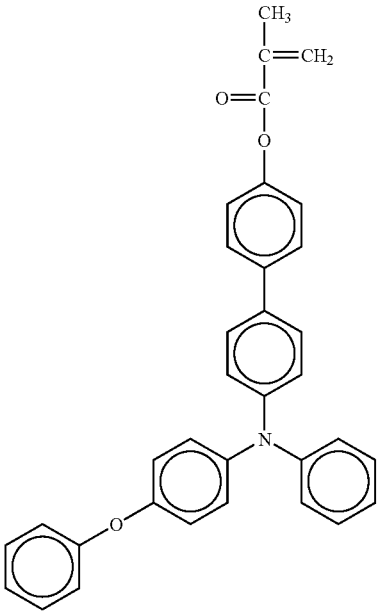
No. 71
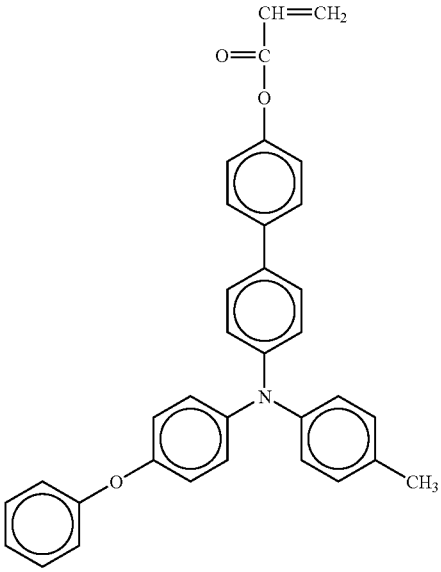
-continued
No. 72
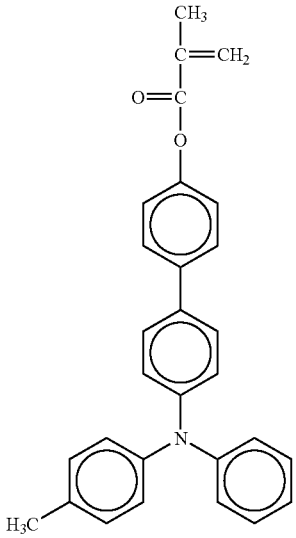
No. 73
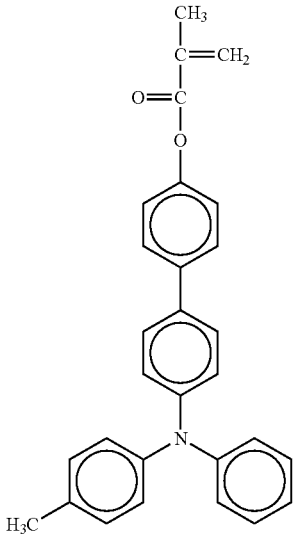

-continued
No. 74
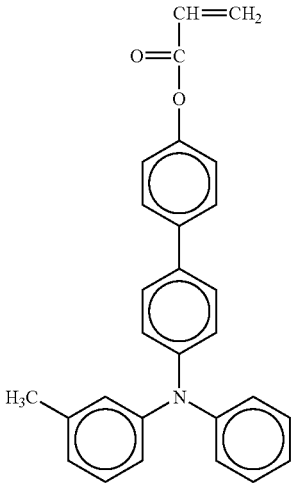
No. 75
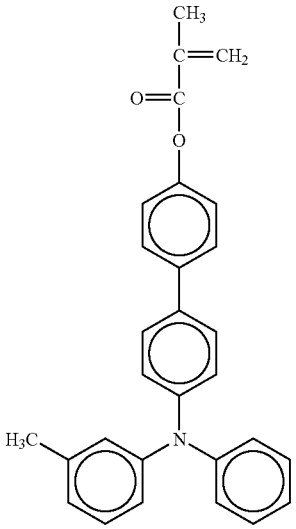
No. 76
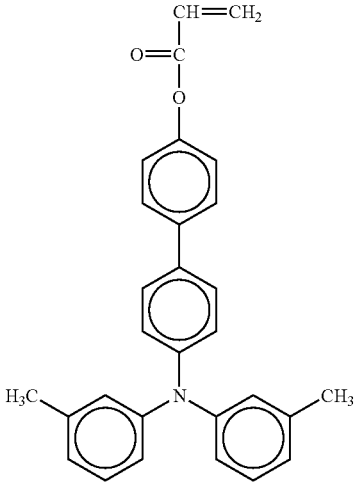
-continued
No. 77
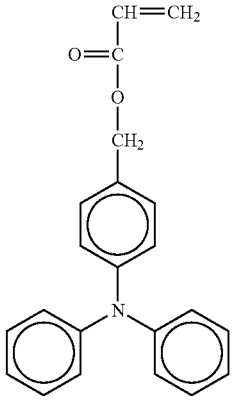
No. 78
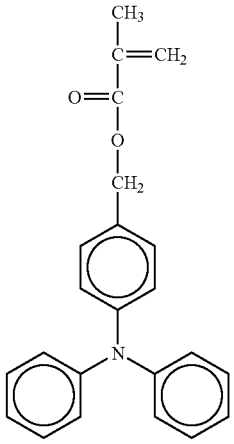
No. 79
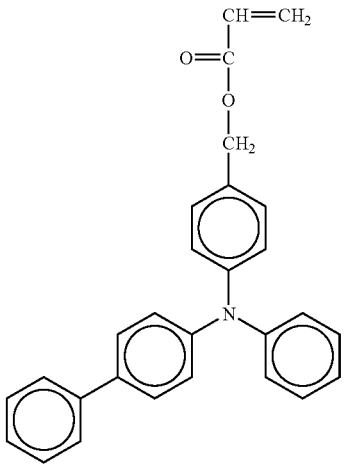

-continued
No. 80
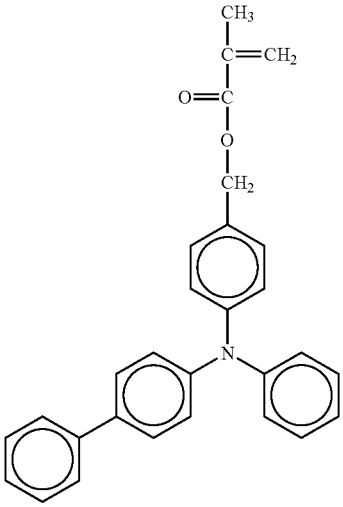
No. 81
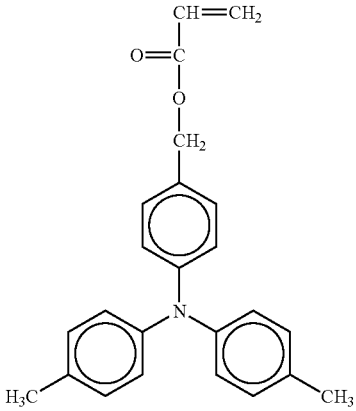
No. 82
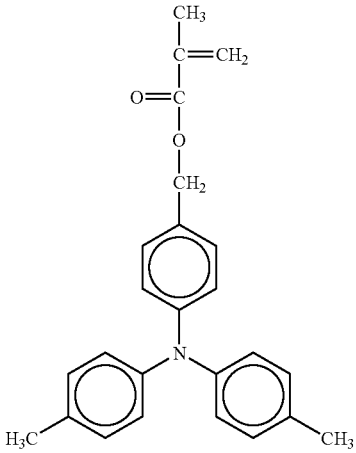
-continued
No. 83
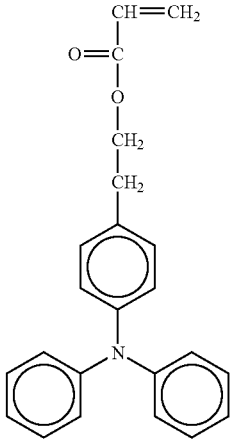
No. 84
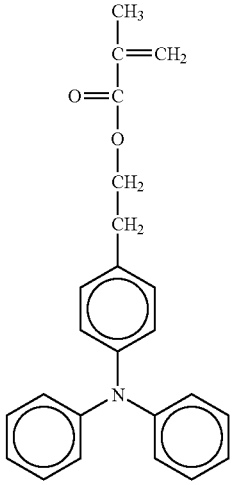
No. 85
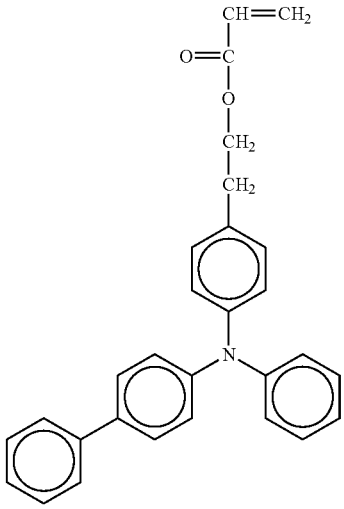

-continued
No. 86
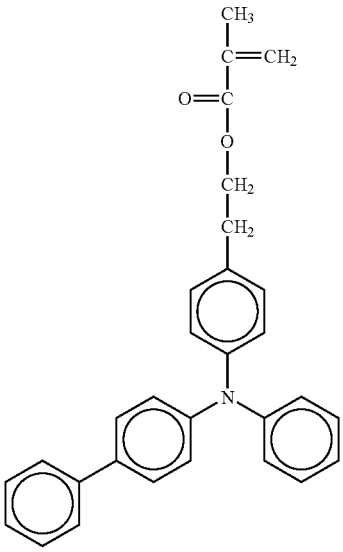
No. 87
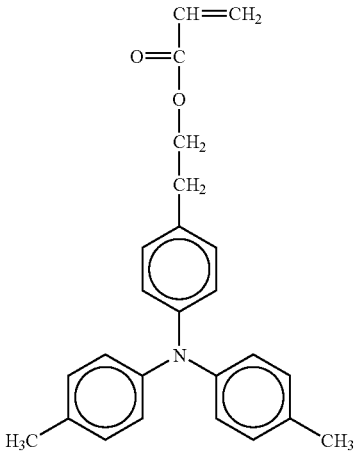
No. 88
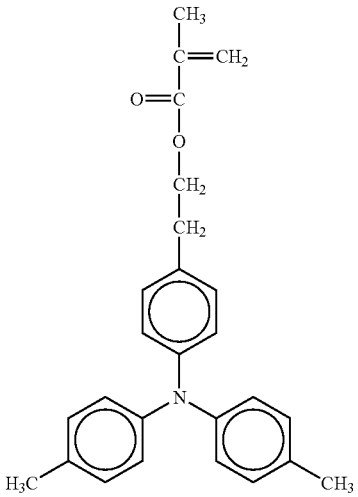
-continued
No. 89
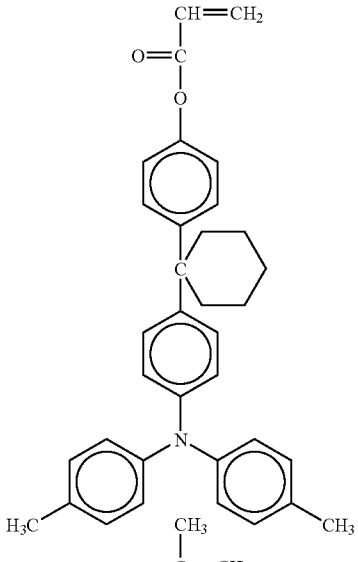
No. 90
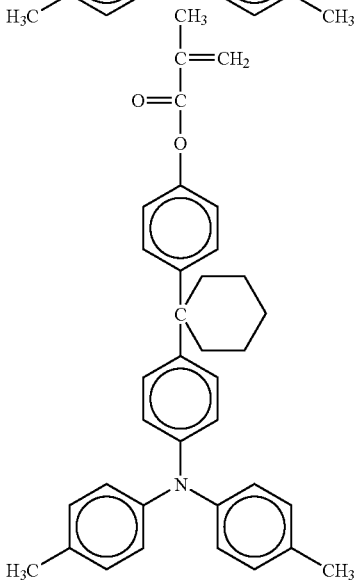
No. 91
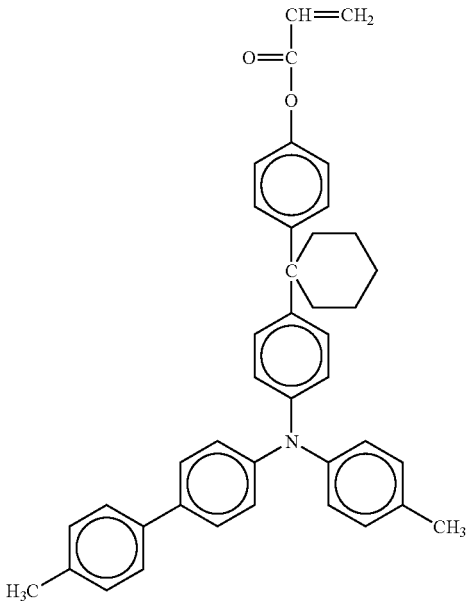

-continued
No. 92
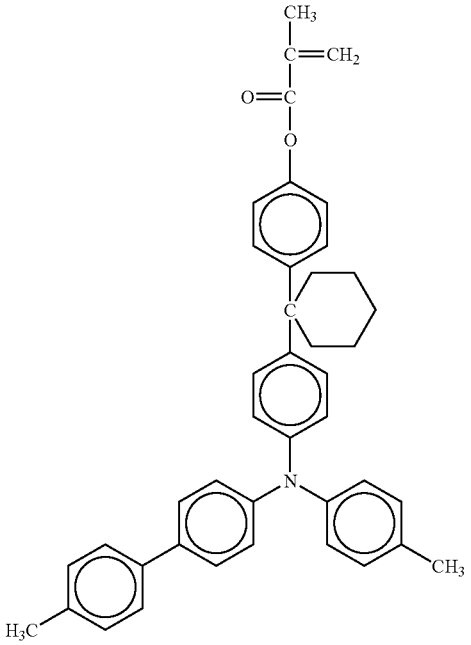
No. 93
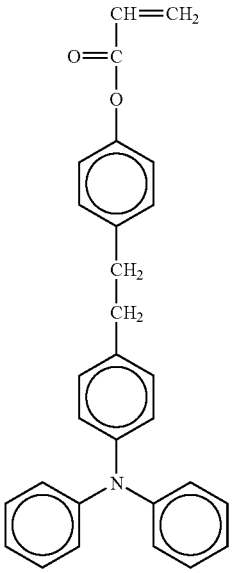
-continued
No. 94
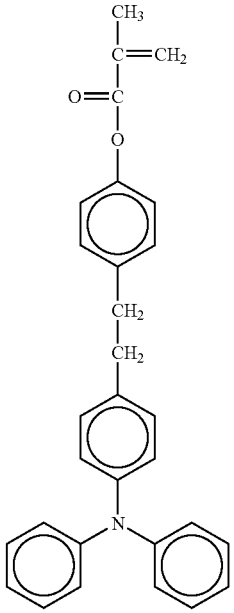
No. 95
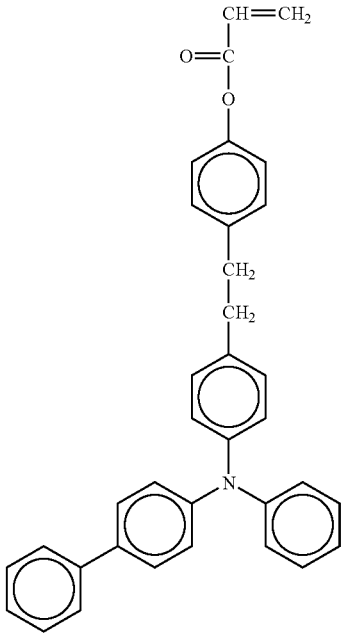

-continued
No. 96
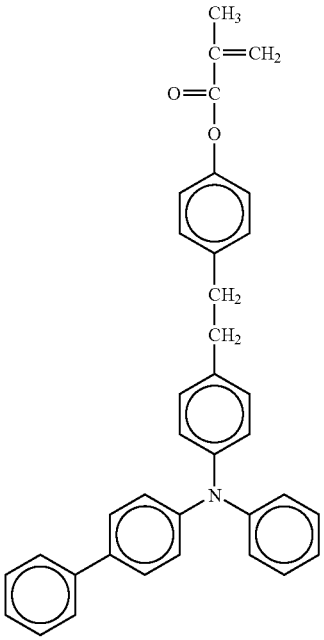
No. 97
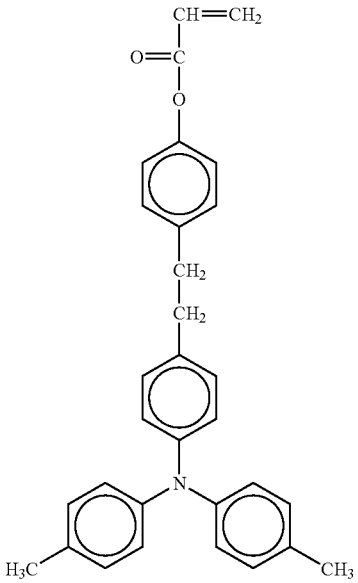
-continued
No. 98
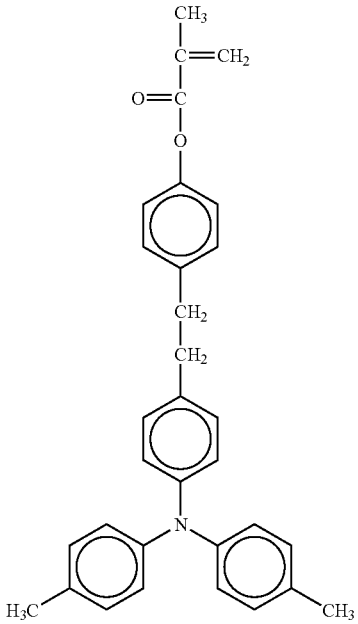
No. 99
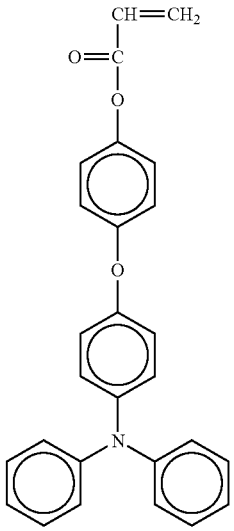

-continued
No. 100
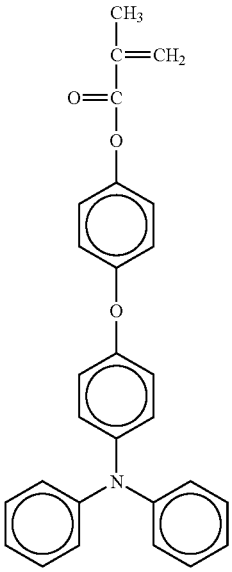
No. 101
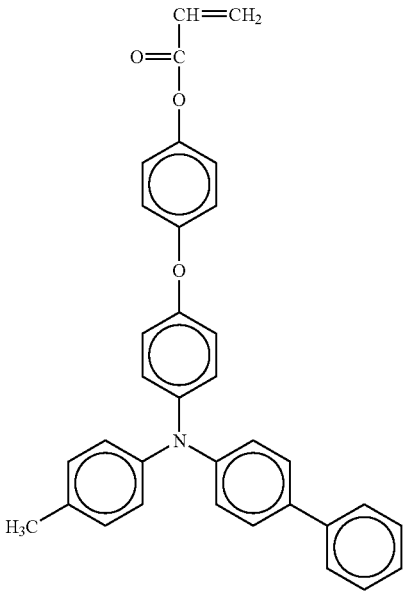
-continued
No. 102
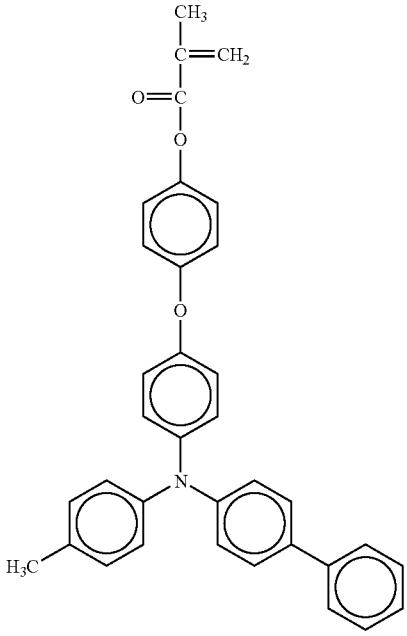
No. 103
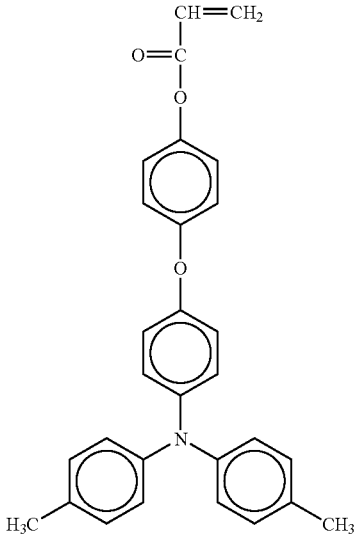

-continued
No. 104
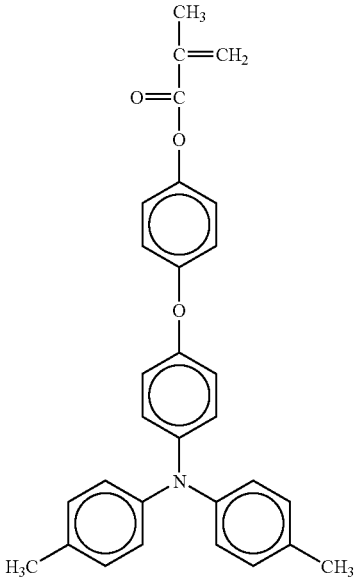
No. 105
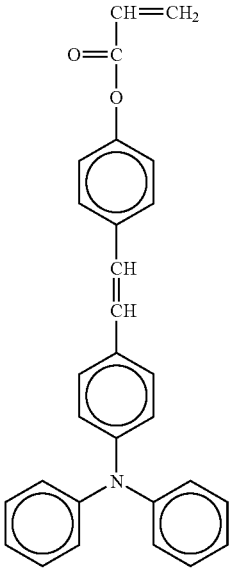
-continued
No. 106
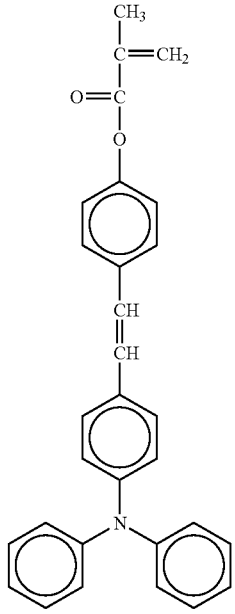
No. 107
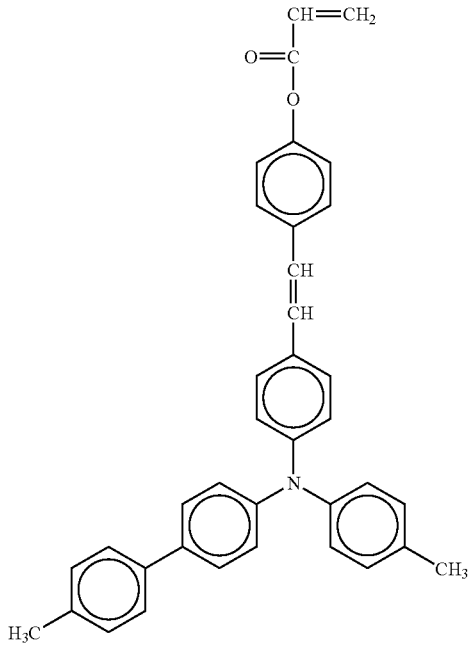

-continued
No. 108
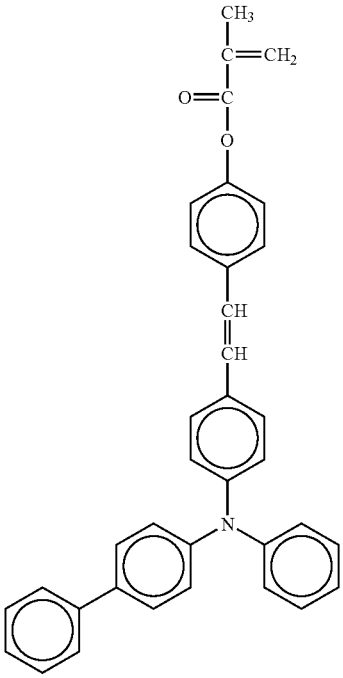
No. 109
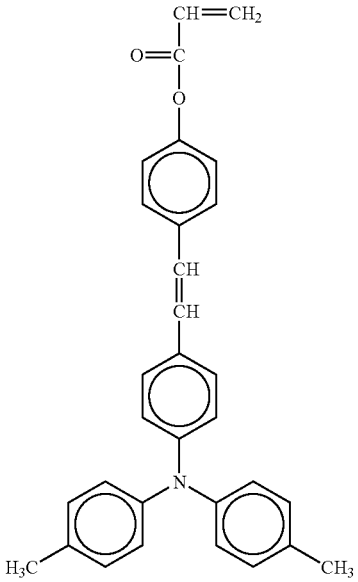
-continued
No. 110
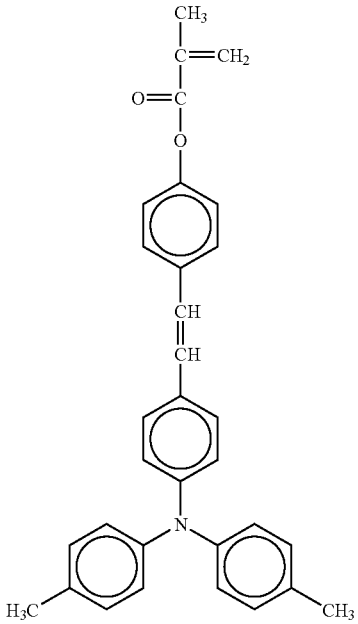
No. 111
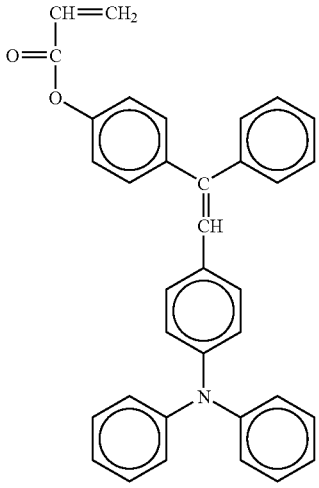

-continued
No. 112
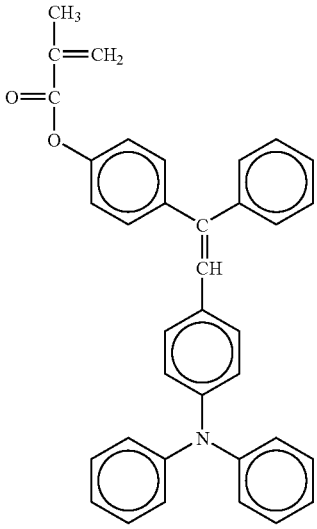
No. 113
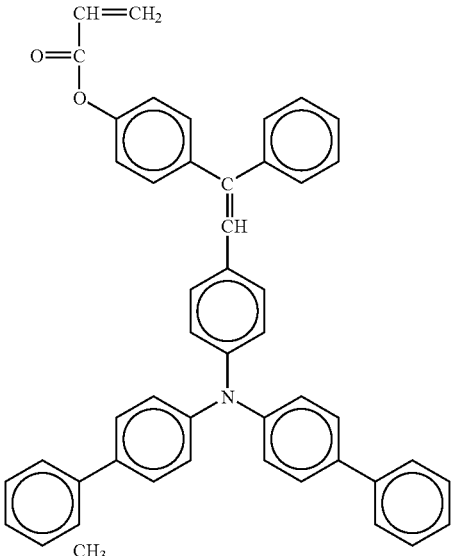
No. 114
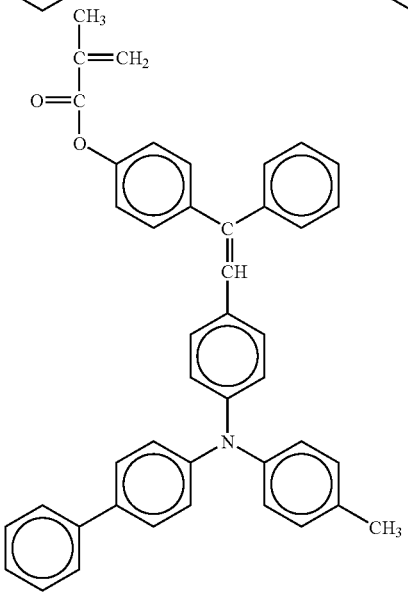
-continued
No. 115
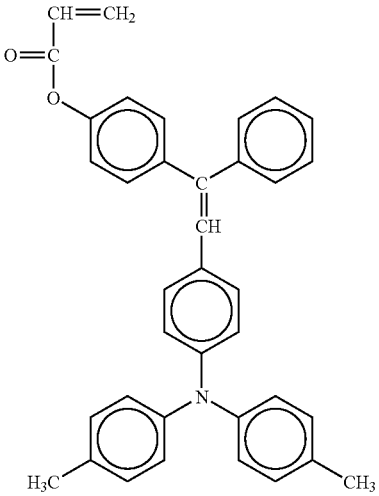
No. 116
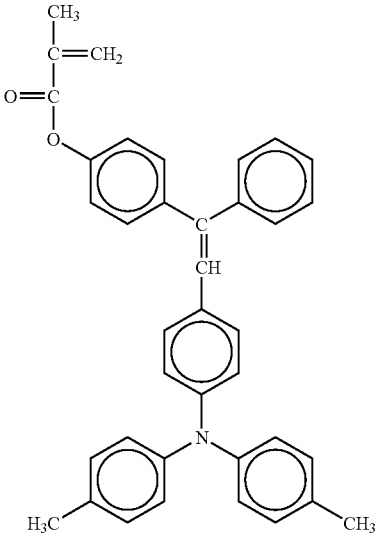
No. 117
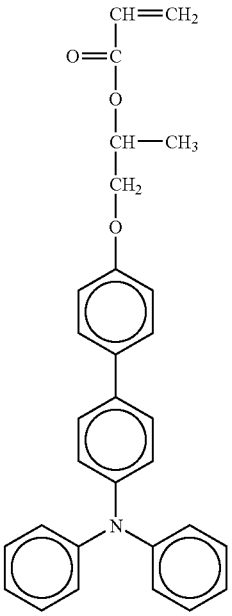

-continued
No. 118
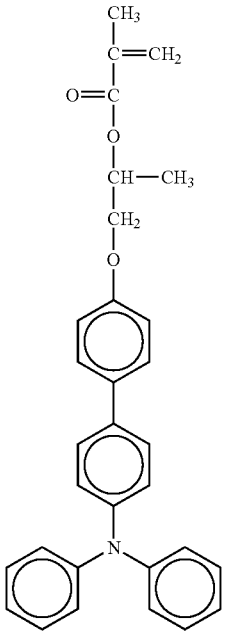
No. 119
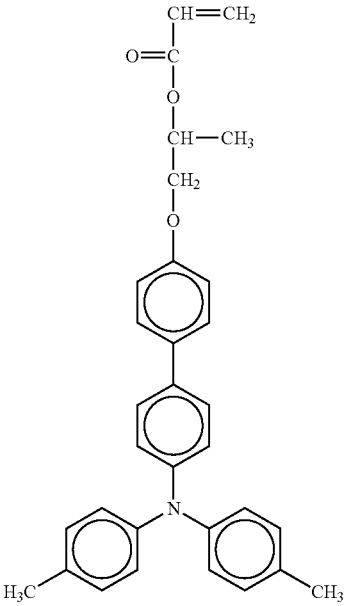
-continued
No. 120
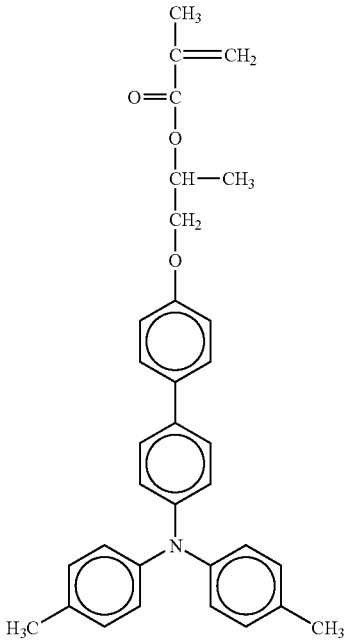
No. 121
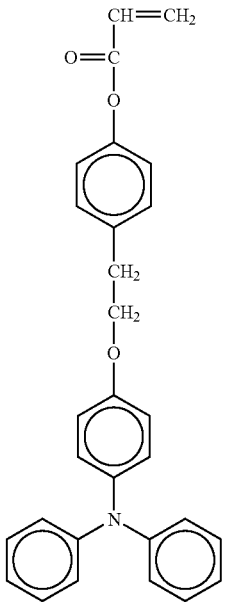

-continued
No. 122
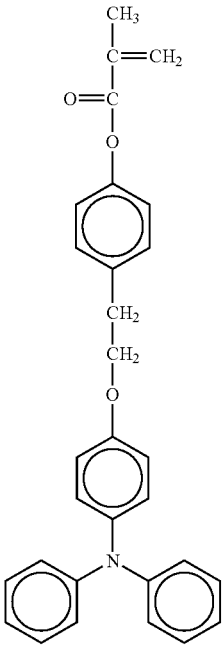
No. 123
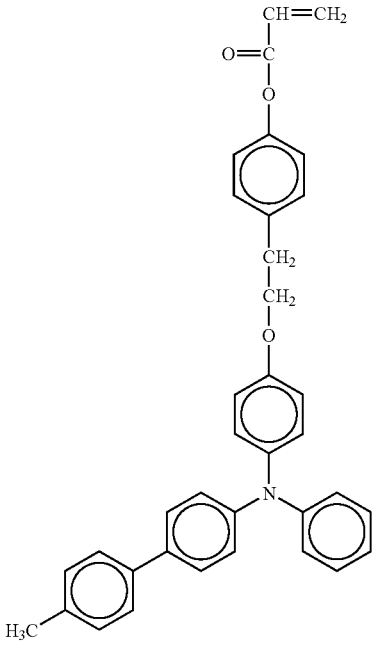
-continued
No. 124
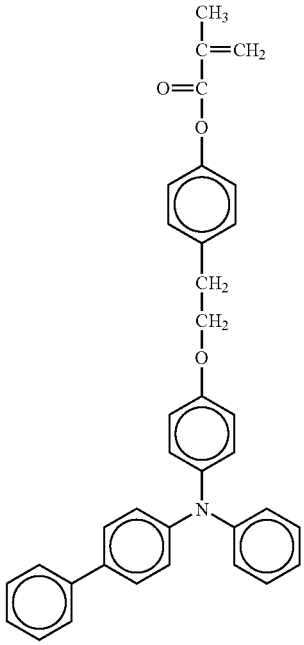
No. 125
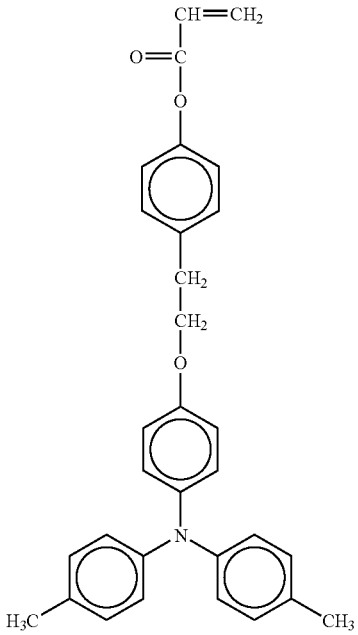

-continued
No. 126
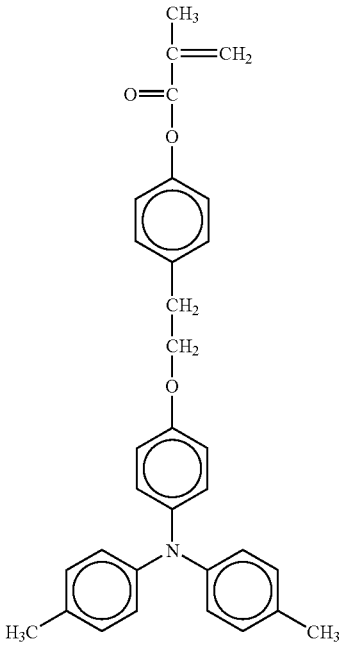
No. 127
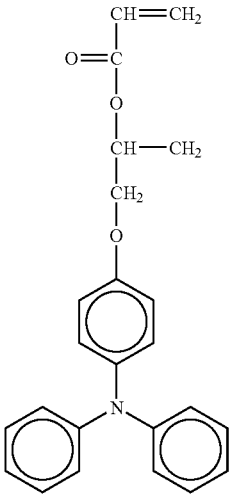
-continued
No. 128
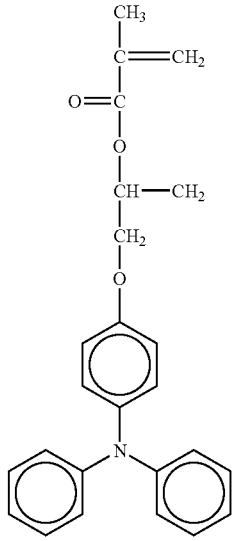
No. 129
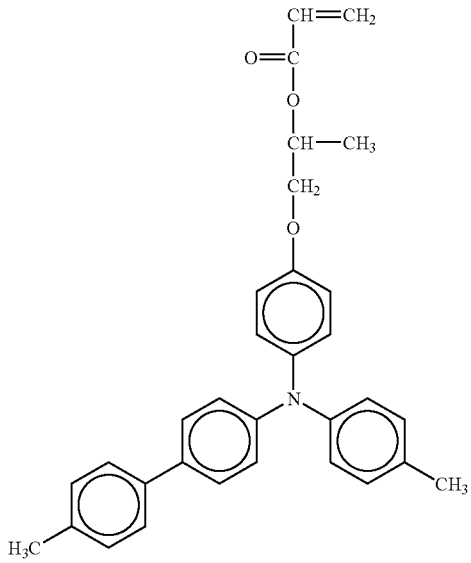

-continued
No. 130
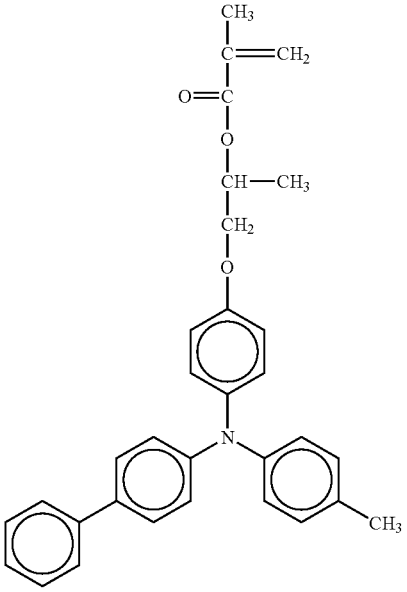
No. 131
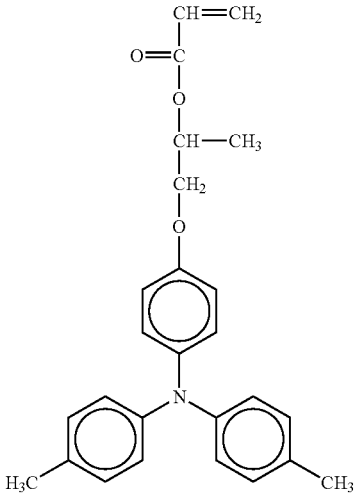
No. 132
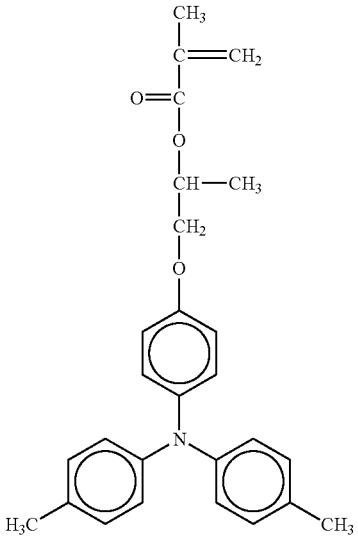
-continued
No. 133
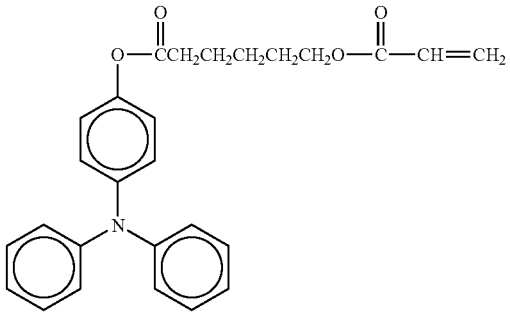
No. 134
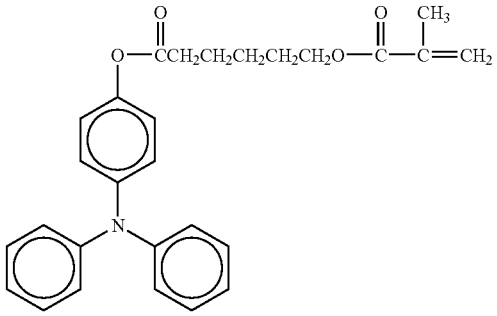
No. 135
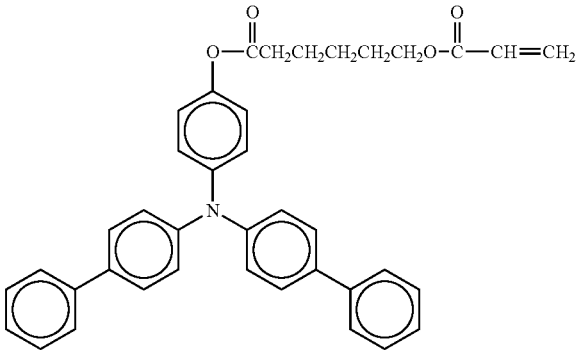
No. 136
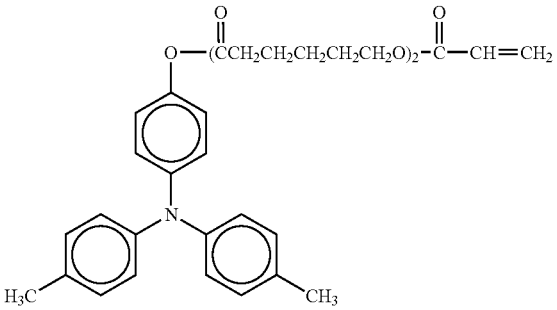

-continued
No. 137
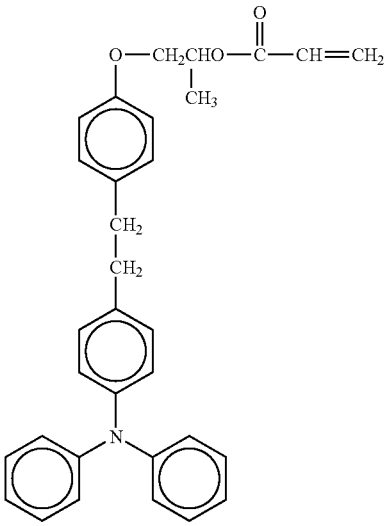
No. 138
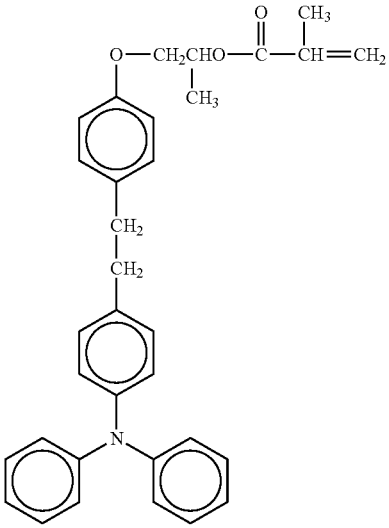
No. 139
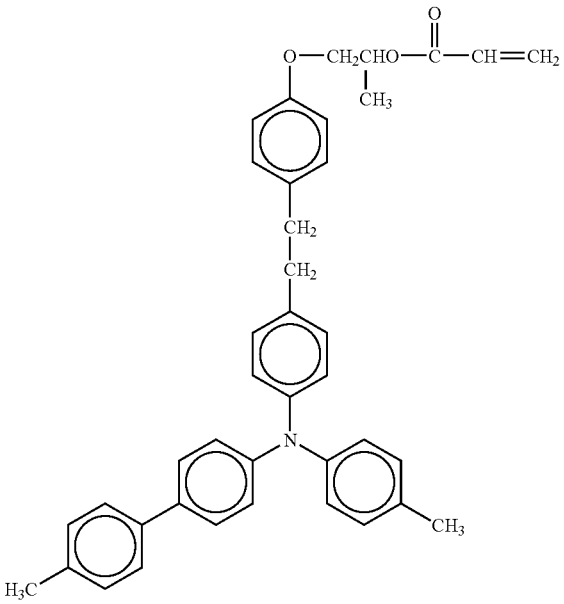
-continued
No. 140
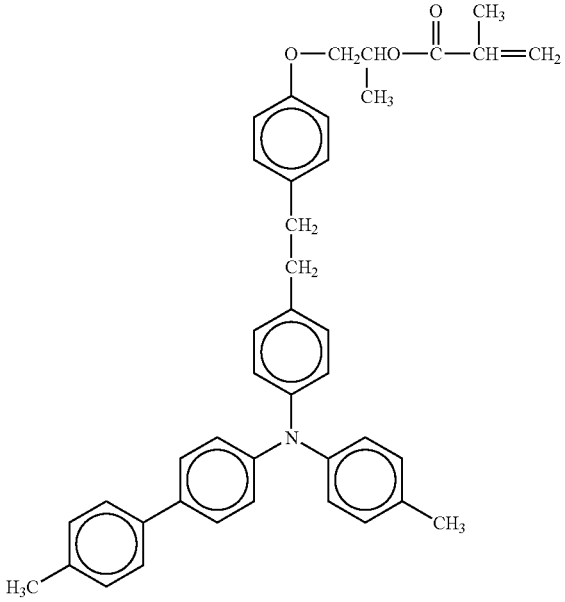
No. 141
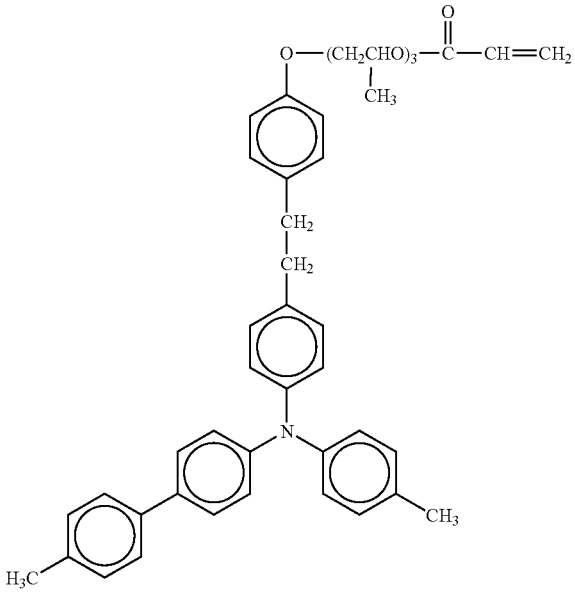

-continued
No. 142
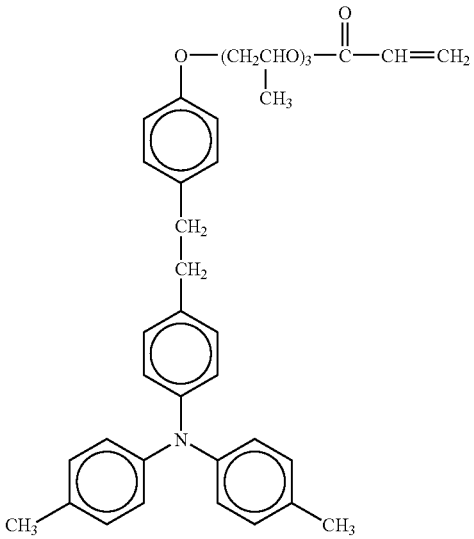
No. 143
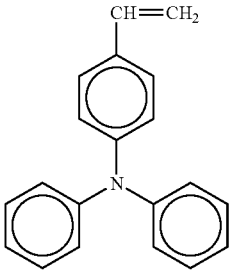
No. 144
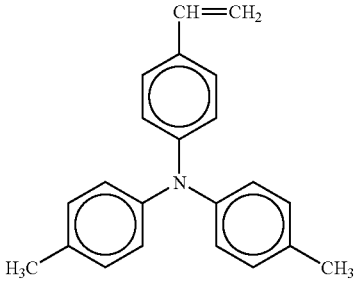
No. 145
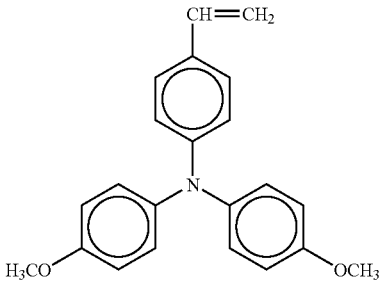
-continued
No. 146
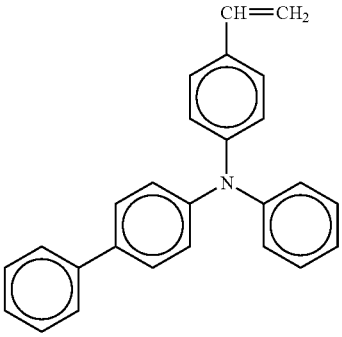
No. 147
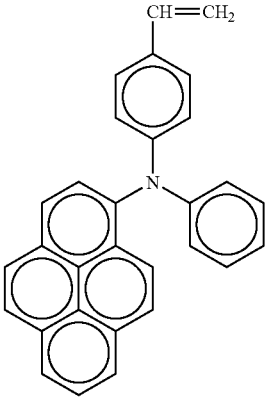
No. 148
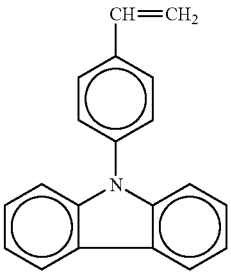
No. 149
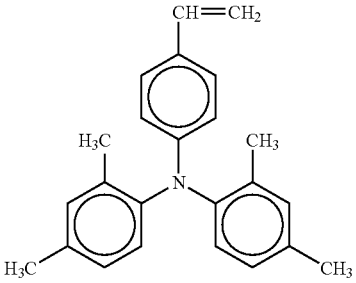

-continued
No. 150
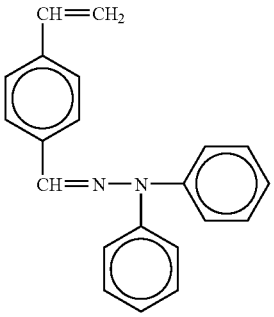
No. 151
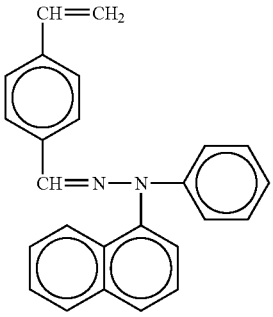
No. 152
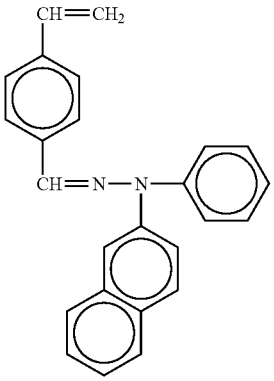
No. 153
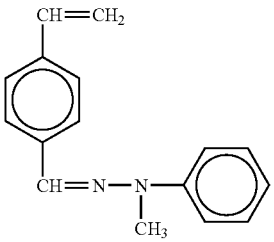
No. 154
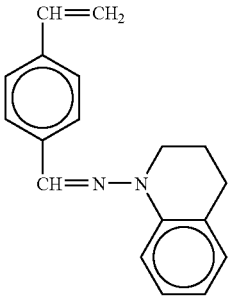
-continued
No. 155
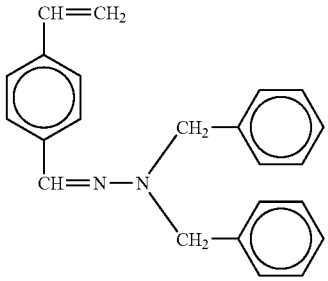
No. 156
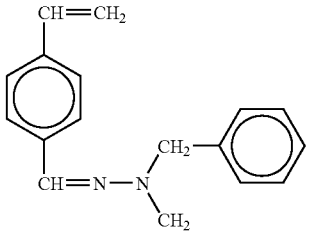
No. 157
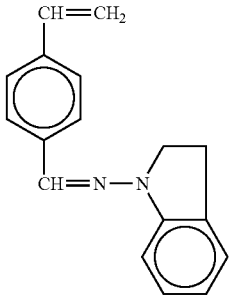
No. 158
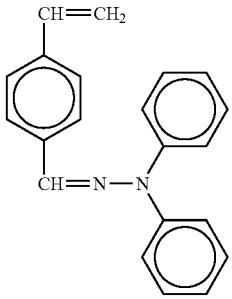
No. 159
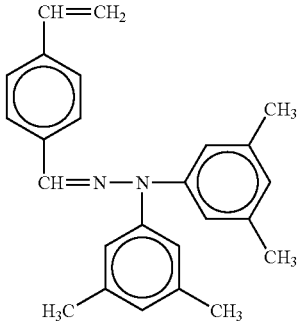

-continued

No. 160

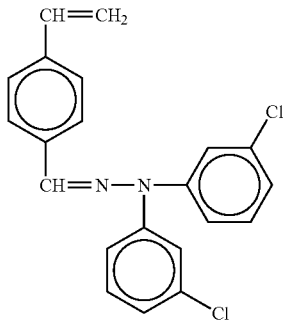

Also, the one-functional free-radical-polymerizable compound having a charge transporting structure used for the present invention is important for giving charge transportation ability to the cross-linked surface layer and the content of the compound is 20-80% by weight, preferably 30-70% by weight of the total weight of the cross-linked surface layer. If the content is less then 20% by weight, the charge transportation performance of the cross-linked surface layer cannot be maintained sufficiently and the degradation of the electrical characteristics such as lowering in the sensitivity and the elevation of the residual potential are caused in repeated use. On the other hand, if the content is over 80% by weight, the content of the free-radical-polymerizable monomer having no charge transporting structure represented by general formula (A) is reduced. As the result, the lowering in the cross-link density is caused so that the abrasive resistance is insufficient. As the balance of the electrical characteristics and the abrasive resistance is considered, the content of the compound is most preferably in a range of 30-70% by weight, although it depends on used processes that may require different electrical characteristics or abrasive resistance.

The surface layer in the present invention is a cross-linked surface layer obtained by simultaneously curing at least the free-radical-polymerizable monomer having no charge transporting structure represented by general formula (A) and the one-functional free-radical-polymerizable compound having a charge transporting structure. Herein, a one-through four-functional free-radical-polymerizable monomer and a radical-polymerizable oligomer can be used in combination for the purpose of giving a function such as the control of the viscosity of a coating liquid for the surface layer, stress relaxation for the cross-linked surface layer, the reduction of surface free energy, and the reduction of a friction coefficient.

A well-known free-radical-polymerizable monomer and a well-known oligomer can be used.

As the one-through four-functional free-radical-polymerizable monomer, the following compounds are exemplified but the monomer is not limited to these compounds.

That is, as the free-radical-polymerizable monomer used in the present invention, for example, trimethylolpropane triacrylate (TMPTA), trimethylolpropane trimethacrylate, HPA-modified trimethylolpropane triacrylate, EO-modified trimethylolpropane triacrylate, PO-modified trimethylolpropane triacrylate, caprolactone-modified trimethylolpropane triacrylate, HPA-modified trimethylolpropane trimethacrylate, penta-erythritol triacrylate, penta-erythritol tetraacrylate (PETTA), glycerole triacrylate, ECH-modified glycerole triacrylate, EO-modified glycerole triacrylate, PO-modified glycerole triacrylate, tris(acryloxyethyl)isocyanurate, alkyl-modified di-penta-erythritol tetraacrylate, alkyl-modified di-penta-erythritol triacrylate, dimethylolpropane tetraacrylate (DTMPTA), penta-erythritol ethoxytetraacrylate, EO-modified phosphate triacrylate, 2,2,5,5-tetrahydroxymethylcyclopentanone tetraacrylate, 2-ethylhexyl acrylate, 2-hydroxyethyl acrylate, 2-hydroxypropyl acrylate, tetrahydrofurfuryl acrylate, 2-ethylhexylCarbitol acrylate, 3-methoxybutyl acrylate, benzyl acrylate, cyclohexyl acrylate, isoamyl acrylate, isobutyl acrylate, methoxytriethylene glycol acrylate, phenoxytetraethylene glycol acrylate, cetyl acrylate, isostearyl acrylate, stearyl acrylate, styrene monomer, 1,3-butanediol diacrylate, 1,4-butanediol diacrylate, 1,4-butanediol dimethacrylate, 1,6-hexanediol diacrylate, 1,6-hexanediol dimethacrylate, diethyleneglycol diacrylate, neopentylglycol diacrylate, EO-modified bisphenol A diacrylate, EO-modified bisphenol F diacrylate, neopentylglycol diacrylate, di-penta-erythritol pentaacrylate, di-penta-erythritol hexaacrylate, and caprolactone-modified di-penta-erythritol hexaacrylate can be provided.

As the functional monomer, for example, a reactive additive having a fluorine atom as a substituent or a radical-polymerizable functional group such as octafluoropentyl acrylate, 2-perfluorooctylethyl acrylate, 2-perfluorooctylethyl methacrylate, and 2-perfluoroisononylethyl acrylate and a reactive silicone-based additive such as PO-modified 2-neopentylglycol diacrylate can be effectively used.

The functional monomers may be used singularly or in combination as a mixture. The content of the functional monomer is 0.01-30% by weight, preferably 0.05-20% by weight of a solid content of coating liquid for forming a cross-linked layer.

As the radical-polymerizable oligomer, for example, epoxyacrylate-type oligomer, urethane acrylate-type oligomer, and polyester acrylate-type oligomer can be provided. Herein, if a one-functional or two-functional free-radical-polymerizable monomer or a radical-polymerizable oligomer is much contained, the three-dimensional cross-link density of the cross-linked surface layer substantially lowers so that the lowering in the abrasive resistance is caused. Therefore, the content of the monomer and the oligomer is regulated to be equal to or less than 150 parts by weight, preferably equal to or less than 100 parts by weight per 100 parts by weight of the free-radical-polymerizable monomer having no charge transporting structure represented by general formula (A).

Also, although the surface layer in the present invention is a cross-linked surface layer obtained by simultaneously curing at least the free-radical-polymerizable monomer having no charge transporting structure represented by general formula (A) and the one-functional free-radical-polymerizable compound having a charge transporting structure, a polymerization initiator may be used for the cross-linked surface layer according to need, for example, for promoting the cross-linking reaction efficiently.

As a thermal polymerization initiator, peroxide-type initiators such as 2,5-dimethylhexane-2,5-dihydroperoxide, dicumylperoxide, benzoyl peroxide, t-butylcumylperoxide, 2,5-dimethyl-2,5-di(peroxybenzoyl)hexyne-3,3-di-t-butylperoxide, t-butylhydroperoxide, cumene hydroperoxide, and lauroyl peroxide, and azoic initiators such as azobis(isobutylnitrile), azobis(cyclohexanecarbonitrile), azobis(methyl isobutyrate), azobis(isobutylamidine hydrochloride), and 4,4'-azobis(4-cyanovaleric acid) can be provided.

As a photo-polymerization initiator, acetophenone-based or ketal-type photo-polymerization initiators such as diethoxyacetophenone, 2,2-dimethoxy-1,2-diphenylthene-1-one, 1-hydroxycyclohexyl-phenylketone, 4-(2-hydroxyethoxy)phenyl(2-hydroxy-2-propyl)ketone, 2-benzyl-2-dimethylamino-1-(4-morpholinophenyl)butanone-1,2-hydroxy- 2-methyl-1-phenylpropane-1-one, 2-methyl-2-morpholino (4-methylthiophenyl)propane-1-one, and 1-phenyl-1,2-propanedione-2-(o-ethoxycarbonyl)oxime, benzoin ether-type photo-polymerization initiators such as benzoin, benzoin methyl ether, benzoin ethyl ether, benzoin isobutyl ether, and benzoin isopropyl ether, benzophenone-based photo-polymerization initiators such as benzophenone, 4-hydroxybenzophenone, methyl o-benzoylbenzoate, 2-benzoylnaphthalene, 4-benzoylbiphenyl, 4-benzoyl phenyl ether, acrylated benzophenone, and 1,4-benzoylbenzene, thioxanthone-based photo-polymerization initiators such as 2-isopropylthioxanthone, 2-chlorothioxanthone, 2,4-dimethylthioxanthone, 2,4-diethylthioxanthone, and 2,4-dichlorothioxanthone, and other photo-polymerization initiators such as ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methylphenylglyoxy ester, 9,10-phenanthrene, acridine-based compounds, triazine-based compounds, and imidazole-based compounds, can be provided.

Also, additives having photo-polymerization promoting effect can be employed singularly or in combination with the photo-polymerization initiator. For example, triethanolamine, methyldiethanolamine, ethyl 4-dimethylaminobenzoate, isoamyl 4-dimethylaminonemzoate, (2-dimethylamino)ethyl benzoate, and 4,4'-dimethylaminobenzophenone can be provided.

The polymerization initiators may be used singularly or in combination as a mixture. The content of the polymerization initiator is 0.5-40 parts by weight, preferably 1-20 parts by weight per 100 parts by weight of total contents having a radical polymerizing property.

Although the surface layer in the present invention is a cross-linked surface layer obtained by simultaneously curing at least the free-radical-polymerizable monomer having no charge transporting structure represented by general formula (A) and the one-functional free-radical-polymerizable compound having a charge transporting structure, filler particles can be contained for the purpose of improving the abrasive resistance.

The average primary particle size of the filler is preferably 0.01-0.5 μm on the points of light transmittance of the surface layer and the abrasive resistance. If the average primary particle size of the filler is less than 0.01 μm, the degradation of the dispersiveness of the filler is caused and the effect of improving the abrasive resistance is not sufficiently exerted. On the other hand, if the average primary particle size of the filler is over 0.5 μm, the precipitation of the filler may be promoted in a liquid dispersion and toner filming may be caused.

The higher the concentration of the filler material in the surface layer is, the abrasive resistance is advantageously high. However, if the concentration is too high, a side effect such as the elevation of the residual potential and the reduction of the transmittance of writing light through the surface layer may be caused. Therefore, the concentration is generally equal to or less than 50% by weight, preferably equal to or less than 30% by weight of total solid content.

Furthermore, the filler can be surface-treated by using at least one kind of surface treatments and such surface treatment is preferable with respect to the dispersiveness of the filler. The reduction of the dispersiveness of the filler does not only cause the elevation of the residual potential but also the reduction of the transparency of a coated film, the generation of defects on a coated film, and further the reduction of the abrasive resistance, which may cause the serious problem of disturbing the attainment of high durability and high quality image.

As the surface treatment, although all conventionally used surface treatments can be used, a surface treatment capable of keeping the insulation properties of the filler is preferable.

The amount of the surface treatment is suitably 3-30% by weight, preferably 5-20% by weight of the weight of filler although it depends on the primary particle size of the used filler. If the amount of the surface treatment is less than 3% by weight, the effect of the dispersion of the filler cannot be obtained. Also, if the amount of the surface treatment is over 30% by weight, significant elevation of the residual potential is caused. The filler materials are used singularly or in combination as a mixture.

Moreover, coating liquid used for the present invention can contain an additive such as each kind of plasticizer (for the purpose of stress relaxation or the improvement of adhesive properties) and a leveling agent according to need. For such additives, well-known additives is can be used. As the plasticizer, a plasticizer generally used for resin, such as dibutyl phthalate, dioctyl phthalate, etc. can be used and the usage of the plasticizer is equal to or less than 20% by weight, preferably equal to or less than 10% by weight of total solid content contained in coating liquid. Also, as the leveling agent, silicone oils such as dimethylsilicone oil, methylphenylsilicone oil, etc. and a polymer or oligomer that contain a perfluoroalkyl group in a side chain thereof can be used and the usage of the leveling agent is appropriately equal to or less than 3% by weight of total solid content contained in coating liquid.

For a composition contained in coating liquid for cross-linked surface layer, a binder resin can be contained in a quantity such that surface smoothness, electrical characteristics, or durability of the photoconductor are preserved. However, when a polymer material such as a binder resin is contained in coating liquid, phase separation occurs due to the low compatibility with a polymer produced by the curing reaction of a radical-polymerizable composition (the free-radical-polymerizable monomer and the free-radical-polymerizable compound having an charge transporting structure) and, as the result, the irregularity of the surface of the cross-linked surface layer become markedly uneven. Accordingly, no use of a binder resin is preferable.

The cross-linked surface layer of the present invention is formed by coating and curing coating liquid that contains the free-radical-polymerizable monomer having no charge transporting structure represented by general formula (A) and the one-functional free-radical-polymerizable compound having a charge transporting structure.

If the free-radical-polymerizable monomer is in a liquid state, such coating liquid in which another component can be dissolved can be coated but coating liquid diluted with solvent according to need is coated. As the used solvent, alcohols such as methanol, ethanol, propanol, and butanol, ketones such as acetone, ethyl methyl ketone, isobutyl methyl ketone, and cyclohexanone, esters such as ethyl acetate and butyl acetate, ethers such as tetrahydrofuran, dioxane, propylether, halogenated hydrocarbons such as dichloromethane, dichloroethane, trichloroethane, and chlorobenzene, aromatic hydrocarbons such as benzene, toluene, and xylene, and cellosolves such as methylcellosolve, ethylcellosolve, and cellosolve acetate can be provided.

The solvents are used singularly or in combination as a mixture. The dilution ratio of the coating liquid with the solvent is arbitrary decided dependent on the solubility of the composition, a coating method, and objective film thickness.

The coating can be carried out using a dip coating method, a spray coat method, a bead coat method, or a ring coat method.

In the present invention, after such coating liquid is coated, the coated liquid is cured providing external energy, so as to form the cross-linked surface layer. As the external energy, thermal energy, light energy, and radiation energy can be used.

As a method for applying the thermal energy, the coated liquid is heated from the side of a coated surface or a support using air, a gas such as nitrogen, a vapor, each kind of thermal medium, infrared rays, or electromagnetic waves. The heating temperature is preferably equal to or greater than 100° C. and equal to or less than 170° C. If the temperature is less than 100° C., the reaction rate of curing is slow so that the reaction does not complete perfectly. If the temperature is over 170° C., the reaction promotes inhomogeneously, so that marked distortion occurs in the cross-linked surface layer. In order to promote the curing reaction homogeneously, a method of heating at a comparatively low temperature less than 100° C. and subsequently heating up to a temperature equal to or greater then 100° C. so as to complete the reaction is useful.

For providing the light energy, an UV light source such as a high-pressure mercury-vapor lamp and a metal halide lamp, which having emission wavelength mainly in a ultraviolet region can be used but a visible light source may be selected in accordance with absorption wavelength of the radical-polymerizable content or photo-polymerization initiator. The illuminance of irradiating light is preferably equal to or greater than 50 $mW/cm^2$ and equal to or less than 1,000 $mW/cm^2$. If the illuminance is less than 50 $mW/cm^2$, it takes a long time to complete the curing reaction. If the illuminance is over 1,000 $mW/cm^2$, the reaction promotes inhomogeneously, so that the irregularity of the cross-linked surface layer is enhanced.

For providing the radiation energy, an electron beam can be used.

Among the aforementioned energies, it is useful to employ thermal or light energy because of easy control of the reaction rate and the simplicity of a device.

Since the film thickness of the cross-linked surface layer used for the present invention depends on the layer structure of the photoconductor in which the cross-linked surface layer is employed, the film thickness is explained with a description of the layer structure below.

Now, the layer structure of the photoconductor according to the present invention is described below.

<Layer Structure of an Electrophotographic Photoconductor>

An electrophotographic photoconductor according to the present invention is illustrated based on the drawings.

Figure 1B:
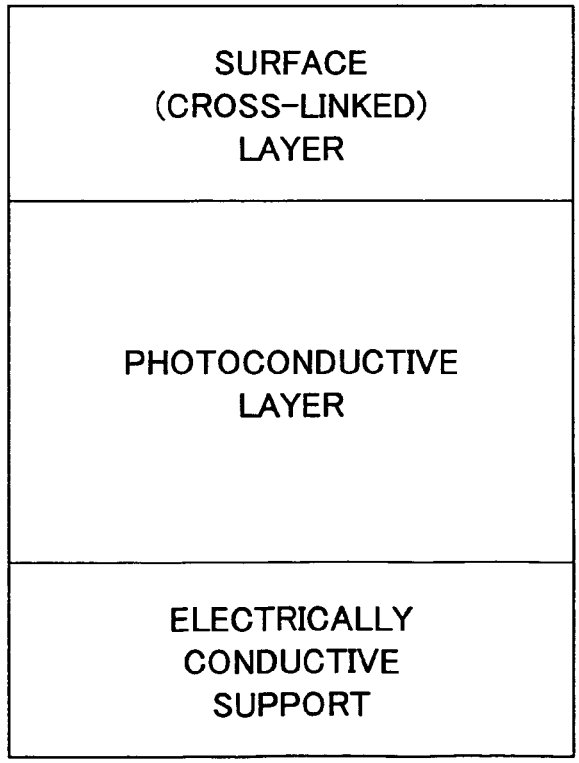

FIGS. 1A and 1B illustrate electrophotographic photoconductors having a single layer structure according to the present invention, in which a photoconductive layer having both a charge generation function and a charge transportation function is provided on an electrically conductive support. FIG. 1A illustrates a cross-linked surface layer obtained by cross-linking or curing the entire photoconductive layer and FIG. 1B illustrates a cross-linked surface layer provided on the surface of a photoconductive layer.

Figure 2A:
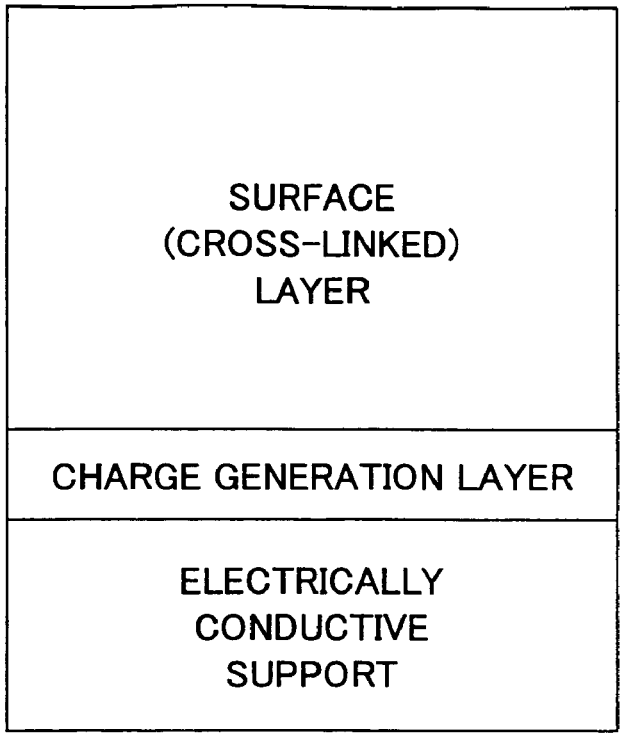
FIGS. 2A and 2B are cross-sectional views of other examples of an electrophotographic photoconductor according to the present invention.
Figure 2B:
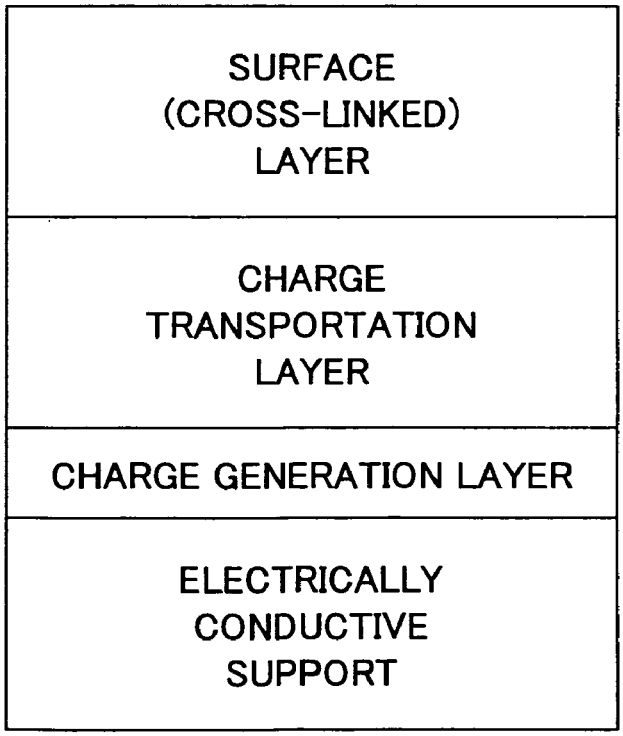

FIGS. 2 A and 2B illustrate electrophotographic photoconductors having a laminated layer structure according to the present invention, in which a charge generation layer having a charge generation function and a charge transportation layer having a charge transportation function are laminated on an electrically conductive support. FIG. 2A illustrates a cross-linked surface layer obtained by cross-linking or curing the entire charge transportation layer and FIG. 2B illustrates a cross-linked surface layer provided on the surface of a charge transportation layer.

<Electrically Conductive Support>

As the electrically conductive support, an electrically conductive support obtained by applying a film-shaped or cylindrical plastic or paper with an electrically conductive material with a volumetric resistivity of $10^{10}$ Ωcm, for example, a metal such as aluminum, nickel, chromium, nichrome, copper, gold, silver, and platinum, and a metal oxide such as tin oxide and indium oxide by means of vapor-depositing or sputtering, a electrically conductive plate made of aluminum, aluminum alloy, nickel, or stainless, and an electrically conductive pipe produced by applying surface treatment such as cutting, super finishing, and polishing to an unfinished pipe obtained by extruding or drawing aluminum, aluminum alloy, nickel, or stainless can be used. Furthermore, an endless nickel belt and an endless stainless belt that are disclosed in Japanese Laid-Open Patent Application No. 52-36016 can be used as the electrically conductive support. Moreover, an electrically conductive support obtained by applying a liquid dispersion containing electrically conductive powder in a proper binder resin on the aforementioned electrically conductive support can be also used.

As the electrically conductive powder, carbon black powder, acetylene black powder, metal powders such as aluminum powder, nickel powder, iron powder, nichrome powder, copper powder, zinc powder, and silver powder, and metal oxide powders such as electrically conductive tin oxide powder and ITO (indium tin oxide) powder.

As the binder material used with the electrically conductive powder, a thermoplastic resin, a thermosetting resin, and a photosetting resin, such as poly(styrene), styrene-acrylonitrile copolymer, styrene-butadiene copolymer, styrene-maleic anhydride copolymer, polyester, poly(vinyl chloride), vinyl chloride-vinyl acetate copolymer, poly(vinyl acetate), poly(vinylidene chloride), polyallylate resin, phenoxy resin, polycarbonate, cellulose acetate resin, ethylcellulose resin, poly(vinyl butyral), poly(vinyl formal), poly(vinyltoluene), poly(N-vinylcarbazole), acrylic resin, silicone resin, epoxy resin, melamine resin, urethane resin, phenol resin, and alkyd resin can be provided. Such electrically conductive layer can be provided by applying the dispersion liquid obtained by dispersing the electrically conductive powder and the binder resin in a proper solvent such as tetrahydrofuran, dichloromethane, ethyl methyl ketone, and toluene, onto the aforementioned electrically conductive support.

Advantageously, the electrically conductive support used for the present invention may be an electrically conductive support obtained by providing an electrically conductive layer made of a heat-shrinkable tubing that contains the aforementioned electrically conductive powder in a material such as poly(vinyl chloride), poly(propylene), polyester, poly(styrene), poly(vinylidene chloride), poly(ethylene), chlorinated rubber, and Teflon (Trade Mark) on a proper cylindrical substrate.

<Photoconductive Layer>

Next, a photoconductive layer is described. The photoconductive layer may have either the laminated structure or the single layer structure.

A photoconductive layer having the laminated structure includes a charge generation layer having a charge generation function and a charge transportation layer having a charge transportation function. On the other hand, a photoconductive layer having the single layer structure is a layer having both a charge generation function and a charge transportation function.

Both the laminated-layer-structure photoconductive layer and the single-layer-structure photoconductive layer are described below.

<Laminated-Layer-Structure Photoconductive Layer>

(Charge Generation Layer)

A charge generation layer is a layer based on a charge generation material having a charge generation function, for which a binder resin can be used in combination according to need.

As the charge generation material, either an inorganic charge generation material or an organic charge generation material can be employed.

As the inorganic charge generation material, crystalline selenium, amorphous selenium, selenium-tellurium, a selenium-tellurium-halogen, a selenium-arsenic compound, and amorphous silicon can be provided. Advantageously, the dangling bond of the amorphous silicon may be terminated with a hydrogen atom or a halogen atom and the amorphous silicon may be doped with a boron atom, phosphorus atom, or the like.

On the other hand, as the organic charge generation material, well-known materials can be used. For example, a phthalocyanine-based pigment such as metal phthalocyanine and an azo pigment containing a triphenylamine skeleton, no-metal phthalocyanine, an azulenium salt pigment, a methyl squarate pigment, an azo pigment containing a carbazole skeleton, an azo pigment containing a triphenylamine skeleton, an azo pigment containing a diphenylamine skeleton, an azo pigment containing a dibenzothiophene skeleton, an azo pigment containing a fluorenone skeleton, an azo pigment containing an oxadiazole skeleton, an azo pigment containing a bis(stilbene) skeleton, an azo pigment containing an distyryloxadiazole skeleton, an azo pigment containing an distyrylcarbazole skeleton, a perylene-based pigment, a polycyclic quinone-based pigment such as an anthraquinone-based pigment, a quinoneimine-based pigment, a diphenylmethane-based pigment, a triphenylmethane-basedpigment, a benzoquinone-based pigment, a naphthoquinone-based pigment, a cyanine-based pigment, an azomethyne-based pigment, an indigoid-based pigment, and a bis(benzimidazole)-based pigment can be provided.

The charge generation materials can be used singularly or in combination as a mixture.

As the binder resin used for the charge generation layer according to need, polyamide, polyurethane, epoxy resin, polyketone, polycarbonate, silicone resin, acrylic resin, poly(vinyl butyral), poly(vinyl formal), poly(vinyl ketone), polystyrene, poly(N-vinylcarbazole), and polyacrylamide can be provided. The binder resins can be used singularly or in combination as a mixture.

In addition, as a binder resin for the charge generation layer, beside the aforementioned binder resin, a polymeric charge transportation material having a charge transportation function, for example, a polymer material such as polycarbonate, polyester, polyurethane, polyether, polysiloxane, and an acrylic resin, and a polymer material containing a polysilane skeleton, all of which have an arylamine skeleton, a benzidine skeleton, a hydrazone skeleton, a carbazole skeleton, a stilbene skeleton, or a pyrazoline skeleton, can be also used.

Provided as the specific examples of the former are, for example, polymeric charger transportation materials disclosed in Japanese Laid-Open Patent Application No. 01-001728, Japanese Laid-Open Patent Application No. 01-009964, Japanese Laid-Open Patent Application No. 01-013061, Japanese Laid-Open Patent Application No. 01-019049, Japanese Laid-Open Patent Application No. 01-241559, Japanese Laid-Open Patent Application No. 04-011627, Japanese Laid-Open Patent Application No. 04-175337, Japanese Laid-Open Patent Application No. 04-183719, Japanese Laid-Open Patent Application No. 04-225014, Japanese Laid-Open Patent Application No. 04-230767, Japanese Laid-Open Patent Application No. 04-320420, Japanese Laid-Open Patent Application No. 05-232727, Japanese Laid-Open Patent Application No. 05-310904, Japanese Laid-Open Patent Application No. 06-234836, Japanese Laid-Open Patent Application No. 06-234837, Japanese Laid-Open Patent Application No. 06-234838, Japanese Laid-Open Patent Application No. 06-234839, Japanese Laid-Open Patent Application No. 06-234840, Japanese Laid-Open Patent Application No. 06-234841, Japanese Laid-Open Patent Application No. 06-239049, Japanese Laid-Open Patent Application No. 06-236050, Japanese Laid-Open Patent Application No. 06-236051, Japanese Laid-Open Patent Application No. 06-295077, Japanese Laid-Open Patent Application No. 07-056374, Japanese Laid-Open Patent Application No. 08-176293, Japanese Laid-Open Patent Application No. 08-208820, Japanese Laid-Open Patent Application No. 08-211640, Japanese Laid-Open Patent Application No. 08-253568, Japanese Laid-Open Patent Application No. 08-269183, Japanese Laid-Open Patent Application No. 09-062019, Japanese Laid-Open Patent Application No. 09-043883, Japanese Laid-Open Patent Application No. 09-71642, Japanese Laid-Open Patent Application No. 09-87376, Japanese Laid-Open Patent Application No. 09-104746, Japanese Laid-Open Patent Application No. 09-110974, Japanese Laid-Open Patent Application No. 09-110976, Japanese Laid-Open Patent Application No. 09-157378, Japanese Laid-Open Patent Application No. 09-221544, Japanese Laid-Open Patent Application No. 09-227669, Japanese Laid-Open Patent Application No. 09-235367, Japanese Laid-Open Patent Application No. 09-241369, Japanese Laid-Open Patent Application No. 09-268226, Japanese Laid-Open Patent Application No. 09-272735, Japanese Laid-Open Patent Application No. 09-302084, Japanese Laid-Open Patent Application No. 09-302085, and Japanese Laid-Open Patent Application No. 09-328539.

Also, provided as the specific examples of the latter are, for example, polysilylenes disclosed in Japanese Laid-Open Patent Application No. 63-285552, Japanese Laid-Open Patent Application No. 05-19497, Japanese Laid-Open Patent Application No. 05-70595, and Japanese Laid-Open Patent Application No. 10-73944.

Additionally, a low-molecular-weight charge transportation material can be contained in the charge generation layer. As the low-molecular-weight charge transportation material used for the charge generation layer, a hole transportation material and a electron transportation material can be provided.

As the electron transportation material, an electron accepting material such as chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and diphenoquinone derivatives can be provided. The electron transportation materials can be used singularly or in combination as a mixture.

As the hole transportation material, an electron donating material as described below can be provided and preferably used.

As the hole transportation material, oxazole derivatives, oxadiaxole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bis(stilbene) derivatives, enamine derivatives, and other well-known materials can be provided. The hole transportation materials can be used singularly or in combination as a mixture.

As a representative method for forming the charge generation layer, a method of producing a thin film in vacuum and a method of casting from solution or liquid dispersion can be provided.

As the former method, a vapor deposition method, a glow discharge decomposition method, an ion plating method, a sputtering method, a reactive sputtering method, a CVD method can be provided and a charge generation layer that contains the inorganic charge generation material or the organic charge generation material can be formed well.

When a charge generation layer is formed by the latter casting method, the charge generation layer can be formed by dispersing the inorganic or organic charge generation material, if necessary, with the binder resin, into a solvent such as tetrahydrofuran, dioxane, dioxoran, toluene, dichloromethane, monochlorobenzene, dichloroethane, cyclohexanone, cyclopentanone, anisole, xylene, ethyl methyl ketone, acetone, ethyl acetate, and butyl acetate, by means of ball-mill, attriter, sand mill, or beads mill, then moderately diluting the obtained liquid dispersion and applying the diluted dispersion. Additionally, a leveling agent such as dimethylsilicone oil and methylphenylsilicone oil can be added according to need. Application of coating liquid can be carried out by means of dip coating, spray coating, beads coating, or ring coating.

The film thickness of the charge generation layer provided as described above is appropriately 0.01-5 μm, preferably 0.05-2 μm.

(Charge Transportation Layer)

A charge transportation layer is a layer having a charge transportation function and a cross-linked surface layer having a charge transporting structure is used as the charge transportation layer in the present invention. When the cross-linked surface layer is the whole of a charge transportation layer, as described in the aforementioned method of producing a cross-linked surface layer, the cross-linked surface layer is formed by applying coating liquid that contains a radical-polymerizable composition for the present invention (the radical polymerizable monomer having no charge transporting structure represented by general formula (A) and the one-functional radical-polymerizable compound having a charge transporting structure) onto the charge generation layer, drying the coating liquid according to need, and initiating a curing reaction due to external energy. Herein, the film thickness of the cross-linked surface layer is 10-30 μm, preferably 10-25 μm. If the film thickness is less than 10 μm, a sufficient charging electrical potential cannot be maintained. On the other hand, if the film thickness is over 30 μm, the cross-linked surface layer easily separates from an under layer due to the volume shrinkage at the time of curing.

When the cross-linked surface layer is formed on the surface of a charge transportation layer, or, in other words, a charge transportation layer has a laminated structure, a charge transportation layer portion, which is an under layer of the cross-linked surface layer, can be formed by dissolving or dispersing a charge transportation material having a charge transportation function and a binder resin into a proper solvent, applying the obtained solution or dispersion liquid onto a charge generation layer and drying the applied solution or dispersion liquid. Subsequently, the coating liquid containing a radical-polymerizable composition for the present invention is applied on the charge transportation layer portion and cross-linked or cured by using external energy so as to obtain a cross-linked surface layer.

As the charge transportation material, the electron transportation materials, the hole transportation materials, and the polymeric charge transportation materials, described for the charge generation layer, can be used. As described above, the use of the polymeric charge transportation material is particularly useful since the solubility of the under layer portion of the charge transportation layer at the time of applying the coating liquid for the cross-linked surface layer can be reduced.

As the binder resin used in combination with the charge transportation material, a thermoplastic resin and a thermosetting resin, such as poly(styrene), styrene-acrylonitrile copolymer, styrene-butadiene copolymer, styrene-maleic anhydride copolymer, polyester, poly(vinyl chloride), vinyl chloride-vinyl acetate copolymer, poly(vinyl acetate), poly (vinylidene chloride), polyallylate resin, phenoxy resin, polycarbonate, cellulose acetate resin, ethylcellulose resin, poly (vinyl butyral), poly(vinyl formal), poly(vinyltoluene), poly (N-vinylcarbazole), acrylic resin, silicone resin, epoxy resin, melamine resin, urethane resin, phenol resin, and alkyd resin can be provided.

The content of the charge transportation material is appropriately 20-300 parts by weight, preferably 40-150 parts by weight per 100 parts by weight of the binder resin. Additionally, when the polymeric charge transportation material is used, the polymeric charge transportation materials can be used singularly or in combination with the binder resin.

As a solvent used in the coating liquid for the under layer portion of the charge transportation layer, a solvent for the charge generation layer can be similarly used but a solvent that can dissolve the charge transportation material and the binder resin well is preferable. The solvents may be used singularly or in combination as a mixture. Also, in order to form the under layer portion of the charge transportation layer, the coating methods for the charge generation layer can be used similarly.

Additionally, a plasticizer or a leveling agent can be added according to need. As the plasticizer used for the under layer portion of the charge transportation layer, a plasticizer used for a general resin, such as dibutyl phthalate and dioctyl phthalate, can be directly used and the usage of the plasticizer is appropriately 0-30 parts by weight per 100 parts by weight of the binder resin. As the leveling agent used for the under layer portion of the charge transportation layer, silicone oils such as dimethylsilicone oil and methylphenylsilicone oil and a polymer oligomer containing a perfluoroalkyl group in side chain thereof can be provided and the usage of the leveling agent is appropriately 0-1 parts by weight per 100 parts by weight of the binder resin.

The film thickness of the under layer portion of the charge transportation layer is approximately 5-40 μm, preferably 10-30 μm.

When the cross-linked surface layer is a surface portion of charge transportation layer, as described in the aforementioned method of producing a cross-linked surface layer, the cross-linked surface layer is formed by applying the coating liquid that contains a radical-polymerizable composition for the present invention onto the under layer portion of the charge transportation layer, drying the applied coating liquid according to need, and initiating a curing reaction due to external thermal or light energy. In this case, the film thickness of the cross-linked surface layer is 1-20 μm, preferably 2-10 μm. If the film thickness is less than 1 μm, the durability of the cross-linked surface layer is variable dependent on the ununiformity of the film thickness. On the other hand, if the film thickness is over 20 μm, the film thickness of the whole of charge transportation layer becomes large, whereby the diffusion of charges increases and the reproducibility of an image decreases.

<Single-Layer-Structure Photoconductive Layer>

A single-layer-structure photoconductive layer is a layer having both a charge generation function and a charge transportation function. The cross-linked surface layer having a charge transporting structure used for the present invention contains a charge generation material having a charge generation function and is usefully used as a single-layer-structure photoconductive layer. As described in the method for forming the charge generation layer by means of casting, the cross-linked surface layer is formed by dispersing the charge generation material into coating liquid containing the radical-polymerizable composition, applying the coating liquid onto a electrically conductive support, drying the applied coating liquid according to need, and initiating a curing reaction by external energy. Herein, liquid dispersion in which the charge generation material is previously dispersed in a solvent may be added into the coating liquid for cross-linked surface layer.

In this case, the film thickness of the cross-linked surface layer is 10-30 μm, preferably 10-25 μm. If the film thickness is less than 10 μm, a sufficient charging electrical potential cannot be maintained. On the other hand, if the film thickness is over 30 μm, the cross-linked surface layer easily separates from an electrically conductive substrate or an underlying layer due to the volume shrinkage at the time of curing.

Also, when the cross-linked surface layer is a surface portion of single-layer-structure photoconductive layer, a photoconductive layer portion, which is an under layer of the cross-linked surface layer, can be formed by dissolving or dispersing a charge generation material having a charge generation function, a charge transportation material having a charge transportation function, and a binder resin into a proper solvent, applying the obtained solution or dispersion liquid onto an electrically conductive support or an underlying layer, and drying the applied solution or dispersion liquid.

Additionally, a plasticizer and a leveling agent can be added according to need. For the method of dispersing a charge generation material, the charge generation material, the charge transportation material, a plasticizer, and a leveling agent, those provided for the charge generation layer and the charge transportation layer can be similarly used. As the binder resin, beside the binder resin provided for the charge transportation layer, the binder resin provided for the charge generation layer may be used in combination. Also, the aforementioned polymeric charge transportation material can be used and is useful in that mixing of the composition contained in the under layer portion of the photoconductive layer into the cross-linked surface layer can be reduced. The film thickness of the under layer portion of the photoconductive layer is approximately 5-30 μm, preferably 10-25 μm.

When the cross-linked surface layer is a surface portion of the single-layer-structure photoconductive layer, as described above, the cross-linked surface layer is formed by applying the coating liquid that contains a radical-polymerizable composition for the present invention and the charge generation material onto the under layer portion of the photoconductive layer, drying the applied coating liquid according to need, and curing the dried coating liquid due to external thermal or light energy. In this case, the film thickness of the cross-linked surface layer is 1-20 μm, preferably 2-10 μm. If the film thickness is less than 1 μm, the durability of the cross-linked surface layer is variable dependent on the ununiformity of the film thickness. On the other hand, if the film thickness is over 20 μm, the film thickness of the whole of charge transportation layer becomes large, whereby the diffusion of charges increases and the reproducibility of an image decreases.

The content of the charge generation material contained in the single-layer-structure photoconductive layer is preferably 1-30% by weight of the total quantity of the photoconductive layer. Also, the content of the binder resin contained in the under layer portion of the photoconductive layer is preferably 20-80% by weight of the total quantity of the photoconductive layer. Further, the content of the charge transportation material is preferably 10-70% by weight of the total quantity of the photoconductive layer.

<Intermediate Layer>

In the photoconductor according to the present invention, the cross-linked surface layer is a surface portion of photoconductive layer, an intermediate layer can be provided between the cross-linked surface layer and the under layer portion of the photoconductive layer for the purpose of suppressing the contamination of a component of the under layer portion into the cross-linked surface layer or improving the adhesive property to the under layer portion. The intermediate layer prevents the inhibition of the curing reaction and the generation of irregularities of the cross-linked surface layer, which are caused by the contamination of the composition contained in the under layer portion of the photoconductive layer into the outermost surface layer that contains the radical-polymerizable composition. Also, the adhesive property of the cross-linked surface layer to the under layer portion of the photoconductive layer can be improved.

The intermediate layer is generally based on a binder resin. As such binder resin, polyamide, alcohol-soluble nylon, water-soluble poly(vinyl butyral), poly(vinyl butyral), and poly(vinyl alcohol) can be provided. As a method for forming an intermediate layer, a commonly used coating method is employed as described above. Additionally, the thickness of the intermediate layer is appropriately 0.05-2 μm.

<Underlying Layer>

In the photoconductor according to the present invention, an underlying layer can be provided between the electrically conductive support and the photoconductive layer. Although the underlying layer is generally based on a resin, such resin is desirably a resin having a high solvent resistance against a general organic solvent, considering the application of coating liquid for photoconductive layer in a solvent on the underlying layer. As such resin, a water-soluble resin such as poly (vinyl alcohol), casein, and poly(sodium acrylate), an alcohol-soluble resin such as copolymerized nylon and methoxymethylated nylon, and a curing-type resin in which a three-dimensional network structure such as polyurethane, melamine resin, phenol resin, alkyd-melamine resin, and epoxy resin can be provided. In addition, a fine powder pigment of a metal oxide such as titanium oxide, silica, alumina, zirconium oxide, tin oxide, and indium oxide, may be added into the underlying layer for preventing the generation of a moire pattern and reducing the residual electric potential.

The underlying layer can be formed be using a proper solvent and a coating method as used for the aforementioned photoconductive layer. Further, a silane coupling agent, titanium coupling agent, chromium coupling agent, etc. can be used for the underlying layer in the present invention. Beside the aforementioned underlying layer, anodized Al2O3, an underlying layer made of an organic material such as poly (para-xylene) (parylene) or an inorganic material such as SiO2, SnO2, TiO2, ITO, and CeO2, by using a method of producing a thin film in vacuum, and a well-known underlying layer can be used well as the underlying layer in the present invention. The thickness of the underlying layer is appropriately 0-5 μm.

<Addition of Antioxidant into Each Layer>

In the present invention, an antioxidant can be added into each layer such as the cross-linked surface layer, the charge generation layer, the charge transportation layer, the underlying layer, and the intermediate layer, for improving an environmental resistance and, particularly, preventing the lowering in the sensitivity and the elevation of the residual electric potential.

As the antioxidant used for the present invention, the following antioxidants can be provided.

(Phenol-Based Compounds)

2,6-di-t-butyl-p-crezol, butylated hydroxyanisole, 2,6-di-t-butyl-4-ethylphenol, stearyl β-(3,5-di-t-butyl-4-hydroxyphenyl)propionate, 2,2'-methylene-bis(4-methyl-6-t-butylphenol), 2,2'-methylene-bis(4-ethyl-6-t-butylphenol), 4,4'-thiobis(3-methyl-6-t-butylphenol), 4,4'-butylidene-bis(3-methyl-6-t-butylphenol), 1,1,3-tris(2-methyl-4-hydroxy-5-t-butylphenyl)butane, 1,3,5-trimethyl-2,4,6-tris (3,5-di-t-butyl-4-hydroxybenzyl)benzene, tetrakis [methylene-3-(3',5'-di-t-butyl-4'-hydroxyphenyl) propionate]methane, bis[3,3'-bis(4'-hydroxy-3'-t-butylphenyl)butyric acid] glycol ester, tocopherols, etc.

(Paraphenylenediamines)

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, etc.

(Hydroquinones)

2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, etc.

(Organic Sulfur Compounds)

dilauryl-3,3'-thiodipropionate, distearyl-3,3'-thiodipropionate, ditetradecyl-3,3'-thiodipropionate, etc.

(Organic Phosphorus Compounds)

triphenylphosphine, tri(nonylphenyl)phosphine, tri(dinonylphenyl)phosphine, tricresylphosphine, tri(2,4-dibutylphenoxy)phosphine, etc.

These compounds are well-known as antioxidants for a rubber, a plastic, a fat and a fatty oil and a commercially available product thereof can be easily obtained.

In the present invention, the content of the antioxidant is 0.01-10% by weight of the total weight of a layer to which the antioxidant is added.

<Image Formation Method and Apparatus>

Next, an image formation method and an image formation apparatus according to the present invention are illustrated in detail based on the drawings.

The image formation method and the image formation apparatus according to the present invention involve the use of a photoconductor having a smooth charge-transporting cross-linked surface layer with low surface energy and a process including, generally at least, a charging step, an image-wise light exposure step, and a developing step for the photoconductor, subsequently, a transcription step and a fixing step, which transcribes and fixes a toner image to an image supporter (a transcription paper), respectively, and a cleaning step of cleaning the surface of the photoconductor. However, in an image formation method in which an electrostatic latent image is directly transcribed onto and developed on a transcription medium, not all steps in the process for the photoconductor is required.

Figure 3:
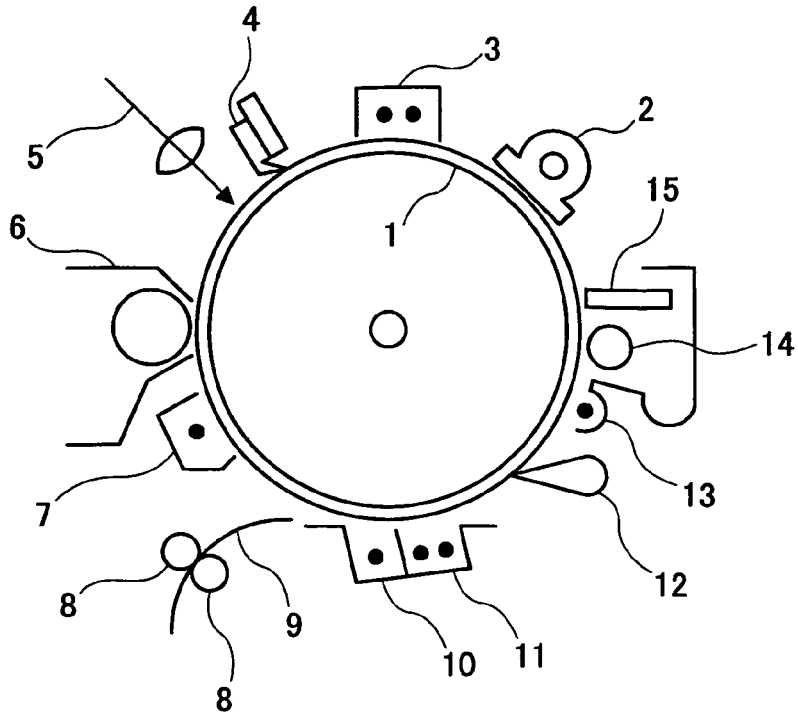
FIG. 3 is a schematic diagram showing an example of an image formation apparatus according to the present invention.

FIG. 3 is a schematic diagram showing an example of the image formation apparatus. An electrically charging charger 3 is employed as means for uniformly charging the photoconductor. As the charging means, a corotron device, a scorotron device, a solid discharge device, a needle electrode device, a roller charging device, and an electrically conductive brush device can be employed and well-known charging methods can be used.

Next, an image-wise light exposure part 5 is employed for forming an electrostatic latent image on the uniformly charged photoconductor 1. As a light source of the image-wise light exposure part 5, all light emitters such as a fluorescent lamp, a tungsten lamp, a halogen lamp, a mercury vapor lamp, a sodium vapor lamp, a light-emitting diode (LED), a semiconductor laser diode (LD), and an electroluminescent (EL) device can be used. Additionally, in order to irradiate the photoconductor with light of a desired wavelength region, each kind of filters such as a sharp cut filter, a bandpass filter, a near-infrared cut filter, a dichroic filter, an interference filter, and a color conversion filter can be employed.

Next, a development unit 6 is used for visualizing the electrostatic latent image formed on the photoconductor 1. As a development method, a one-component development method and a two-component development method, which use dry-type toner, and a wet-process development method, which uses wet-type toner, can be provided. When positive (negative) charging is applied on the photoconductor and image-wise light exposure is performed, a positive (negative) electrostatic latent image is formed on the surface of the photoconductor. When the electrostatic latent image is developed with negatively (positively)-charged toner (charge detecting fine particles), a positive image can be obtained. On the contrary, when the electrostatic latent image is developed with positively (negatively)-charged toner, a negative image can be obtained.

Next, a transcription charger 10 is used for transcribing the visualized toner image on the photoconductor to a transcription medium 9. In addition, a pre-transcription charger 7 may be used in order to perform better transcription. As the transcription means, electrostatic transcription means such as a transcription charger and a bias roller, mechanical transcription means such as adhesion transcription means and pressure transcription means, and magnetic transcription means can be used. As the electrostatic transcription means, the aforementioned charging means can be also used.

Next, as means for separating the transcription medium 9 from the photoconductor 1, a separation charger 11 and a separation claw 12 can be used. As other separation means, a electrostatic adsorption induced separation means, side end belt separation means, a tip grip conveyor, and curvature separation means can be used. As the separation charger 11, the aforementioned charging means can be also used.

Next, a fur brush 14 and a cleaning blade 15 can be used for cleaning the photoconductor after the transcription on which the toner remains. In addition, a pre-cleaning charger 13 can be employed in order to perform more efficient cleaning. As other cleaning means, web cleaning means and magnetic brush means can be used. The cleaning means can be used singularly or in combination.

Next, a charge elimination means may be used for eliminating the latent image remaining on the photoconductor according to need. As the charge elimination means, a charge elimination lamp 2 and a charge elimination charger can be used, and the aforementioned light source for light exposure and the aforementioned charging means can be used, respectively.

Furthermore, as original copy reading means, paper feeding means, fixing means, and paper delivering means, which are not adjacent to the photoconductor, well-known means can be used, respectively.

The image formation method and the image formation apparatus according to the present invention use the electrophotographic photoconductor according to the present invention in an image formation means as mentioned above.

The image formation means may be incorporated and fixed in a copying machine, a facsimile machine, or a printer. However, the image formation machine may be incorporated in the aforementioned apparatus as a process cartridge, which are detachable from the main body of the apparatus. An example of the process cartridge is shown in FIG. 4.

A process cartridge for image formation apparatus incorporates a photoconductor 101, and at least one of charging means 102, developing means 104, transcription means 106, cleaning means 107, and charge elimination means (not shown in the drawings) and a unit (a component) that is detachable from the main body of an image formation apparatus.

Figure 4:
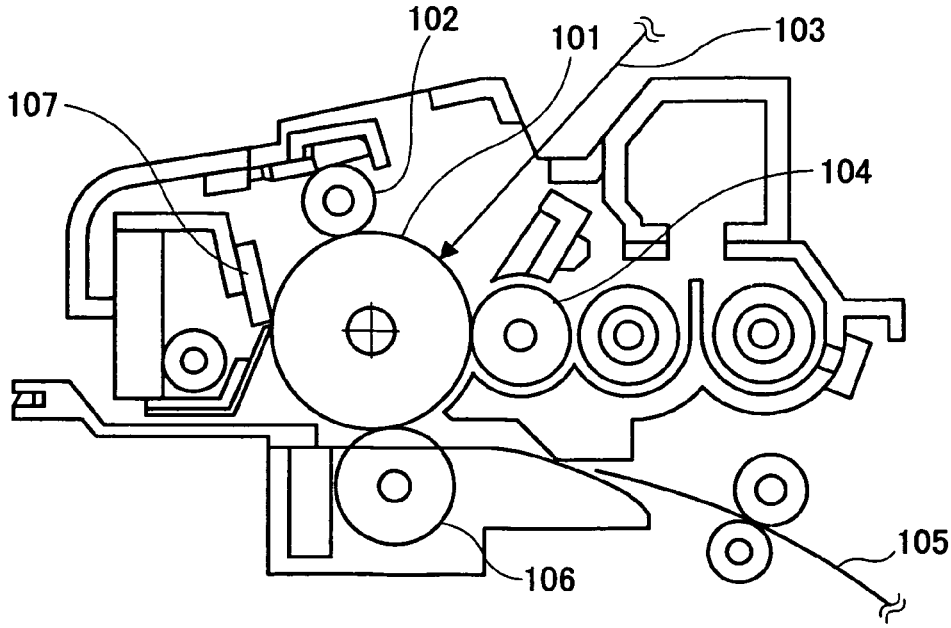
FIG. 4 is a schematic diagram showing an example of a process cartridge for image formation apparatus according to the present invention.

In an image formation process using a unit illustrated in FIG. 4, the photoconductor 101 rotates along a direction denoted by an arrow and an electrostatic latent image is formed on the surface of the photoconductor by charging with charging means 102 and light exposure with light exposure means 103, which electrostatic latent image corresponds to a light exposure image. The electrostatic latent image is developed by the develop means 104 and the toner-developed image is transcribed onto a transcription medium 105 by using transcription means 106 and printed out. Then, the surface of the photoconductor after the image transcription is cleaned by cleaning means 107 and is charge-eliminated by charge elimination means (not shown in the drawings). Again, the process as described above is repeated.

The present invention also provides a process cartridge for image formation apparatus, in which a photoconductor having a polymeric charge transportation layer and the aforementioned cross-linked surface layer and at least one of charging means, developing means, transcription means, cleaning means, and charge elimination means are integrated.

As apparent from the above description, an electrophotographic photoconductor according to the present invention are not only utilized in an electrophotographic copying machine but also can be widely used in the field of an electrophotographic application such as a laser beam printer, a CRT printer, a LED printer, a liquid crystal printer and a laser plate making.

<Synthesis Example of a One-Functional Free-Radical-Polymerizable Compound Having a Charge Transporting Structure>

For example, a one-functional free-radical-polymerizable compound having a transporting structure in the present invention can be synthesized by a method disclosed in Japanese Patent No. 3164426, one example of which is described below.

(1) The synthesis of a hydroxyl-group-substituted triarylamine compound (represented by the following structural formula B)

240 ml of sulfolane was added into 113.85 g (0.3 mol) of a methoxy-group-substituted triarylamine compound (represented by the following structural formula A) and 138 g (0.92 mol) of sodium iodide and the mixture was heated to 60° C. in nitrogen stream. 99 g (0.91 mol) of chlorotrimethylsilane was dropped into the liquid for 1 hour and stirring for 4 and half hours was performed at the temperature of approximately 60° C. to complete the reaction. Approximately 1.5 L of toluene was added into the reaction liquid, which was cooled to the room temperature and washed with water or an aqueous solution of sodium carbonate repeatedly. Then, solvent was removed from the toluene solution and the purification by a column chromatographic treatment (adhesion medium; silica gel, developing solvent; toluene: ethyl acetate=20:1) was carried out. Cyclohexane was added into the obtained pale-yellow oil so as to precipitate a crystal. Thus, 88.1 g (yield=80.4%) of a white crystal represented by the following structural formula B was obtained.

Melting point: 64.0° C.-66.0° C.

TABLE 1

| | Results of elemental analysis (%) | | |
|---|---|---|---|
| | C | H | N |
| Found value | 85.06 | 6.41 | 3.73 |
| Calculated value | 85.44 | 6.34 | 3.83 |

Structural formula A

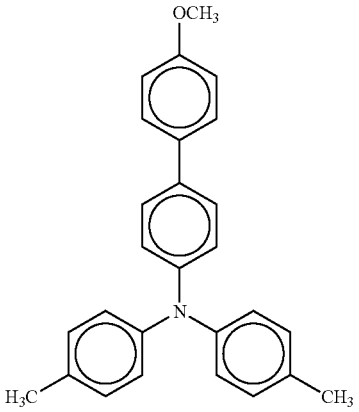

Structural formula B

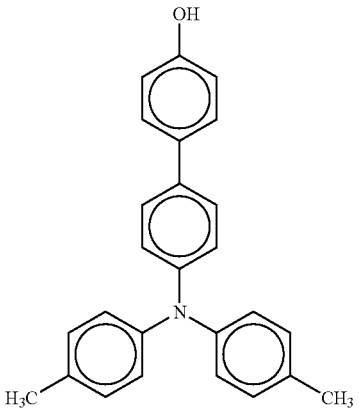

(2) Triarylamino-group-substituted acrylate compound (illustrated compound No. 54)

82.9 g (0.227 mol) of the hydroxyl-group-substituted triarylamine compound (structural formula B) obtained in (1) was dissolved in 400 ml of tetrahydrofuran and an aqueous solution of sodium hydroxide (NaOH: 12.4 g, water: 100 ml)

was dropped into the terahydrofuran solution in nitrogen stream. The obtained solution was cooled to 5° C. and 25.2 g (0.272 mol) of acryloyl chloride was dropped into the solution for 40 minutes. Then, stirring for 3 hours was performed at 5° C. to complete the reaction. Water was poured into the reaction liquid and extraction with toluene was performed. The extracted liquid was washed with an aqueous solution of sodium bicarbonate or water repeatedly. Then, solvent was removed from the toluene solution and the purification by a column chromatographic treatment (adhesion medium; silica gel, developing solvent; toluene) was carried out. n-hexane was added into the obtained colorless oil so as to precipitate a crystal. Thus, 80.73 g (yield=84.8%) of a white crystal of illustrated compound No. 54 was obtained.

Melting point: 117.5° C.-119.0° C.

TABLE 2

| | Results of elemental analysis (%) | | |
|---|---|---|---|
| | C | H | N |
| Found value | 83.13 | 6.01 | 3.16 |
| Calculated value | 83.02 | 6.00 | 3.33 |

Next, the present invention is further explained by examples in detail but the present invention is not limited to the following examples. Herein, all "part" used in the examples mean "part by weight".

Example 1-1

Coating liquid for underlying layer, coating liquid for charge generation layer, and coating liquid for charge transportation layer, which had the following compositions, were applied on an aluminum cylinder in the order by dip coating and dried so as to form 3.5 μm of an underlying layer, 0.2 μm of an charge generation layer, and 23 μm of an charge transportation layer.

{Coating Liquid for Underlying Layer}

Alkyd resin: 6 parts (Beckosol 1307-60-EL produced by DAINIPPON INK AND CHEMICALS, INCORPORATED)

Melamine resin: 4 parts (Superbeckamine G-821-60 produced by DAINIPPON INK AND CHEMICALS, INCORPORATED)

Titanium oxide: 40 parts (CR-EL: ISHIHARA SANGYO KAISHA, LTD.)

Ethyl methyl ketone: 50 parts

{Coating Liquid for Charge Generation Layer}

Bisazo pigment having the following structure: 2.5 parts

Polyvinyl butyral: 0.5 parts (XYHL produced by UCC)

Cyclohexanone: 200 parts

Ethyl methyl ketone: 80 parts

{Coating Liquid for Charge Transportation Layer}

Bisphenol Z-typed polycarbonate: 10 parts (Panlite TS-2050 produced by TEIJIN CHEMICALS LTD.)

Low-molecular-weight charge transportation material having the following structure: 7 parts

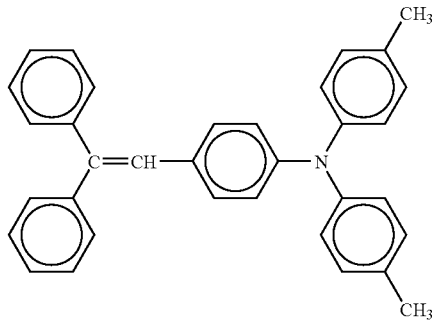

Tetrahydrofuran: 100 parts

Tetrahydrofuran solution of 1% silicone oil: 1 part (KF50-100CS produced by Shin-Etsu Chemical Co., Ltd.)

Coating liquid for cross-linked surface layer having the following composition was spray-coated on the charge transportation layer. Light irradiation was carried out by using a metal halide lamp under the condition of irradiation intensity of 500 mW/cm$^2$ and irradiation time of 20 seconds. Further, drying at 130° C. for 30 minutes was applied so as to provide 4.0 μm of a cross-linked surface layer, so that an electrophotographic photoconductor according to the present invention was obtained.

{Coating Liquid for Cross-Linked Surface Layer}

Free-radical-polymerizable monomers having no charge transporting structure: 95 parts Di-penta-erythritol hexaacrylate (a mixture with pentaacrylate based on hexaacrylate; KAYARAD DPHA produced by NIPPON KAYAKU CO., LTD.)

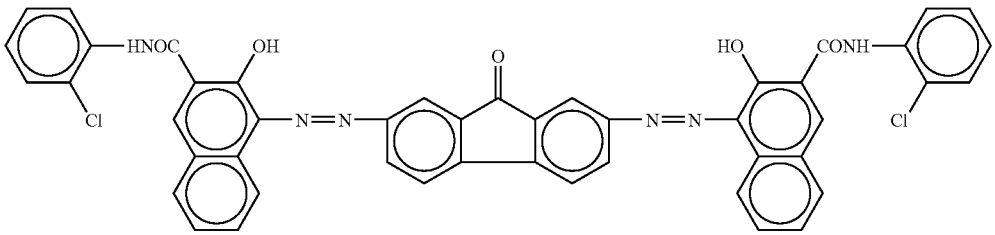

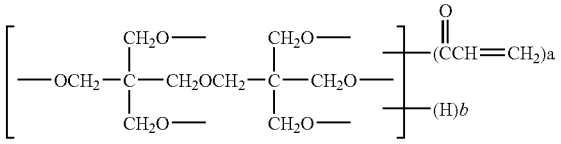

(wherein a=5 and b=1 or a=6 and b=0.)

One-functional free-radical-polymerizable compound having a charge transporting structure: 95 parts (Illustrated compound No. 54)

Photo-polymerization initiator: 10 parts 1-hydroxy-cyclohexyl phenyl ketone (Irgacure 184 produced by Ciba Specialty Chemicals)

Tetrahydrofuran: 1200 parts

Example 1-2

An electrophotographic photoconductor was produced similar to example 1-1 except that the free-radical-polymerizable monomer having no charge transporting structure contained in the coating liquid for cross-linked surface layer in example 1-1 was changed to the following compound.

Caprolactone-modified di-penta-erythritol hexaacrylate (KAYARAD DPCA-60 produced by NIPPON KAYAKU CO., LTD.)

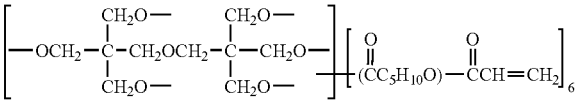

Example 1-3

An electrophotographic photoconductor was produced similar to example 1-1 except that the free-radical-polymerizable monomer having no charge transporting structure contained in the coating liquid for cross-linked surface layer in example 1-1 was changed to the following compound.

EO-modified di-penta-erythritol hexaacrylate (KAYARAD DPEA-12 produced by NIPPON KAYAKU CO., LTD.)

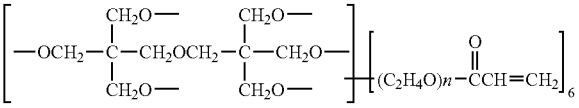

(Herein, the mean average of n is 12.)

Example 1-4

An electrophotographic photoconductor was produced similar to example 1-1 except that the free-radical-polymerizable monomer having no charge transporting structure contained in the coating liquid for cross-linked surface layer in example 1-1 was changed to the following compound.

Free-radical-polymerizable monomer having no charge transporting structure: 95 parts (1) Caprolactone-modified di-penta-erythritol hexaacrylate: 47.5 parts (KAYARAD DPCA-120 produced by NIPPON KAYAKU CO., LTD.)

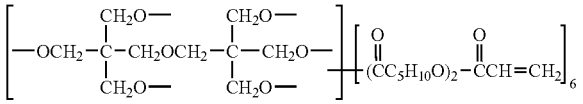

(2) Trimethylol propane triacrylate: 47.5 parts (TMPTA produced by Tokyo Kasei Kogyo Co., Ltd.)

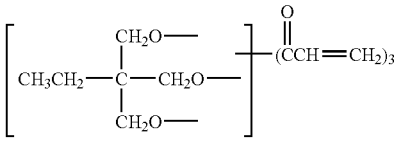

Example 1-5

An electrophotographic photoconductor was produced similar to example 1-1 except that the free-radical-polymerizable monomer having no charge transporting structure contained in the coating liquid for cross-linked surface layer in example 1-1 was changed to the following compound.

Free-radical-polymerizable monomer having no charge transporting structure: 95 parts (1) Di-penta-erythritol hexaacrylate: 47.5 parts (a mixture with pentaacrylate based on hexaacrylate; KAYARAD DPHA produced by NIPPON KAYAKU CO., LTD.)

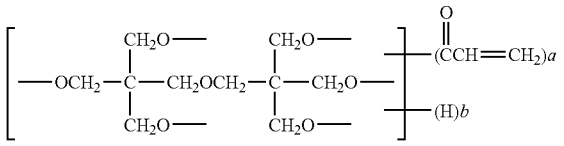

(wherein a=5 and b=1 or a=6 and b=0.)

(2) Trimethylol propane triacrylate: 47.5 parts (TMPTA produced by Tokyo Kasei Kogyo Co., Ltd.)

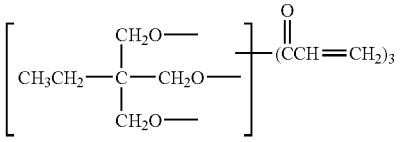

Example 1-6

An electrophotographic photoconductor was produced similar to example 1-1 except that the free-radical-polymerizable monomer having no charge transporting structure contained in the coating liquid for cross-linked surface layer in example 1-1 was changed to the following compound.

Free-radical-polymerizable monomer having no charge transporting structure: 95 parts (1) Di-penta-erythritol hexaacrylate: 47.5 parts (A mixture with pentaacrylate based on hexaacrylate; KAYARAD DPHA produced by NIPPON KAYAKU CO., LTD.)

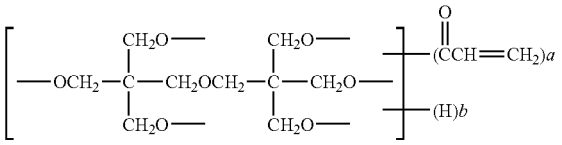

(wherein a=5 and b=1 or a=6 and b=0.)

(2) Caprolactone-modified di-penta-erythritol hexaacrylate: 47.5 parts (KAYARAD DPCA-120 produced by NIPPON KAYAKU CO., LTD.)

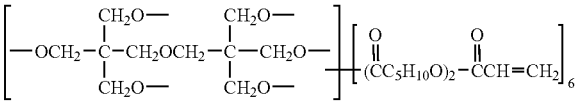

Example 1-7

An electrophotographic photoconductor was produced similar to example 1-1 except that the free-radical-polymerizable compound having a charge transporting structure contained in the coating liquid for cross-linked surface layer in example 1-1 was changed to illustrated compound No. 16.

Example 1-8

An electrophotographic photoconductor was produced similar to example 1-1 except that the free-radical-polymerizable compound having a charge transporting structure contained in the coating liquid for cross-linked surface layer in example 1-1 was changed to illustrated compound No. 24.

Example 1-9

An electrophotographic photoconductor was produced similar to example 1-1 except that the coating liquid for cross-linked surface layer in example 1-1 was changed to the following liquid.

{Coating Liquid for Cross-Linked Surface Layer}

Free-radical-polymerizable monomer having no charge transporting structure: 90 parts Caprolactone-modified di-penta-erythritol hexaacrylate (KAYARAD DPCA-120 produced by NIPPON KAYAKU CO., LTD.)

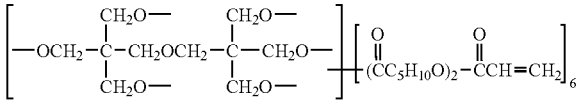

One-functional free-radical-polymerizable compound having a charge transporting structure: 90 parts (Illustrated compound No. 54)

Photo-polymerization initiator: 20 parts 1-hydroxy-cyclohexyl phenyl ketone (Irgacure 184 produced by Ciba Specialty Chemicals)

Tetrahydrofuran: 90 parts

Filler fine particles: 20 parts

Alumina filler (AA03 produced by SUMITOMO CHEMICAL CO., LTD.)

Comparison 1-1

An electrophotographic photoconductor was produced similar to example 1-1 except that the free-radical-polymerizable monomer having no charge transporting structure in example 1-1 was not added.

Comparison 1-2

An electrophotographic photoconductor was produced similar to example 1-1 except that the free-radical-polymerizable monomer having no charge transporting structure contained in the coating liquid for cross-linked surface layer in example 1-1 was changed to the following material.

Free-radical-polymerizable monomer having no charge transporting structure represented by the following structural formula: 95 parts

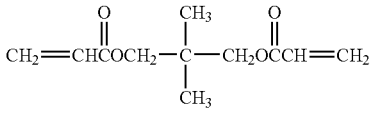

Two-functional acrylate: KAYARAD NPGDA produced by NIPPON KAYAKU CO., LTD.

Molecular weight: 212

Number of functional groups: two-functionality

Molecular weight/Number of functional groups=106

Comparison 1-3

An electrophotographic photoconductor was produced similar to example 1-1 except that the one-functional free-radical-polymerizable compound having a charge transporting structure contained in the coating liquid for cross-linked surface layer in example 1-1 was not added.

Comparison 1-4

An electrophotographic photoconductor was produced similar to example 1-1 except that the free-radical-polymerizable compound having a charge transporting structure contained in the coating liquid for cross-linked surface layer in example 1-1 was changed to the following material.

Free-radical-polymerizable compound having a charge transporting structure represented by the following structural formula: 95 parts

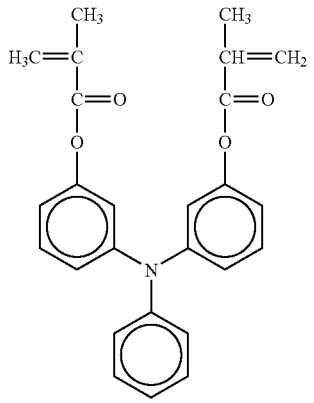

Comparison 1-5

An electrophotographic photoconductor was produced similar to example 1-1 except that the free-radical-polymerizable compound having a charge transporting structure contained in the coating liquid for cross-linked surface layer in example 1-1 was changed to the following material.

Charge transportation material represented by the following structural formula: 10 parts

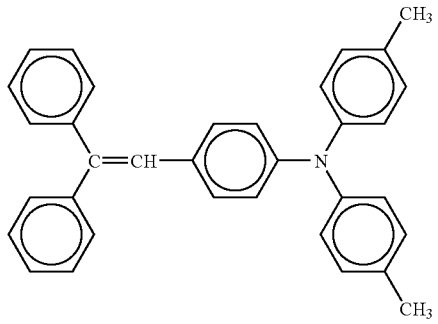

Comparison 1-6

An electrophotographic photoconductor was produced similar to example 1-1 except that the cross-linked layer was not provided and the film thickness of the charge transportation layer was 27 μm in example 1-1.

Comparison 1-7

An electrophotographic photoconductor was produced similar to example 1-1 except that the coating liquid for cross-linked surface layer was changed to the following liquid in example 1-1.

{Coating Liquid for Cross-Linked Surface Layer}

Free-radical-polymerizable monomer having no charge transporting structure: 5 parts Di-penta-erythritol hexaacrylate (a mixture with pentaacrylate based on hexaacrylate; KAYARAD DPHA produced by NIPPON KAYAKU CO., LTD.)

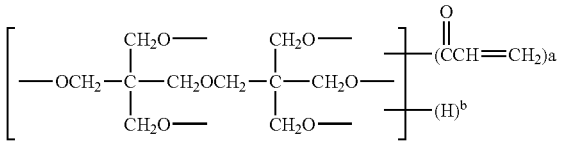

(wherein a=5 and b=1 or a=6 and b=0.)

Charge transportation material represented by the following structural formula: 20 parts

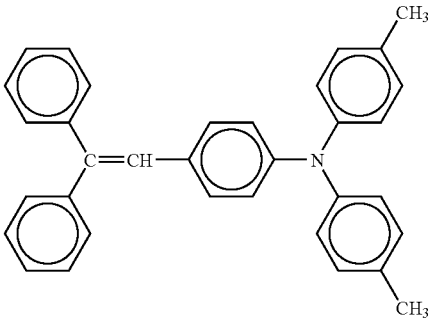

Photo-polymerization initiator: 0.15 parts 1-hydroxy-cyclohexyl phenyl ketone (Irgacure 184 produced by Ciba Specialty Chemicals)

Polycarbonate resin (bisphenol A-type): 15 parts

Monochlorobenzene: 300 parts

The electrophotographic photoconductor produced as described above was installed into a electrophotographic process cartridge and the electric potential on dark portions was set at 700 (−V) in IPSiO Color 7100 produced by Ricoh Company, Ltd., in which an AC non-contacting roller type charging device and 655 nm semiconductor laser as a light source for image-wise light exposure are employed.

Then, continuous test printing on totally 50,000 papers was performed in the actual machine and an abrasive loss and an electric potential in the machine were evaluated. The results are shown in Table 3.

TABLE 3

Results of test printing on papers in actual machine

| | | Electric potential in machine (−V) | | | |
|---|---|---|---|---|---|
| | | Initial | | After 50,000 printing | |
| | Abrasive loss (μm) | Electric potential on dark portion | Electric potential on bright portion | Electric potential on dark portion | Electric potential on bright portion |
| Example 1-1 | 1.20 | 700 | 80 | 700 | 85 |
| Example 1-2 | 1.11 | 695 | 85 | 695 | 90 |
| Example 1-3 | 1.15 | 700 | 85 | 700 | 90 |
| Example 1-4 | 1.31 | 700 | 75 | 700 | 80 |

TABLE 3-continued

| Results of test printing on papers in actual machine | | | | | |
|---|---|---|---|---|---|
| | | Electric potential in machine (−V) | | | |
| | | Initial | | After 50,000 printing | |
| | Abrasive loss (μm) | Electric potential on dark portion | Electric potential on bright portion | Electric potential on dark portion | Electric potential on bright portion |
| Example 1-5 | 1.35 | 700 | 75 | 700 | 85 |
| Example 1-6 | 1.24 | 700 | 80 | 700 | 85 |
| Example 1-7 | 1.22 | 700 | 90 | 700 | 90 |
| Example 1-8 | 1.19 | 695 | 85 | 695 | 85 |
| Example 1-9 | 0.98 | 700 | 115 | 700 | 125 |
| Comparison 1-1 | No cross-linked layer could be formed. | | | | |
| Comparison 1-2 | 2.44 | 695 | 105 | 695 | 125 |
| Comparison 1-3 | 1.44 | 685 | 350 | 655 | 244 |
| Comparison 1-4 | 2.42 | 690 | 110 | 690 | 115 |
| Comparison 1-5 | 3.02 | 690 | 85 | 685 | 95 |
| Comparison 1-6 | 6.02 | 700 | 45 | 655 | 50 |
| Comparison 1-7 | 2.28 | 700 | 90 | 690 | 105 |

Also, crack development tests for the photoconductive layers in examples 1-1, 1-2, 1-4 and comparisons 1-2, 1-4, and 1-7 were performed. As an evaluation method, after finger oil was provided on the surface of the electrophotographic photoconductor and left to stand for 3 days under 50° C. and the ordinary pressure, the crystallization conditions of the photoconductive layers were observed. The results are shown in Table 4.

TABLE 4

| Results of crack development tests | | |
|---|---|---|
| | Initial | After leaving to stand for 3 days |
| Example 1-1 | Gloss was found on photoconductor surface. | Gloss was found on photoconductor surface. |
| Example 1-2 | Gloss was found on photoconductor surface. | Gloss was found on photoconductor surface. |

TABLE 4-continued

| Results of crack development tests | | |
|---|---|---|
| | Initial | After leaving to stand for 3 days |
| Example 1-4 | Gloss was found on photoconductor surface. | Gloss was found on photoconductor surface. |
| Comparison 1-2 | No gloss and a dent were found. | A crack was made. |
| Comparison 1-4 | No gloss was found on photoconductor surface. | A crack was made. |
| Comparison 1-7 | Gloss was found on photoconductor surface. | A crack was made. |

As seen in the results of Table 3, both the improvement of abrasive resistance for a long period and the keeping of high quality image could not be simultaneously achieved in any comparison.

Also, it is understood from Table 4 that no crack was produced and the compound having a charge transporting structure was uniformly incorporated into the cross-linked film with respect to the electrophotographic photoconductor of which the cross-linked surface layer was formed by curing a free-radical-polymerizable monomer having no charge transporting structure, represented by general formula (A) and an one-functional free-radical-polymerizable compound having a charge transporting structure. As the result, it is also understood that both the improvement of the abrasive resistance for a long period and the keeping of high quality image output can be realized.

Example 2-1

Coating liquid for underlying layer, coating liquid for charge generation layer, and coating liquid for charge transportation layer, which had the following compositions, were applied on an aluminum cylinder in the order by dip coating and dried so as to form 3.5 μm of an underlying layer, 0.2 μm of an charge generation layer, and 23 μm of a charge transportation layer.

{Coating Liquid for Underlying Layer}

Alkyd resin: 6 parts (Beckosol 1307-60-EL produced by DAINIPPON INK AND CHEMICALS, INCORPORATED)

Melamine resin: 4 parts (Superbeckamine G-821-60 produced by DAINIPPON INK AND CHEMICALS, INCORPORATED)

Titanium oxide: 40 parts

Ethyl methyl ketone: 50 parts

{Coating Liquid for Charge Generation Layer}

Bisazo pigment having the following structure: 2.5 parts

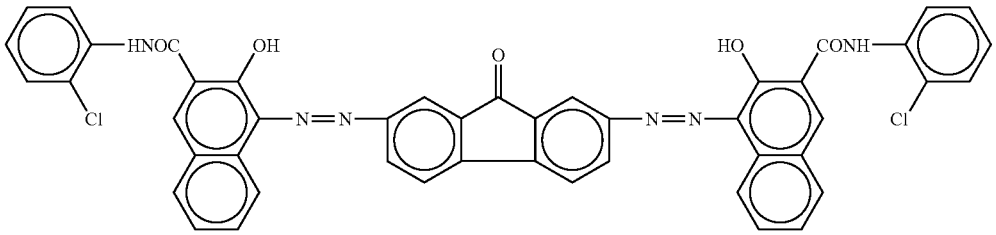

Polyvinyl butyral: 0.5 parts (XYHL produced by UCC)

Cyclohexanone: 200 parts

Ethyl methyl ketone: 80 parts

{Coating Liquid for Charge Transportation Layer}

Bisphenol Z-typed polycarbonate: 10 parts (Panlite TS-2050 produced by TEIJIN CHEMICALS LTD.)

Charge transportation material represented by the following structural formula: 7 parts

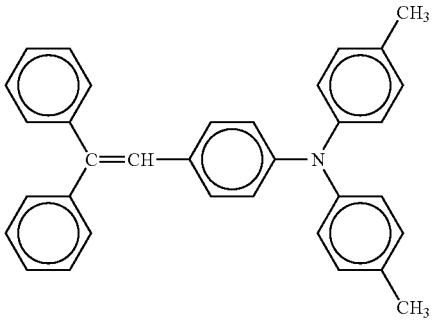

Tetrahydrofuran: 100 parts

Tetrahydrofuran solution of 1% silicone oil: 1 part (KF50-100CS produced by Shin-Etsu Chemical Co., Ltd.)

Coating liquid for cross-linked surface layer having the following composition was spray-coated on the charge transportation layer. Light irradiation was carried out by using a metal halide lamp under the condition of irradiation intensity of 500 mW/cm$^2$ and irradiation time of 20 seconds. Further, drying at 130° C. for 30 minutes was applied so as to provide 4.0 μm of a cross-linked surface layer, so that an electrophotographic photoconductor was produced.

{Coating Liquid for Cross-Linked Surface Layer}

Free-radical-polymerizable monomers having no charge transporting structure represented by the following formula: 95 parts Alkyl-modified di-penta-erythritol pentaacrylate (KAYARAD D-310 produced by NIPPON KAYAKU CO., LTD., average molecular weight: 580)

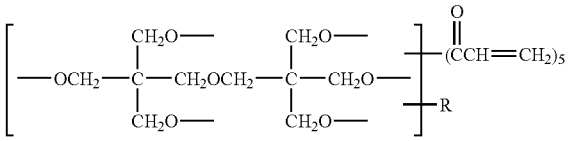

(wherein R is an Alkyl group).

One-functional free-radical-polymerizable compound having a charge transporting structure: 95 parts Illustrated compound No. 54

Photo-polymerization initiator: 10 part 1-hydroxy-cyclohexyl phenyl ketone (Irgacure 184 produced by Ciba Specialty Chemicals)

Tetrahydrofuran: 1200 part

Example 2-2

An electrophotographic photoconductor was produced similar to example 2-1 except that the free-radical-polymerizable monomer having no charge transporting structure contained in the coating liquid for cross-linked surface layer in example 2-1 was changed to the following compound.

Alkyl-modified di-penta-erythritol tetraacrylate represented by the following formula (KAYARAD D-320 produced by NIPPON KAYAKU CO., LTD., average molecular weight: 582)

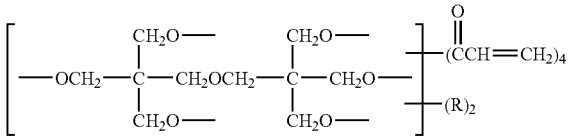

(wherein R is an Alkyl group).

Example 2-3

An electrophotographic photoconductor was produced similar to example 2-1 except that the free-radical-polymerizable monomer having no charge transporting structure contained in the coating liquid for cross-linked surface layer in example 2-1 was changed to the following compound.

Alkyl-modified di-penta-erythritol tetraacrylate represented by the following formula (KAYARAD D-330 produced by NIPPON KAYAKU CO., LTD., average molecular weight: 584)

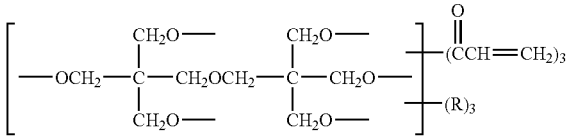

(wherein R is an Alkyl group).

Example 2-4

An electrophotographic photoconductor was produced similar to example 2-1 except that the free-radical-polymerizable monomer having no charge transporting structure contained in the coating liquid for cross-linked surface layer in example 2-1 was changed to the following two kinds of compounds.

Free-radical-polymerizable monomer having no charge transporting structure: total 95 parts (1) Alkyl-modified di-penta-erythritol pentaacrylate represented by the following formula: 47.5 parts (KAYARAD D-310 produced by NIPPON KAYAKU CO., LTD., average molecular weight: 580)

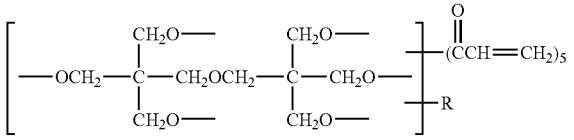

(wherein R is an Alkyl group).

(2) Trimethylol propane triacrylate: 47.5 parts (TMPTA produced by Tokyo Kasei Kogyo Co., Ltd.)

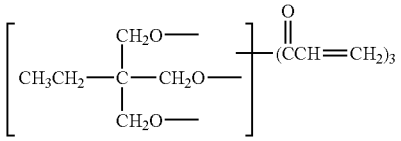

Example 2-5

An electrophotographic photoconductor was produced similar to example 2-1 except that the free-radical-polymerizable monomer having no charge transporting structure contained in the coating liquid for cross-linked surface layer in example 2-1 was changed to the following two kinds of compounds.

Free-radical-polymerizable monomer having no charge transporting structure: total 95 parts (1) Alkyl-modified di-penta-erythritol pentaacrylate represented by the following formula: 47.5 parts (KAYARAD D-320 produced by NIPPON KAYAKU CO., LTD., average molecular weight: 582)

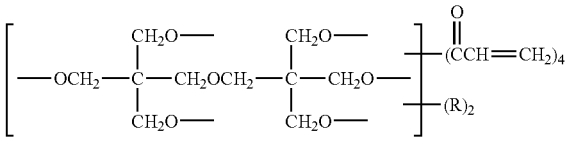

(2) Trimethylol propane triacrylate represented by the following formula: 47.5 parts (TMPTA produced by Tokyo Kasei Kogyo Co., Ltd.)

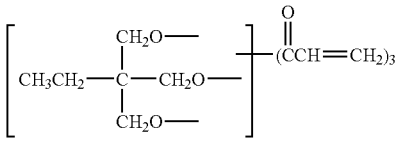

Example 2-6

An electrophotographic photoconductor was produced similar to example 2-1 except that the free-radical-polymerizable monomer having no charge transporting structure contained in the coating liquid for cross-linked surface layer in example 2-1 was changed to the following two kinds of compounds.

Free-radical-polymerizable monomer having no charge transporting structure: total 95 parts (1) Di-penta-erythritol pentaacrylate represented by the following formula: 47.5 parts (KAYARAD D-330 produced by NIPPON KAYAKU CO., LTD., average molecular weight: 584)

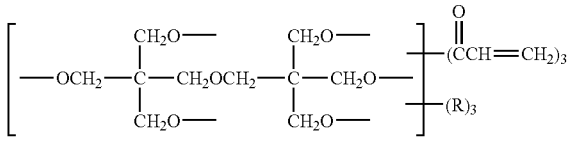

(wherein R is an Alkyl group.)

(2) Caprolactone-modified di-penta-erythritol hexaacrylate: 47.5 parts (KAYARAD DPCA-120 produced by NIPPON KAYAKU CO., LTD.)

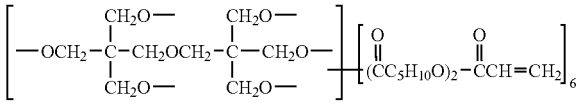

Example 2-7

An electrophotographic photoconductor was produced similar to example 2-1 except that the one-functional free-radical-polymerizable compound having a charge transporting structure contained in the coating liquid for cross-linked surface layer in example 2-1 was changed to illustrated compound No. 16.

Example 2-8

An electrophotographic photoconductor was produced similar to example 2-1 except that the one-functional free-radical-polymerizable compound having a charge transporting structure contained in the coating liquid for cross-linked surface layer in example 2-1 was changed to illustrated compound No. 24.

Example 2-9

An electrophotographic photoconductor was produced similar to example 2-1 except that the coating liquid for cross-linked surface layer in example 2-1 was changed to the following liquid.

{Coating Liquid for Cross-Linked Surface Layer}

Free-radical-polymerizable monomer having no charge transporting structure represented by the following formula: 90 parts Caprolactone-modified di-penta-erythritol hexaacrylate (KAYARAD D-310 produced by NIPPON KAYAKU CO., LTD., average molecular weight: 580)

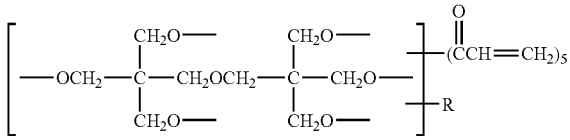

(wherein R is an Alkyl group.)

One-functional free-radical-polymerizable compound having a charge transporting structure: 90 parts Illustrated compound No. 54

Photo-polymerization initiator: 20 parts 1-hydroxy-cyclohexyl phenyl ketone (Irgacure 184 produced by Ciba Specialty Chemicals)

Tetrahydrofuran: 90 parts

Filler fine particles: 20 parts

Alumina filler (AA03 produced by SUMITOMO CHEMICAL CO., LTD.)

Comparison 2-1

An electrophotographic photoconductor was produced similar to example 2-1 except that the free-radical-polymerizable monomer having no charge transporting structure contained in the coating liquid for cross-linked surface layer in example 2-1 was not added.

Comparison 2-2

An electrophotographic photoconductor was produced similar to example 2-1 except that the free-radical-polymerizable monomer having no charge transporting structure contained in the coating liquid for cross-linked surface layer in example 2-1 was changed to the following material.

Free-radical-polymerizable monomer having no charge transporting structure represented by the following structural formula: 95 parts

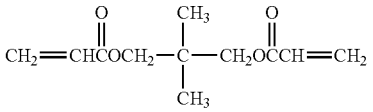

Two-functional acrylate: KAYARAD NPGDA produced by NIPPON KAYAKU CO., LTD.

Molecular weight: 212

Number of functional groups: two-functionality

Molecular weight/Number of functional groups=106

Comparison 2-3

An electrophotographic photoconductor was produced similar to example 2-1 except that the one-functional free-radical-polymerizable compound having a charge transporting structure contained in the coating liquid for cross-linked surface layer in example 2-1 was not added.

Comparison 2-4

An electrophotographic photoconductor was produced similar to example 2-1 except that the one-functional free-radical-polymerizable compound having a charge transporting structure contained in the coating liquid for cross-linked surface layer in example 2-1 was changed to the following material.

Free-radical-polymerizable compound having a charge transporting structure represented by the following structural formula: 95 parts

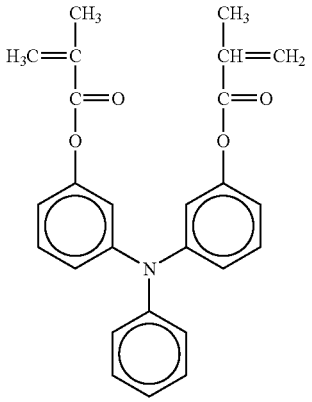

Comparison 2-5

An electrophotographic photoconductor was produced similar to example 2-1 except that the free-radical-polymerizable compound having a charge transporting structure contained in the coating liquid for cross-linked surface layer in example 2-1 was changed to the following material.

Charge transportation material represented by the following structural formula: 10 parts

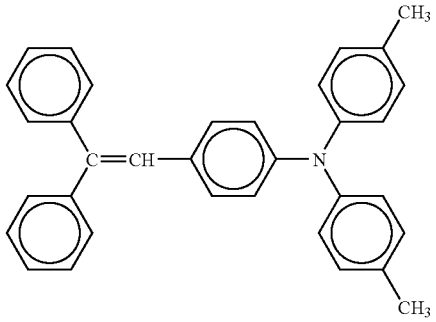

Comparison 2-6

An electrophotographic photoconductor was produced similar to example 2-1 except that the cross-linked surface layer was not provided and the film thickness of the charge transportation layer was 27 μm in example 2-1.

Comparison 2-7

An electrophotographic photoconductor was produced similar to example 2-1 except that the free-radical-polymerizable monomer having no charge transporting structure contained in the coating liquid for cross-linked surface layer in example 2-1 was changed to the following compound.

Free-radical-polymerizable monomer having no charge transporting structure represented by the following formula: 5 parts Di-penta-erythritol hexaacrylate: KAYARAD DPHA produced by NIPPON KAYAKU CO., LTD.

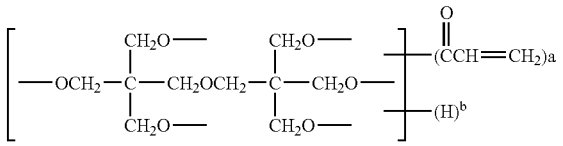

wherein a = 5.5 and b = 0.5.

Comparison 2-8

An electrophotographic photoconductor was produced similar to example 2-9 except that the free-radical-polymerizable monomer having no charge transporting structure contained in the coating liquid for cross-linked surface layer in example 2-9 was changed to the following compound.

Free-radical-polymerizable monomer having no charge transporting structure represented by the following formula: 95 parts Di-penta-erythritol hexaacrylate: KAYARAD DPHA produced by NIPPON KAYAKU CO., LTD.

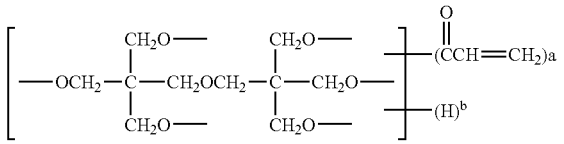

wherein a = 5.5 and b = 0.5.

The electrophotographic photoconductor produced as described above was installed into a electrophotographic process cartridge and a grid voltage was set at 1000 (−V) in a copying machine obtained by remodeling the light source for light exposure in imagio MF 8570 produced by Ricoh Company, Ltd., into a light source for 655 nm. Then, the electric potential on a bright portion was obtained as an initial value at the time of outputting 10 recording papers with A4 size on the condition of light irradiation for the whole surface. Further, continuous test printing on total 500,000 papers was performed for durability evaluation in the actual machine and an abrasive loss of the photoconductor, an electric potential in the machine, and outputted images were evaluated. In addition, ten-point height of irregularities (Rz) was measured by using surface roughness tester SURFCOM 1400D produced by TOKYO SEIMITSU CO., LTD., for evaluating the surface property of the produced photoconductor. The results are shown in Table 5.

TABLE 5

| | | Results of test printing on papers in actual machine | | | | | |
|---|---|---|---|---|---|---|---|
| | | Electric potential in machine (−V) | | | | | |
| | | Initial | | After 50,000 printing | | | |
| | Abrasive loss (μm) | Electric potential on dark portion | Electric potential on bright portion | Electric potential on dark portion | Electric potential on bright portion | Image evaluation | Rz (μm) |
| Example 2-1 | 1.00 | 800 | 80 | 800 | 85 | Good | 0.32 |
| Example 2-2 | 1.15 | 795 | 85 | 795 | 90 | Good | 0.33 |
| Example 2-3 | 1.21 | 800 | 85 | 800 | 90 | Good | 0.33 |
| Example 2-4 | 1.15 | 800 | 75 | 800 | 80 | Good | 0.34 |
| Example 2-5 | 1.23 | 800 | 75 | 800 | 85 | Good | 0.35 |
| Example 2-6 | 1.28 | 800 | 80 | 800 | 85 | Good | 0.31 |
| Example 2-7 | 1.08 | 800 | 90 | 800 | 90 | Good | 0.32 |
| Example 2-8 | 1.06 | 795 | 85 | 795 | 85 | Good | 0.32 |
| Example 2-9 | 0.97 | 800 | 115 | 800 | 125 | Good | 0.38 |
| Comparison 2-1 | | No cross-linked layer could be formed. | | | | No cross-linked layer could be formed. | |
| Comparison 2-2 | 2.44 | 795 | 105 | 795 | 125 | Good | 0.35 |
| Comparison 2-3 | 1.44 | 785 | 350 | 755 | 355 | Lowering in image density | 0.30 |
| Comparison 2-4 | 2.42 | 790 | 110 | 790 | 115 | Slight lowering in image density | 0.53 |
| Comparison 2-5 | 3.02 | 790 | 85 | 785 | 95 | Slight lowering in image density | 0.35 |
| Comparison 2-6 | 6.02 | 800 | 45 | 755 | 50 | Slight lowering in image density | 0.27 |
| Comparison 2-7 | 1.03 | 800 | 90 | 790 | 105 | Good | 0.33 |
| Comparison 2-8 | 0.96 | 800 | 120 | 800 | 125 | Good | 0.39 |

Also, similar test printing for durability evaluation on totally 50,000 papers was performed under the environmental condition of high temperature and high humidity, that is, at the temperature of 30° C. and the humidity of 90%, and electric potential in the machine and outputted image were evaluated with respect to examples 2-1, 2-2, 2-4 and comparisons 2-4, 2-7, and 2-8. The results are shown in Table 6.

TABLE 6

| Evaluation results of environment resistance tests under 30° C. and 90% | | | | | | |
|---|---|---|---|---|---|---|
| | | Electric potential in machine (−V) | | | | |
| | | Initial | | After 100,000 printing | | |
| | Abrasive loss (μm) | Electric potential on dark portion | Electric potential on bright portion | Electric potential on dark portion | Electric potential on bright portion | Image evaluation |
| Example 2-1 | 1.02 | 800 | 75 | 800 | 85 | Good |
| Example 2-2 | 1.12 | 800 | 75 | 800 | 85 | Good |
| Example 2-4 | 1.00 | 800 | 80 | 800 | 85 | Good |
| Comparison 2-4 | 2.45 | 790 | 110 | 790 | 115 | Slight lowering in image density |
| Comparison 2-7 | 1.08 | 790 | 90 | 740 | 110 | Lowering in image density |
| Comparison 2-8 | 0.99 | 790 | 120 | 745 | 135 | Lowering in image density |

Furthermore, similar test printing for durability evaluation was performed under the environmental condition of low temperature and low humidity, that is, at the temperature of 10° C. and the humidity of 15%. Similarly, the obtained images were visually evaluated. The results are shown in Table 7.

TABLE 7

| Evaluation results of environment resistance tests under 10° C. and 15% | | | | | | |
|---|---|---|---|---|---|---|
| | | Electric potential in machine (−V) | | | | |
| | | Initial | | After 100,000 printing | | |
| | Abrasive loss (μm) | Electric potential on dark portion | Electric potential on bright portion | Electric potential on dark portion | Electric potential on bright portion | Image evaluation |
| Example 2-1 | 0.95 | 800 | 85 | 800 | 95 | Good |
| Example 2-2 | 1.02 | 800 | 85 | 800 | 95 | Good |
| Example 2-4 | 0.97 | 800 | 90 | 800 | 95 | Good |
| Comparison 2-4 | 2.25 | 790 | 110 | 790 | 115 | Slight lowering in image density |
| Comparison 2-7 | 1.05 | 790 | 140 | 745 | 180 | Lowering in image density |
| Comparison 2-8 | 0.97 | 790 | 160 | 750 | 185 | Lowering in image density |

As seen in the results of Table 5, both the improvement of abrasive resistance for a long period and the keeping of high quality image could not be achieved simultaneously in any comparison.

Additionally, it is understood that good results were obtained in Table 5 but a high quality image cannot be obtained under the environmental condition of high temperature and high humidity in Table 6 with respect to comparisons 7 and 8.

Also, it is understood from Table 6 and 7 that stable photoconductor properties can be obtained under the environmental condition of high temperature and high humidity or under the environmental condition of low temperature and low humidity with respect to the electrophotographic photoconductor of which the cross-linked surface layer was formed by curing a free-radical-polymerizable monomer having no charge transporting structure, represented by general formula (A) and an one-functional free-radical-polymerizable compound having a charge transporting structure. As the result, it is also understood that the enhancement of the durability against the environment can be realized and both the improvement of the abrasive resistance for a long period and the keeping of high quality image output can be achieved.

Further, the present invention is not limited to these embodiments, but various variations and modifications may be made without departing from the scope of the present invention.

The present application is based on Japanese priority applications No. 2004-007871 filed on Jan. 15, 2004, No. 2004-148853 filed on May 19, 2004, and No. 2004-372872 filed on Dec. 24, 2004, the entire contents of which are hereby incorporated by reference.

APPENDIX

[1] An electrophotographic photoconductor having at least a photoconductive layer on an electrically conductive support, in which a surface layer of the photoconductive layer can be obtained by curing at least a free-radical-polymerizable monomer having no charge transporting structure, represented by general formula (A)

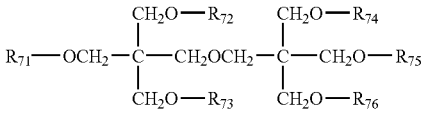

and a one-functional free-radical-polymerizable compound having a charge transporting structure, wherein each of $R_{71}$, $R_{72}$, $R_{73}$, $R_{74}$, $R_{75}$, and $R_{76}$ is a hydrogen atom or

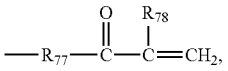

$R_{77}$ is a single bond, an alkylene group, an alkylene ether group, or an alkyleneoxycarbonyl group, $R_{78}$ is a hydrogen atom or a methyl group, and one or none of $R_{71}$ through $R_{76}$ is a hydrogen atom.

[2] The electrophotographic photoconductor described in [1], wherein a functional group(s) of the one-functional free-radical-polymerizable compound having a charge transporting structure is/are an acryloyloxy group or/and a methacryloyloxy group.

[3] The electrophotographic photoconductor described in [1] or [2], wherein a charge transporting structure of the one-functional free-radical-polymerizable compound(s) having a charge transporting structure is/are at least one of compounds represented by general formula (1)

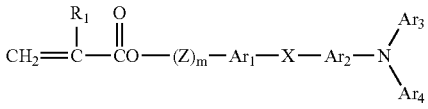

and general formula (2)

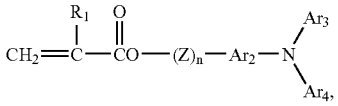

wherein $R_1$ is a hydrogen atom, a halogen atom, an alkyl group which may have a substituent, an aralkyl group which may have a substituent, an aryl group which may have a substituent, a cyano group, a nitro group, an alkoxy group, —$COOR_7$, a carbonyl halide group, or $CONR_8R_9$, $R_7$ is a hydrogen atom, an alkyl group which may have a substituent, an aralkyl group which may have a substituent, or an aryl group which may have a substituent, each of $R_8$ and $R_9$ is a hydrogen atom, a halogen atom, an alkyl group which may have a substituent, an aralkyl group which may have a substituent, or an aryl group which may have a substituent, which may be identical to or different from each other, each of $Ar_1$ and $Ar_2$ is a substituted or non-substituted arylene group, which may be identical to or different from each other, each of $Ar_3$ and $Ar_4$ is a substituted or non-substituted aryl group, which may be identical to or different from each other, X is a single bond, a substituted or non-substituted alkylene group, a substituted or non-substituted cycloalkylene group, a substituted or non-substituted alkylene ether group, an oxygen atom, a sulfur atom, or a vinylene group, Z is a substituted or non-substituted alkylene group, a substituted or non-substituted alkylene ether group, or an alkyleneoxycarbonyl group, and each of m and n is an integer of 0 through 3.

[5] The electrophotographic photoconductor described in any of [1] through [4], wherein the one-functional free-radical-polymerizable compound(s) having a charge transporting structure is/are at least one of compounds represented by general formula (3)

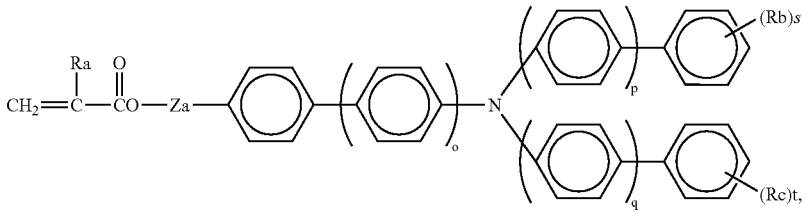

wherein each of o, p, and q is an integer of 0 or 1, Ra is a hydrogen atom or a methyl group, each of Rb and Rc is a alkyl group in which the number of carbons is 1 through 6, where if the number of Rb or Rc is a plural number, the plural Rbs or one-functional free-radical-polymerizable compound having a charge transporting structure is a triarylamine structure.

[4] The electrophotographic photoconductor described in any of [1] through [3], wherein the one-functional free-radi- Rcs may be different from each other, each of s and t is an integer of 0 through 3, and Za is a single bond, a methylene group, an ethylene group,

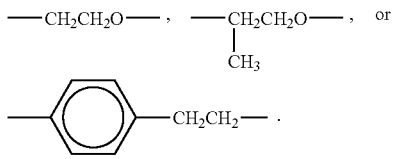

[6] The electrophotographic photoconductor described in any of [1] through [5], wherein a curing device for the surface layer is a heating device or a light energy irradiation device.

[7] The electrophotographic photoconductor described in any of [1] through [6], wherein the photoconductive layer has a laminated layer structure of a charge generation layer, a charge transportation layer, and a cross-linked surface layer on the support.

[8] An image formation method in which at least charging, image-wise light exposure, developing, and transcription are repeated using the electrophotographic photoconductor described in any of [1] through [7].

[9] An image formation apparatus having the electrophotographic photoconductor described in any of [1] through [7].

[10] A process cartridge for image formation apparatus detachable from a main body of an image formation apparatus, having the electrophotographic photoconductor described in any of [1] through [7] and at least one device selected from the group consisting of a charging device, a developing device, a transcription device, a cleaning device, and a charge elimination device.

[11] An electrophotographic photoconductor having at least a photoconductive layer on an electrically conductive support, in which a surface layer of the photoconductive layer can be obtained by curing at least a free-radical-polymerizable monomer having no charge transporting structure, represented by general formula (A)

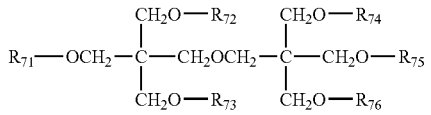

and a one-functional free-radical-polymerizable compound having a charge transporting structure, wherein three through five of $R_{71}$, $R_{72}$, $R_{73}$, $R_{74}$, $R_{75}$, and $R_{76}$ are represented by a general formula (B)

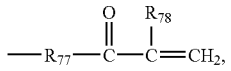

$R_{77}$ is a single bond, an alkylene group, an alkylene ether group, or an alkyleneoxycarbonyl group, $R_{78}$ is a hydrogen atom or a methyl group, functional groups represented by general formula (B) may be identical to or different from each other, a functional group except the functional groups represented by general formula (B) among $R_{71}$, $R_{72}$, $R_{73}$, $R_{74}$, $R_{75}$, and $R_{76}$ is independently a functional group such as an alkyl group which may have a substituent in which the number of carbons is equal to or less than 6.

[12] The electrophotographic photoconductor described in [11], wherein a functional group(s) of the one-functional free-radical-polymerizable compound having a charge transporting structure is/are an acryloyloxy group or/and a methacryloyloxy group.

[13] The electrophotographic photoconductor described in [11] or [12], wherein a charge transporting structure of the one-functional free-radical-polymerizable compound having a charge transporting structure is a triarylamine structure.

[14] The electrophotographic photoconductor described in any of [11] through [13], wherein the one-functional free-radical-polymerizable compound(s) having a charge transporting structure is/are at least one of compounds represented by general formula (1)

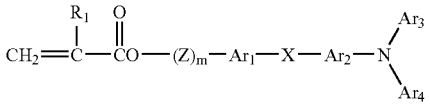

and general formula (2)

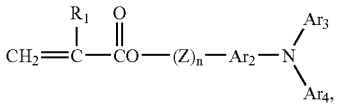

wherein $R_1$ is a hydrogen atom, a halogen atom, an alkyl group which may have a substituent, an aralkyl group which may have a substituent, an aryl group which may have a substituent, a cyano group, a nitro group, an alkoxy group, —$COOR_7$, a carbonyl halide group, or $CONR_8R_9$, $R_7$ is a hydrogen atom, an alkyl group which may have a substituent, an aralkyl group which may have a substituent, or an aryl group which may have a substituent, each of $R_8$ and $R_9$ is a hydrogen atom, a halogen atom, an alkyl group which may have a substituent, an aralkyl group which may have a substituent, or an aryl group which may have a substituent, which may be identical to or different from each other, each of $Ar_1$ and $Ar_2$ is a substituted or non-substituted arylene group, which may be identical to or different from each other, each of $Ar_3$ and $Ar_4$ is a substituted or non-substituted aryl group, which may be identical to or different from each other, X is a single bond, a substituted or non-substituted alkylene group, a substituted or non-substituted cycloalkylene group, a substituted or non-substituted alkylene ether group, an oxygen atom, a sulfur atom, or a vinylene group, Z is a substituted or non-substituted alkylene group, a substituted or non-substituted alkylene ether group, or an alkyleneoxycarbonyl group, and each of m and n is an integer of 0 through 3.

[15] The electrophotographic photoconductor described in any of [11] through [14], wherein the one-functional free-radical-polymerizable compound(s) having a charge transporting structure is/are at least one of compounds represented by general formula (3)

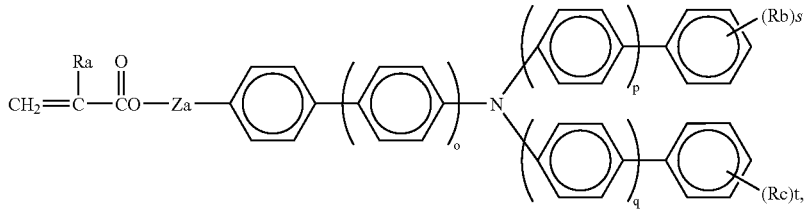

wherein each of o, p, and q is an integer of 0 or 1, Ra is a hydrogen atom or a methyl group, each of Rb and Rc is a alkyl group in which the number of carbons is 1 through 6, where if the number of Rb or Rc is a plural number, the plural Rbs or Rcs may be different from each other, each of s and t is an integer of 0 through 3, and Za is a single bond, a methylene group, an ethylene group,

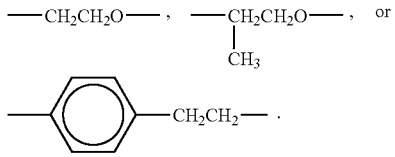

[16] The electrophotographic photoconductor described in any of [11] through [15], wherein a curing device for the surface layer is a heating device or a light energy irradiation device.

[17] The electrophotographic photoconductor described in any of [11] through [16], wherein the photoconductive layer has a laminated layer structure of a charge generation layer, a charge transportation layer, and a cross-linked surface layer on the support.

[18] An image formation method in which at least charging, image-wise light exposure, developing, and transcription are repeated using the electrophotographic photoconductor described in any of [11] through [17].

[19] An image formation apparatus having the electrophotographic photoconductor described in any of [11] through [17].

[20] A process cartridge for image formation apparatus detachable from a main body of an image formation apparatus, having the electrophotographic photoconductor described in any of [11] through [17] and at least one device selected from the group consisting of a charging device, a developing device, a transcription device, a cleaning device, and a charge elimination device.

According to the present invention, a photoconductor with high service durability, good electrical characteristics, and good image formation for a long period can be provided using a resin obtained by mixing, polymerizing, and curing compounds with a reactive functional group, more specifically, a free-radical-polymerizable monomer having no charge transporting structure, represented by general formula (A) and a one-functional free-radical-polymerizable monomer having a charge transporting structure, as a resin component of a cross-linked surface layer of a photoconductive layer.

According to the present invention, a photoconductor with high service durability, good electrical characteristics, and excellent environmental resistance for a long period, using a resin obtained by mixing, polymerizing, and curing compounds with a reactive functional group, more specifically, a free-radical-polymerizable monomer having no charge transporting structure, represented by general formula (A) and a one-functional free-radical-polymerizable monomer having a charge transporting structure, as a resin component of a cross-linked surface layer of a photoconductive layer.

Therefore, an image formation process, an image formation apparatus, and a process cartridge for image formation apparatus, which have high performance and high reliability and can provide higher quality image for a long period, can be provided using one of the aforementioned photoconductors.

What is claimed is:

1. An electrophotographic photoconductor having at least a photoconductive layer on an electrically conductive support, in which a surface layer of the photoconductive layer can be obtained by curing at least a free-radical-polymerizable monomer having no charge transporting structure, represented by general formula (A)

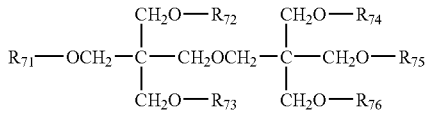

and a one-functional free-radical-polymerizable compound having a charge transporting structure, wherein each of $R_{71}$, $R_{72}$, $R_{73}$, $R_{74}$, $R_{75}$, and $R_{76}$ is a hydrogen atom or

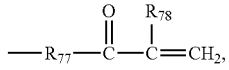

$R_{77}$ is a single bond, an alkylene group, an alkylene ether group, or an alkyleneoxycarbonyl group, $R_{78}$ is a hydrogen atom or a methyl group, and one or none of $R_{71}$ through $R_{76}$ is a hydrogen atom, wherein when $R_{77}$ is a single bond, one of $R_{71}$ through $R_{76}$ is a hydrogen atom.

2. The electrophotographic photoconductor as claimed in claim 1, wherein a functional group(s) of the one-functional free-radical-polymerizable compound having a charge transporting structure is/are an acryloyloxy group or/and a methacryloyloxy group.

3. The electrophotographic photoconductor as claimed in claim 1, wherein a charge transporting structure of the one-functional free-radical-polymerizable compound having a charge transporting structure is a triarylamine structure.

4. The electrophotographic photoconductor as claimed in claim 1, wherein the one-functional free-radical-polymerizable compound(s) having a charge transporting structure is/are at least one of compounds represented by general formula (1)

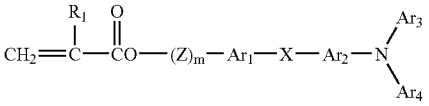

and general formula (2)

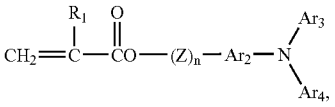

wherein $R_1$ is a hydrogen atom, a halogen atom, an alkyl group which may have a substituent, an aralkyl group which may have a substituent, an aryl group which may have a substituent, a cyano group, a nitro group, an alkoxy group, —$COOR_7$, a carbonyl halide group, or $CONR_8R_9$, $R_7$ is a hydrogen atom, an alkyl group which may have a substituent, an aralkyl group which may have a substituent, or an aryl group which may have a substituent, each of $R_5$ and $R_9$ is a hydrogen atom, a halogen atom, an alkyl group which may have a substituent, an aralkyl group which may have a substituent, or an aryl group which may have a substituent, which may be identical to or different from each other, each of $Ar_1$ and $Ar_2$ is a substituted or non-substituted arylene group, which may be identical to or different from each other, each of $Ar_3$ and $Ar_4$ is a substituted or non-substituted aryl group, which may be identical to or different from each other, X is a single bond, a substituted or non-substituted alkylene group, a substituted or non-substituted cycloalkylene group, a substituted or non-substituted alkylene ether group, an oxygen atom, a sulfur atom, or a vinylene group, Z is a substituted or non-substituted alkylene group, a substituted or non-substituted alkylene ether group, or an alkyleneoxycarbonyl group, and each of m and n is an integer of 0 through 3.

5. The electrophotographic photoconductor as claimed in claim 1, wherein the one-functional free-radical-polymerizable compound(s) having a charge transporting structure is/are at least one of compounds represented by general formula (3)

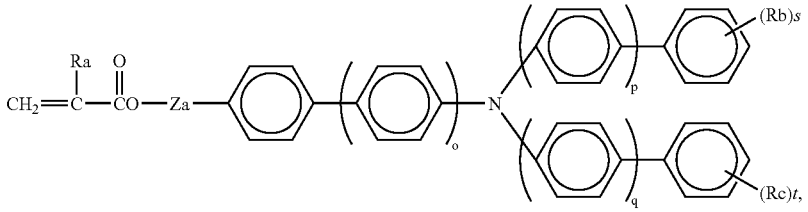

wherein each of o, p, and q is an integer of 0 or 1,

Ra is a hydrogen atom or a methyl group, each of Rb and Rc is an alkyl group in which the number of carbons is 1 through 6, where if the number of Rb or Rc is a plural number, the plural Rbs or Rcs may be different from each other, each of s and t is an integer of 0 through 3, and Za is a single bond, a methylene group, an ethylene group,

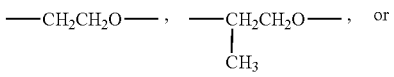

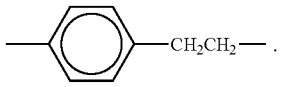

6. The electrophotographic photoconductor as claimed in claim 1, wherein a curing device for the surface layer is a heating device or a light energy irradiation device.

7. The electrophotographic photoconductor as claimed in claim 1, wherein the photoconductive layer has a laminated layer structure of a charge generation layer, a charge transportation layer, and a cross-linked surface layer on the support.

8. An image formation method in which at least charging, image-wise light exposure, developing, and transcription are repeated using the electrophotographic photoconductor as claimed in claim 1.

9. An image formation apparatus having the electrophotographic photoconductor as claimed in claim 1.

10. A process cartridge for image formation apparatus detachable from a main body of an image formation apparatus, having the electrophotographic photoconductor as claimed in claim 1 and at least one device selected from the group consisting of a charging device, a developing device, a transcription device, a cleaning device, and a charge elimination device.

* * * * *